US011780067B2

(12) United States Patent
Mochizuki et al.

(10) Patent No.: US 11,780,067 B2
(45) Date of Patent: Oct. 10, 2023

(54) PNEUMATIC TOOL

(71) Applicant: MAX CO., LTD., Tokyo (JP)

(72) Inventors: Kazuya Mochizuki, Tokyo (JP); Kousuke Moriwaki, Tokyo (JP); Hiroshi Tanaka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/362,270

(22) Filed: Jun. 29, 2021

(65) Prior Publication Data

US 2021/0402580 A1 Dec. 30, 2021

(30) Foreign Application Priority Data

Jun. 30, 2020 (JP) ..... 2020-113613

(51) Int. Cl.
*B25C 1/04* (2006.01)
*B25C 1/00* (2006.01)

(52) U.S. Cl.
CPC ..... *B25C 1/047* (2013.01); *B25C 1/042* (2013.01); *B25C 1/008* (2013.01); *B25C 1/043* (2013.01)

(58) Field of Classification Search
None
See application file for complete search history.

(56) References Cited

U.S. PATENT DOCUMENTS 3,190,189 A * 6/1965 Mosetich ..... B25C 1/008 91/461
3,964,659 A * 6/1976 Eiben ..... B25C 1/008 227/7
4,736,879 A * 4/1988 Yamada ..... B25C 1/041 417/264
2014/0231485 A1 8/2014 Bauer
2019/0022842 A1* 1/2019 Oouchi ..... B25C 1/047
2019/0111552 A1* 4/2019 Nagao ..... B25C 7/00

FOREIGN PATENT DOCUMENTS

JP H06-032308 A 8/1994
JP UM-H06-032308 Y2 8/1994

OTHER PUBLICATIONS

European Search Report for EP Application No. 21182526.0 dated Nov. 25, 2021. (9 pp.).

* cited by examiner

*Primary Examiner* — Tanzim Imam
(74) *Attorney, Agent, or Firm* — Weihrouch IP

(57) ABSTRACT

A pneumatic tool includes a drive part configured to be driven by compressed air, a control valve configured to switch the presence or absence of operation of the drive part, and a timer part configured to switch the presence or absence of operation of the control valve after a lapse of a predetermined time. The timer part includes a timer piston configured to move in one direction, a timer piston cylinder configured to support the timer piston such that the timer piston can slide, and an on-off valve part configured to switch the presence or absence of operation of the control valve in conjunction with the timer piston. The on-off valve part includes a shaft portion configured to move in conjunction with the timer piston, and compressed air flowing into the on-off valve part presses the shaft portion in the one direction.

12 Claims, 38 Drawing Sheets

PNEUMATIC TOOL

CROSS-REFERENCE TO RELATED APPLICATION

This application is based upon and claims the benefit of priority from prior Japanese patent application No. 2020-113613, filed on Jun. 30, 2020, the entire contents of which are incorporated herein by reference.

TECHNICAL FIELD

The present disclosure relates to a pneumatic tool that operates using compressed air as a power source.

BACKGROUND ART

A pneumatic tool called a nailing machine is known in which a striking piston is reciprocated using compressed air as a power source to drive a driver coupled to the striking piston and strike a nail or the like supplied to a nose. Such a nailing machine is configured to strike a nail by operating a main valve with two operations, that is, one operation of pulling a trigger provided on a grip portion and another operation of pressing a contact arm that protrudes from a tip of the nose and can be reciprocated against a member to be driven.

In the following description, the state in which the trigger is pulled by one operation is referred to as ON of the trigger, and the state in which one operation is released and the trigger is not pulled is referred to as OFF of the trigger. Further, the state in which the contact arm is pressed by another operation is referred to as ON of the contact arm, and the state in which another operation is released and the contact arm is not pressed is referred to as OFF of the contact arm.

In the nailing machine, for example, the main valve is operated by turning on the trigger and then turning on the contact arm with the trigger turned on, thereby striking a nail.

A technique has been proposed in which, after striking a nail, a main valve is operated by turning off a contact arm with a trigger turned on and turning on the contact arm again with the trigger turned on, thereby striking next nail. In this way, an operation of continuously striking a nail by repeating ON and OFF of the contact arm with the trigger turned on is referred to as contact striking.

In the contact striking, after striking a nail, a nail can be continuously struck every time the contact arm is turned on with the trigger turned on, which is suitable for quick work. On the other hand, in order to regulate careless operation, a technique has been proposed in which the main valve is deactivated when a predetermined time has elapsed without turning on the contact arm after the trigger is turned on (e.g., see PTL 1).

CITATION LIST

Patent Literature

PTL 1: Japanese Examined Utility-Model Publication No. H6-32308

SUMMARY OF INVENTION

In the configuration in which the main valve is deactivated when a predetermined time has elapsed without turning on the contact arm after the trigger is turned on, the timekeeping can be stably performed by measuring a lapse of a predetermined time using an electric timer. However, nailing machines driven by compressed air do not include a source of electricity. Therefore, a power supply and a circuit are required in order to use an electric timer.

On the other hand, PTL 1 proposes a timekeeping mechanism that uses the pressure of compressed air in a main chamber to store compressed air for operating a nailing machine. For example, the timekeeping mechanism using the air pressure has a configuration in which compressed air is supplied from a main chamber to a space of a predetermined volume and the main valve is operated by the air pressure when the pressure in the space reaches a predetermined pressure.

Such a timekeeping mechanism does not require a power supply and a circuit. However, since the pressure in the main chamber fluctuates due to the fact that the pressure of compressed air supplied from a compressor and the like (not shown) is not always constant and that the compressed air in the main chamber is consumed in a nail striking operation and the like, the time until the pressure in the space reaches a predetermined pressure to operate the main valve is not constant. Therefore, in the nailing machine to which the timekeeping mechanism using air pressure is applied, it is difficult to stably perform the timekeeping, and the time from when the trigger is pulled until the main valve is deactivated is not constant.

Therefore, a timekeeping mechanism has been proposed in which air is compressed in a nailing machine and the pressure of the compressed air is used. With such a timekeeping mechanism, the influence of pressure fluctuation in the main chamber can be eliminated. However, a timekeeping mechanism using the air pressure requires a sealing member between a piston and a housing supporting the piston, and sliding resistance between the sealing member and a sliding surface affects the timekeeping.

The present disclosure has been made to solve the above problems, and an object thereof is to provide a pneumatic tool in which timekeeping can be stably performed regardless of fluctuation factors such as air pressure and sliding resistance.

According to an aspect of the present invention, there is provided a pneumatic tool including: a drive part configured to be driven by compressed air; a control valve configured to switch the presence or absence of operation of the drive part; and a timer part configured to switch the presence or absence of operation of the control valve after a lapse of a predetermined time, wherein the timer part includes a timer piston configured to move in one direction and perform timekeeping, a timer piston cylinder configured to support the timer piston such that the timer piston can slide, and an on-off valve part configured to switch the presence or absence of operation of the control valve in conjunction with the timer piston, and wherein the on-off valve part includes a shaft portion configured to move in conjunction with the timer piston, and compressed air flowing into the on-off valve part presses the shaft portion in the one direction.

In the present disclosure, the change in sliding resistance that occurs in the shaft portion and the timer piston is cancelled by applying compressed air that drives the drive part to the shaft portion of the on-off valve part.

In the present disclosure, the timing of switching the presence or absence of operation of a member to be controlled can be made constant regardless of fluctuation factors such as air pressure and sliding resistance.

DESCRIPTION OF EMBODIMENTS

Hereinafter, a nailing machine as a striking tool, which is an example of a pneumatic tool of the present disclosure, will be described with reference to the drawings.

<Configuration Example of a Nailing Machine of a First Embodiment>

Figure 1A:
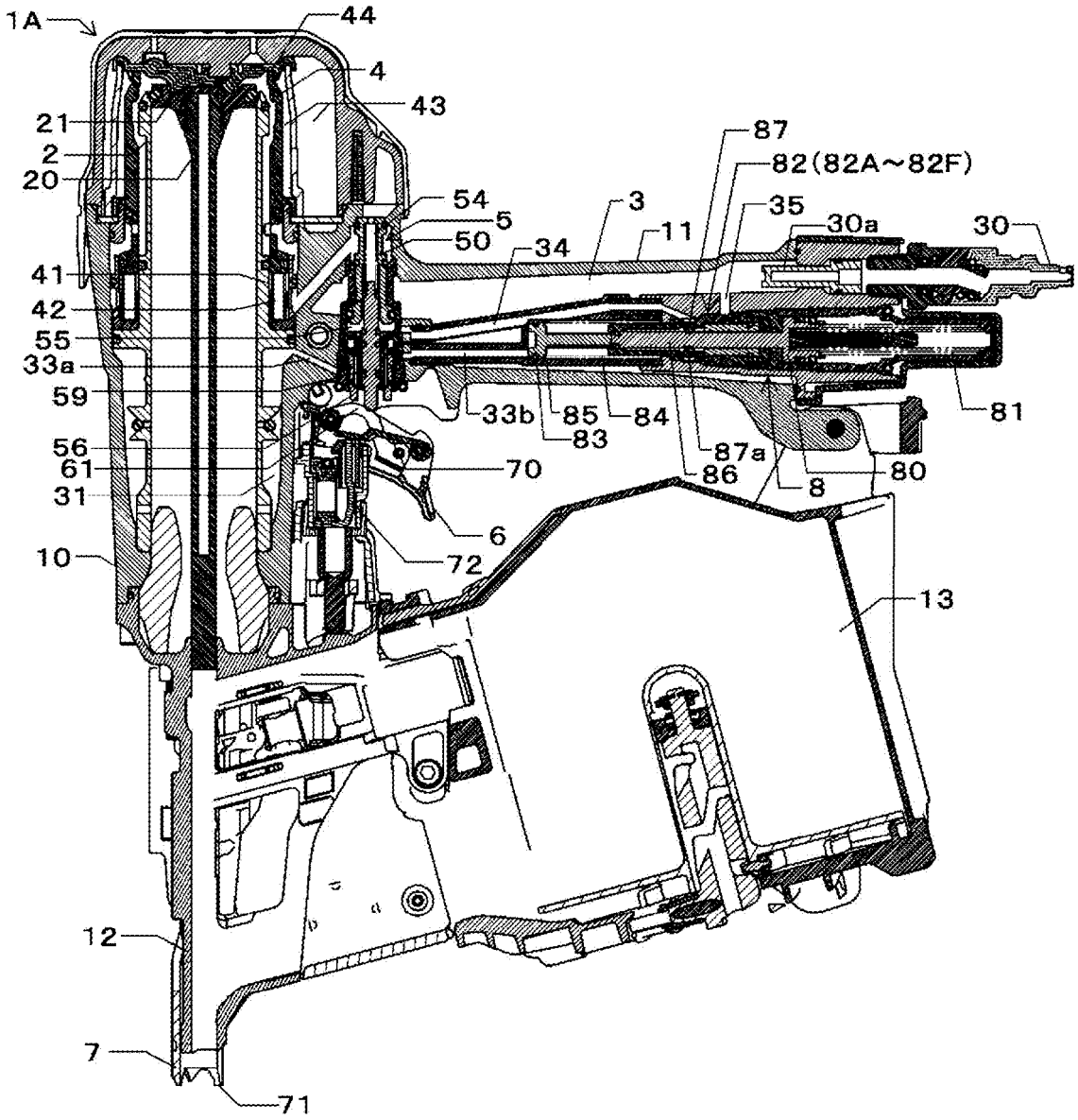
FIG. 1A is an overall sectional view showing an example of a nailing machine according to a first embodiment.
Figure 1B:
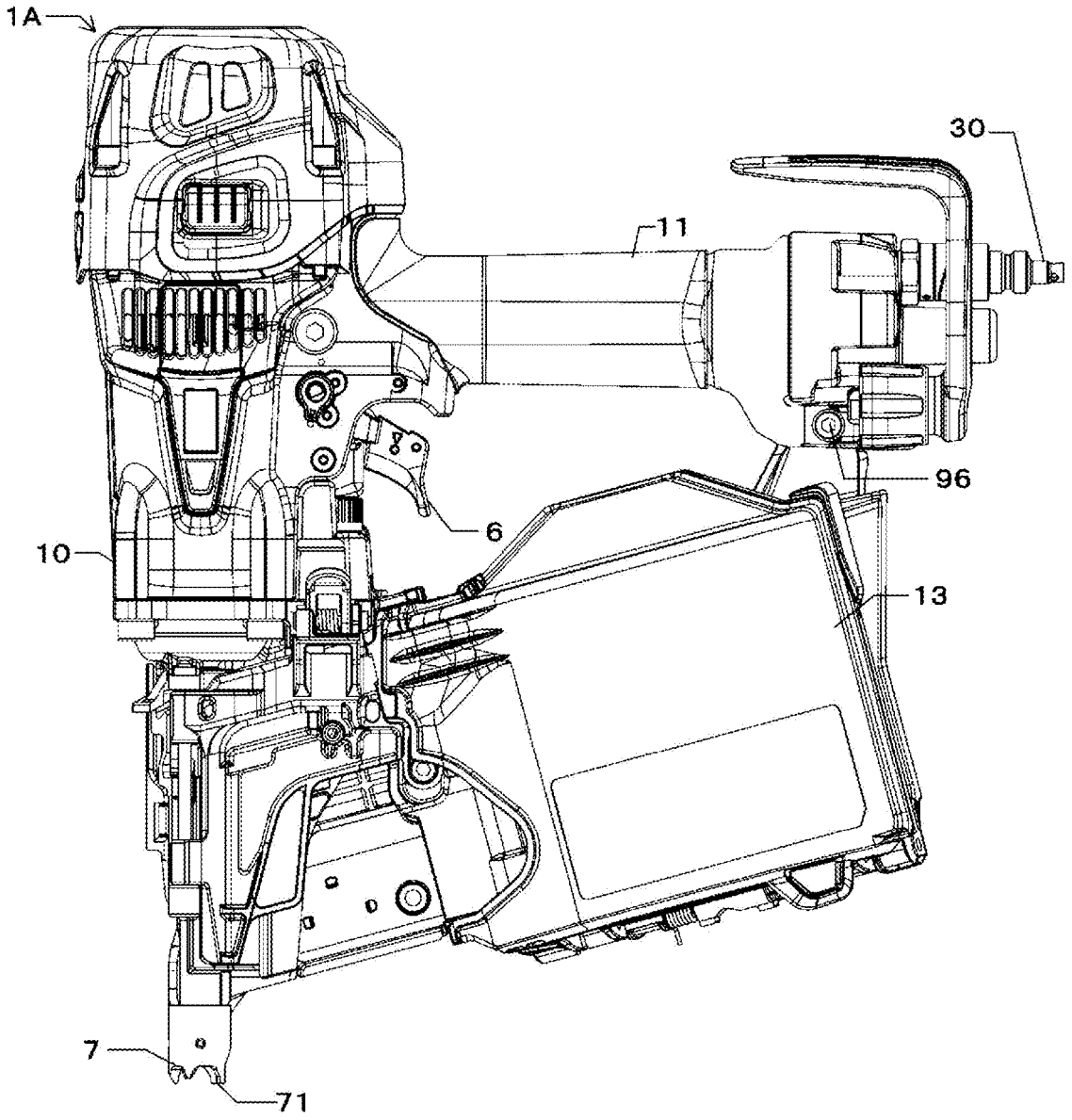
FIG. 1B is a side view showing an example of the nailing machine according to the first embodiment.
Figure 1C:
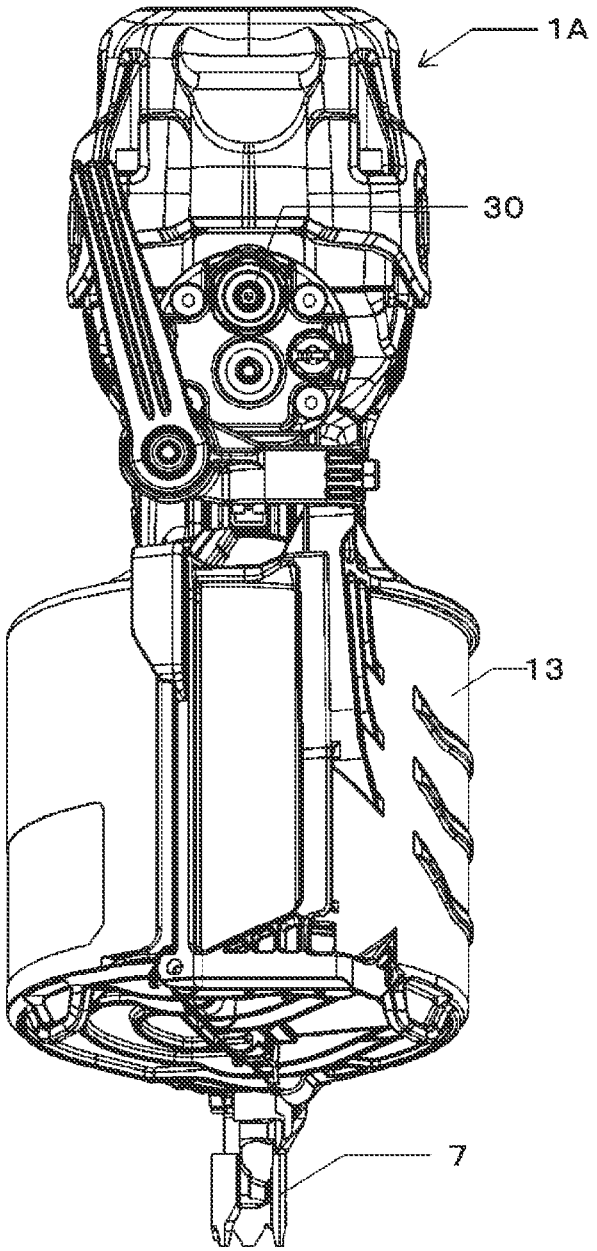
FIG. 1C is a bottom view showing an example of the nailing machine according to the first embodiment.
Figure 2A:
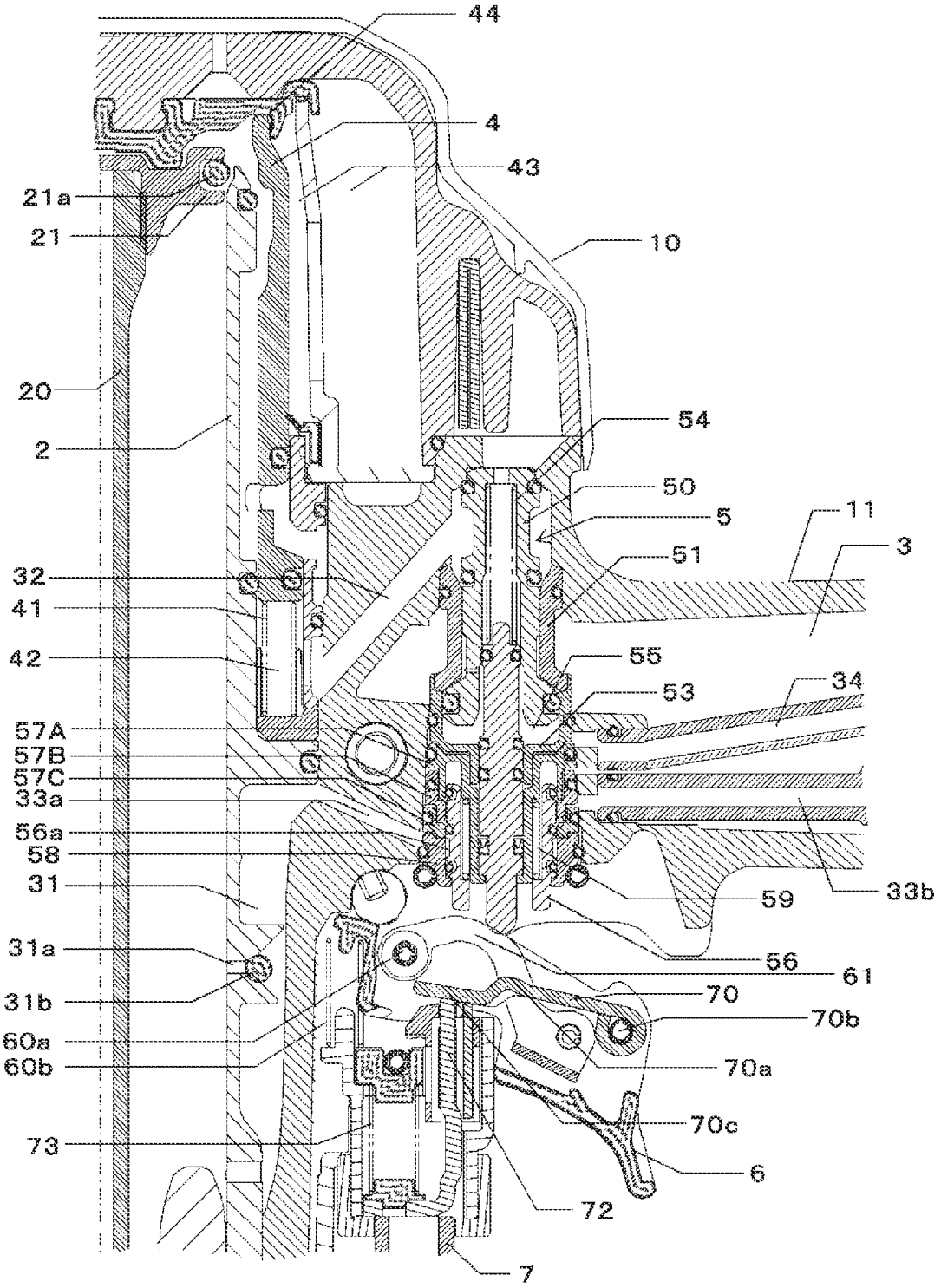
FIG. 2A is a sectional view of a main part showing an example of the nailing machine according to the first embodiment.
Figure 2B:
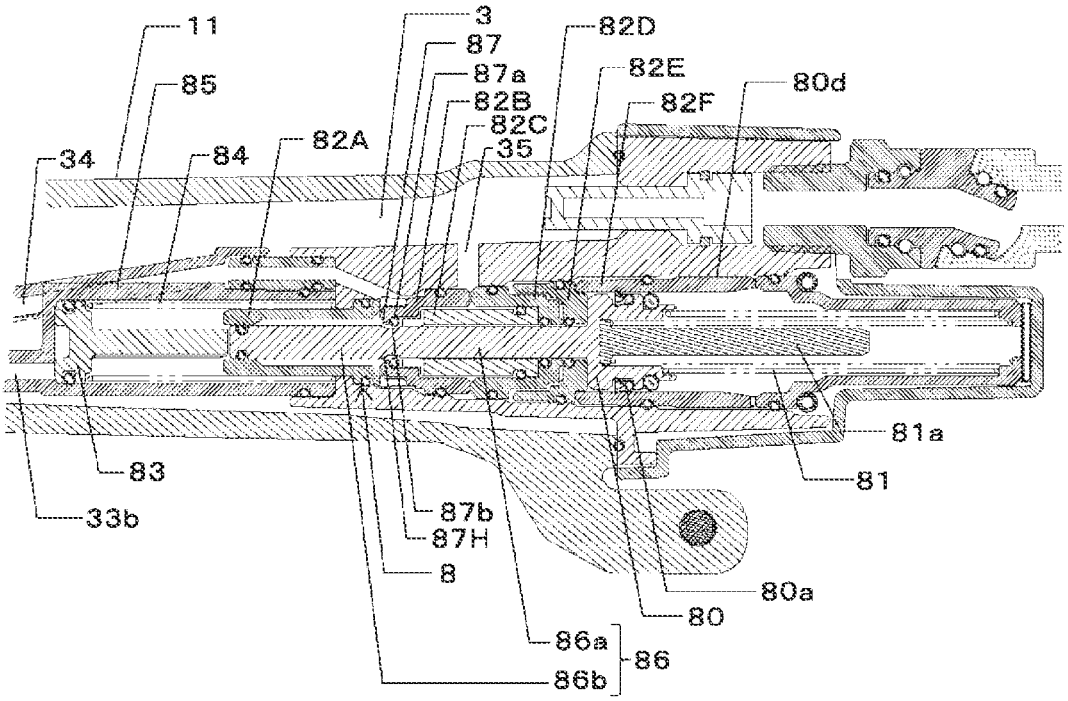
FIG. 2B is a sectional view of a main part showing an example of the nailing machine according to the first embodiment.
Figure 2C:
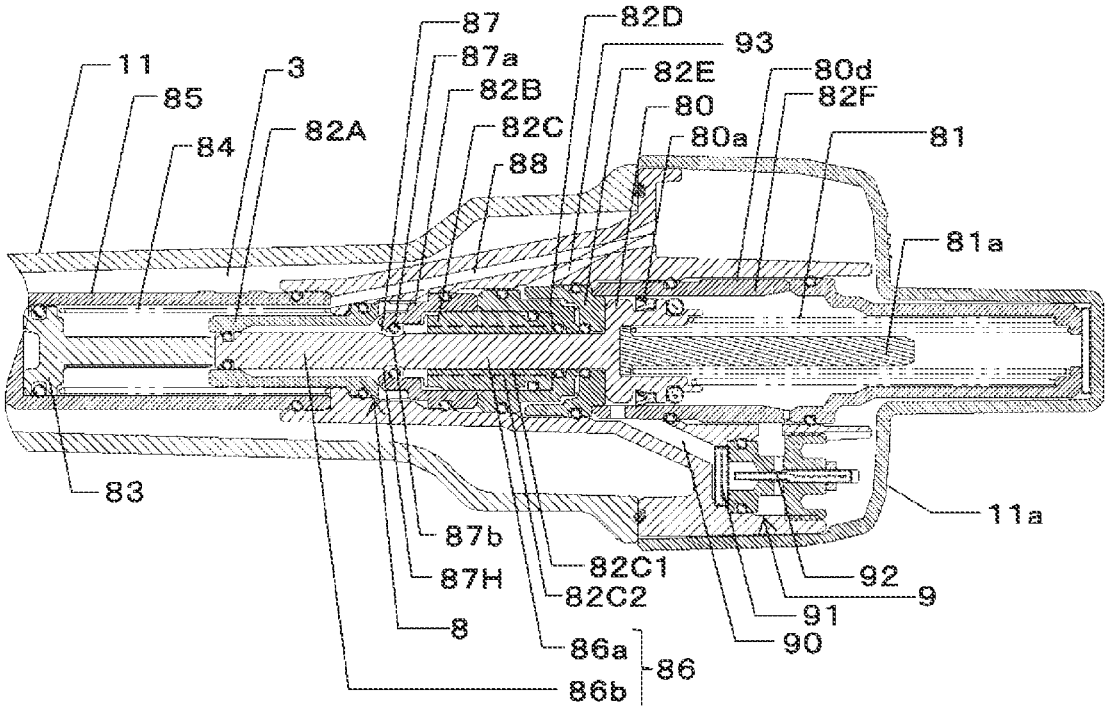
FIG. 2C is a sectional view of a main part showing an example of the nailing machine according to the first embodiment.

FIG. 1A is an overall sectional view showing an example of a nailing machine according to a first embodiment, FIG. 1B is a side view showing an example of the nailing machine according to the first embodiment, and FIG. 1C is a bottom view showing an example of the nailing machine according to the first embodiment. Further, FIGS. 2A, 2B and 2C are sectional views of a main part showing an example of the nailing machine according to the first embodiment.

A nailing machine 1A of the first embodiment incudes a housing 10 having a shape extending in one direction and a handle 11 having a shape extending in the other direction from the housing 10. Further, the nailing machine 1A includes a nose 12 at one end of the housing 10 and a magazine 13 that supplies a nail (not shown) to the nose 12. Considering the usage pattern of the nailing machine 1A, the side where the nose 12 is provided is defined as the lower side.

The nailing machine 1A includes a striking cylinder 2 that operates with compressed air to perform a striking operation and a main chamber 3 to which compressed air is supplied from an external air compressor (not shown).

The striking cylinder 2 is an example of a drive part and is provided inside the housing 10 so as to extend in an upper and lower direction. The striking cylinder 2 includes a striking driver 20 for striking out a nail or the like (not shown), and a striking piston 21 for driving the striking driver 20. The striking driver 20 is attached to the striking piston 21 so as to protrude from a lower surface side of the striking piston 21. The striking piston 21 is provided with an O-ring 21*a* as a sealing member on the outer periphery thereof and is slidably attached to the inside of the striking cylinder 2.

In the striking cylinder 2, the striking piston 21 is pressed by the compressed air supplied from the main chamber 3, and the striking piston 21 and the striking driver 20 are integrally moved, so that the striking driver 20 is driven by the striking piston 21. The striking driver 20 driven by the striking piston 21 is guided by the nose 12 to strike out a nail (not shown) supplied from the magazine 13 to the nose 12.

The main chamber 3 is provide inside the handle 11. Compressed air is supplied from an air compressor into the main chamber 3 by connecting a hose (not shown) to a chuck 30 provided at an end of the handle 11. Further, an end cap filter 30*a* for suppressing foreign matters from entering the main chamber 3 is provided between the chuck 30 and the main chamber 3.

The nailing machine 1A includes a blowback chamber 31 to which compressed air for returning the striking piston 21 after the striking operation is supplied. The blowback chamber 31 is provided around a lower portion of the striking cylinder 2 in the housing 10. The blowback chamber 31 is connected to the striking cylinder 2 via an inflow/discharge port 31*a* provided at a substantially intermediate portion in the upper and lower direction of the striking cylinder 2, and compressed air is supplied to the blowback chamber 31 via the main chamber 3 and the striking cylinder 2. The inflow/discharge port 31*a* includes a check valve 31*b* that regulates the direction in which air flows in one direction. The check valve 31*b* allows air to flow from the striking cylinder 2 to the blowback chamber 31 and regulates the backflow of air from the blowback chamber 31 to the striking cylinder 2.

The nailing machine 1A includes a first air flow path 32 that forms a flow path communicating with the atmosphere.

The nailing machine 1A includes a main valve 4 that switches the inflow/outflow of compressed air in the main chamber 3 to reciprocate the striking piston 21, and a trigger valve 5 that operates the main valve 4.

The main valve 4 is an example of a valve mechanism. The main valve 4 reciprocates the striking piston 21 by switching between the inflow of compressed air from the main chamber 3 into the striking cylinder 2 and the outflow of compressed air from the striking cylinder 2 to the outside.

The main valve 4 is provided on an outer peripheral side of an upper end portion of the striking cylinder 2 so as to be vertically movable. Further, the main valve 4 is urged upward in a closing direction by the force of a main valve spring 41. Furthermore, the main valve 4 is pushed upward by the air pressure of compressed air when compressed air is supplied from the main chamber 3 to a main valve lower chamber 42 via the trigger valve 5. Further, the main valve 4 is pushed downward by the air pressure of compressed air when compressed air is supplied from the main chamber 3 to a main valve upper chamber 43.

In this way, when the main valve 4 is not operating, the main valve 4 is urged upward and located at a top dead center position due to the relationship between the balance of the air pressure of compressed air supplied into the main valve lower chamber 42 and the air pressure of compressed air supplied into the main valve upper chamber 43 and the force of the main valve spring 41, and a top opening portion 44 of the main chamber 3 and the striking cylinder 2 is blocked. Further, when the main valve 4 is operating, the main valve lower chamber 42 communicates with the atmosphere. Thus, the main valve 4 is pushed downward by the air pressure of compressed air supplied into the main valve upper chamber 43, and the top opening portion 44 of the main chamber 3 and the striking cylinder 2 is opened.

The trigger valve 5 is an example of a control valve. The trigger valve 5 includes a pilot valve 50 that opens and closes the main valve lower chamber 42, and a trigger valve housing 51 to which the pilot valve 50 is attached so as to be vertically movable. Further, the trigger valve 5 includes a trigger valve stem 52 that operates the pilot valve 50, a trigger valve cap 53 to which the trigger valve stem 52 is attached so as to be vertically movable, and a trigger valve stem spring 54 that urges the pilot valve 50 upward and urges the trigger valve stem 52 downward.

Compressed air is supplied to the trigger valve 5 from the main chamber 3, and the pilot valve 50 is pushed downward by the air pressure of the compressed air. Further, in the trigger valve 5, compressed air is supplied to a trigger valve lower chamber 55 formed between the pilot valve 50 and the trigger valve cap 53, and the pilot valve 50 is pushed upward by the air pressure of the compressed air.

In this way, the pilot valve 50 is held at an upper position due to the relationship between the balance of the air pressure of the compressed air and the force of the trigger valve stem spring 54. Further, in the trigger valve 5, the trigger valve lower chamber 55 communicates with the atmosphere according to the position of the trigger valve stem 52, and the pilot valve 50 is moved downward by the air pressure of the compressed air. When the pilot valve 50 is moved downward, a passage through which the first air flow path 32 communicates with the atmosphere is opened, and the main valve lower chamber 42 communicates with the atmosphere.

The trigger valve 5 includes a timer switch 56 that operates a timer (to be described later), timer switch housings 57A to 57C to which the timer switch 56 is attached so as to be vertically movable, a timer switch cap 58 to which the timer switch 56 is attached so as to be vertically movable and which supports the timer switch housings 57A to 57C, and a timer switch spring 59 that urges the timer switch 56 downward.

In the trigger valve 5, a gap between the timer switch cap 58 and the timer switch housing 57C forms a flow path through which air passes in communication with a first timer operating flow path 33*a* connected to the blowback chamber 31. Further, in the trigger valve 5, a gap between the timer switch housing 57C and the timer switch housing 57B forms a flow path through which air passes in communication with a second timer operating flow path 33*b* connected to the timer (to be described later). Furthermore, in the trigger valve 5, a gap between the trigger valve housing 57A and the trigger valve housing 57B forms a flow path through which air passes in communication with the main chamber 3. Further, a flow path forming recess 56*a* having a concave outer peripheral surface along a circumferential direction is formed in the timer switch 56.

The timer switch 56 switches the presence and absence of communication between the first timer operating flow path 33*a* and the second timer operating flow path 33*b* according to the position of the flow path forming recess 56*a* with respect to the timer switch housings 57A to 57C and the timer switch cap 58.

Further, in the trigger valve 5, a gap between the timer switch housing 57A and the trigger valve cap 53 forms a flow path that communicates an operation regulating flow path 34 connected to the main chamber 3 via the timer (to be described later) and the trigger valve lower chamber 55.

The nailing machine 1A includes a trigger 6 that receives one operation for operating the trigger valve 5, and a contact arm 7 that receives another operation for operating the trigger valve 5.

The trigger 6 is provided on one side of the handle 11. The trigger 6 is configured such that one end side near the housing 10 is rotatably supported by a shaft 60*a* and the other end side farther from the housing 10 is urged by a trigger spring 60*b* in the direction away from the handle 11.

The trigger 6 includes a contact lever 70 that is pushed by the contact arm 7. One end side of the contact lever 70 near the housing 10 extends to a position facing the trigger valve stem 52. The contact lever 70 includes an acting portion 70*a* for pushing the trigger valve stem 52 on the one end side thereof. Further, the other end side of the contact lever 70 is rotatably supported on the trigger 6 by a shaft 70*b*. Furthermore, the contact lever 70 is urged by a spring (not shown) in the direction in which the acting portion 70*a* is separated from the trigger valve stem 52.

The trigger 6 includes a timer switch lever 61 that pushes the timer switch 56. The timer switch lever 61 rotates in conjunction with the rotation of the trigger 6 with the shaft 60*a* as a fulcrum, and pushes the timer switch 56 by an operation in which the other end side of the trigger 6 is moved in the direction approaching the handle 11.

The contact arm 7 is provided so as to be movable along an extending direction of the nose 12. The contact arm 7 includes a butting portion 71 that is butted against a member to be driven on the tip end side of the nose 12. Further, the contact arm 7 includes a pressing portion 72 that pushes an acted portion 70*c* of the contact lever 70. The contact arm 7 is urged by a contact arm spring 73 in the direction protruding from the tip end side of the nose 12.

The nailing machine 1A includes a timer 8 that performs a timekeeping operation. The timer 8 is an example of a timer part. The timer 8 includes a timer piston 80 that generates compressed air for timekeeping as a load, a timer piston spring 81 that urges the timer piston 80, and a timer piston spring guide 81*a* that guides the expansion and contraction of the timer piston spring 81. The timer 8 performs a meter-out control in which the speed of the timer piston 80 is controlled by adjusting the amount of outflow air from a timer piston cylinder 80*d*.

Further, the timer 8 includes timer piston housings 82A to 82F that movably support the timer piston 80 and form a flow path through which air passes. Furthermore, the timer 8 includes a preset piston 83 that operates the timer piston 80, a preset piston spring 84 that urges the preset piston 83, and a preset piston housing 85 that movable supports the preset piston 83.

The timer 8 is configured such that the timer piston 80 and the preset piston 83 can move along the extending direction of the handle 11. The timer 8 is configured such that the timer piston housings 82A to 82F are arranged along the extending direction of the handle 11, the timer piston housing 82F constituting the timer piston cylinder 80*d* movably supports the timer piston 80, and the timer piston housings 82A to 82E movably support a timer piston shaft 86 that is the shaft part of the timer piston 80.

A Y-ring 80*a* that has a Y-shaped cross section as a sealing member having a lip structure is fitted to the outer periphery of the timer piston 80. The Y-ring 80*a* slides on an inner peripheral surface of the timer piston cylinder 80*d*.

The timer 8 is configured such that the cylindrical timer piston housing 82C is inserted inside the timer piston housing 82B and the timer piston housing 82D, and the timer piston shaft 86 passes through the inside of the timer piston housing 82C.

Further, in the timer 8, a gap between the timer piston housing 82B and the timer piston housing 82D communicates with an inflow flow path 35 connected to the main chamber 3 to form a flow path through which air passes. Further, in the timer 8, a gap between the timer piston housing 82B and the timer piston housing 82D, a gap between the timer piston housing 82B and the timer piston housing 82C, and a gap between the timer piston housing 82B and the timer piston housing 82A communicate the inflow flow path 35 and the operation regulating flow path 34 with each other to form a flow path through which air passes.

In the timer piston 80, a flow path forming recess 87*b* having a concave shape along the circumferential direction is formed in the vicinity of substantially the center of the timer piston shaft 86 in an axial direction.

In the timer 8, a flow path communicating the inflow flow path 35 and the operation regulating flow path 34 with each other is closed by an O-ring 87*a* in a state where the O-ring 87*a* provided on the timer piston housing 82B is in contact with the timer piston shaft 86. On the contrary, in the timer 8, the flow path communicating the inflow flow path 35 and the operation regulating flow path 34 with each other is opened by a gap between the O-ring 87*a* and the flow path forming recess 87*b* when the timer piston 80 is moved to a position where the flow path forming recess 87*b* faces the O-ring 87*a*. In this way, the O-ring 87*a*, the timer piston shaft 86 and the flow path forming recess 87*b* constitute an on-off valve part 87 that opens and closes the flow path communicating the inflow flow path 35 and the operation regulating flow path 34 with each other.

The timer piston shaft 86 constituting a shaft part of the on-off valve part 87 is formed such that the diameter of a shaft portion 86*b* on the side opposite to the timer piston 80 is larger than the diameter of a shaft portion 86*a* on the side of the timer piston 80 with the flow path forming recess 87*b* interposed therebetween. In the timer piston shaft 86, a pressure receiving surface 87H that receives the force of the compressed air supplied from the main chamber 3 is formed by the diameter difference of the timer piston shaft 86, which is the difference between the diameter of the shaft portion 86*a* and the diameter of the shaft portion 86*b*. In this way, the timer piston shaft 86 constituting the on-off valve part 87 is pressed by the supply pressure.

The preset piston 83 is provided coaxially with the timer piston 80. The preset piston housing 85 is connected to the blowback chamber 31 via the second timer operating flow path 33*b*, the timer switch 56, the timer switch housings 57B, 57C, the timer switch cap 58, and the first timer operating flow path 33*a*.

The timer 8 includes a discharge flow path 88 that communicates the preset piston housing 85 with the atmosphere. The timer 8 is configured such that the air in the preset piston housing 85 is discharged to the outside from the discharge flow path 88 by the operation of moving the preset piston 83.

Further, the opening and closing of a flow path formed between the timer piston housing 82A and the timer piston shaft 86 and a flow path formed between the preset piston housing 85 and a preset piston shaft 83*a* are switched according to the position of the timer piston 80.

When the flow path formed between the timer piston housing 82A and the timer piston shaft 86 communicates with the flow path formed between the preset piston housing 85 and the preset piston shaft 83*a*, the operation regulating flow path 34, the flow path formed by the timer piston housing 82A and the flow path formed by the preset piston housing 85 communicate with the discharge flow path 88.

Furthermore, the opening and closing of the trigger valve lower chamber 55 and the operation regulating flow path 34 are switched according to the position of the trigger valve stem 52. When the trigger valve lower chamber 55 communicates with the operation regulating flow path 34, the trigger valve lower chamber 55 communicates with the atmosphere via the operation regulating flow path 34, the flow path formed by the timer piston housing 82A, the flow path formed by the preset piston housing 85, and the discharge flow path 88.

The nailing machine 1A includes a choke 9. The choke 9 is an example of a throttle part. The choke 9 includes a discharge flow path 90 communicating with the timer piston housing 82F, a filter 91 provided in the discharge flow path 90, and a needle 92 for throttling the discharge flow path 90.

Further, the nailing machine 1A includes a foreign matter discharge flow path 93 that suppresses foreign matters from entering the choke 9 mainly from the flow path formed between the timer piston housings 82A to 82C and the timer piston shaft 86. The foreign matter discharge flow path 93 communicates the flow path formed between the timer piston housing 82D and the timer piston shaft 86 with the atmosphere.

<Operation Example of the Nailing Machine of the First Embodiment>

Next, the operation of the nailing machine 1A of the first embodiment will be described with reference to each drawing.

Figure 3A:
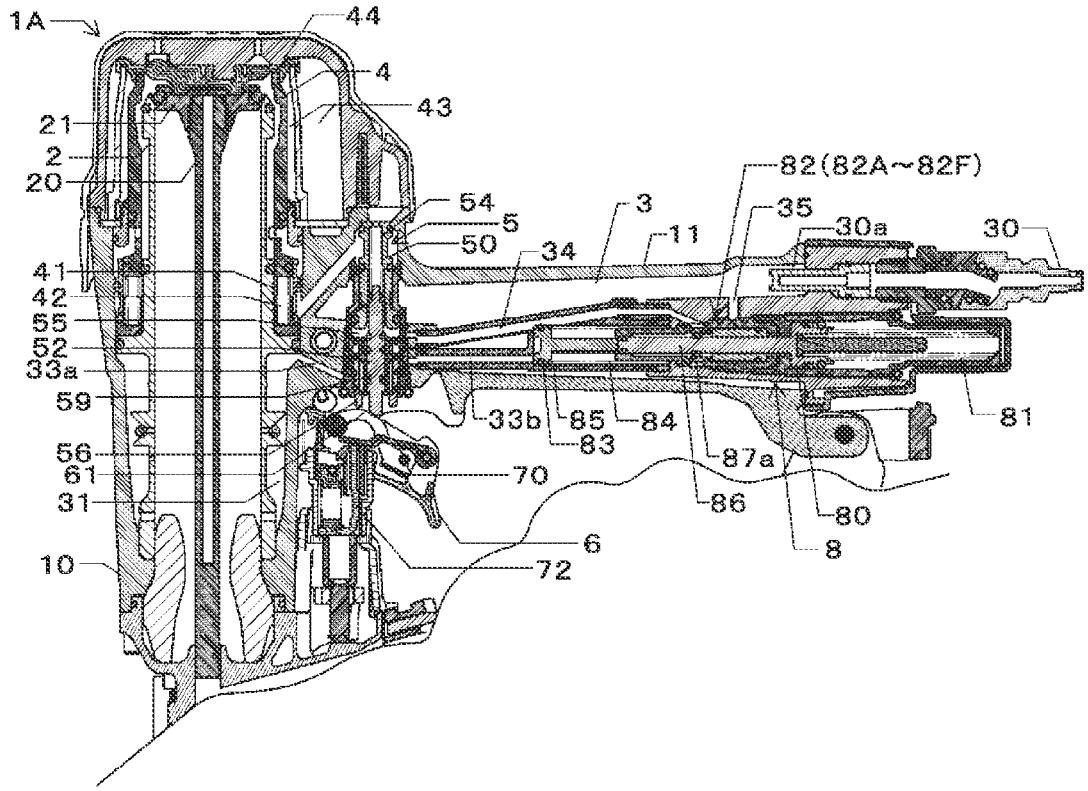
FIG. 3A is an overall sectional view showing a state before compressed air is supplied.
Figure 3B:
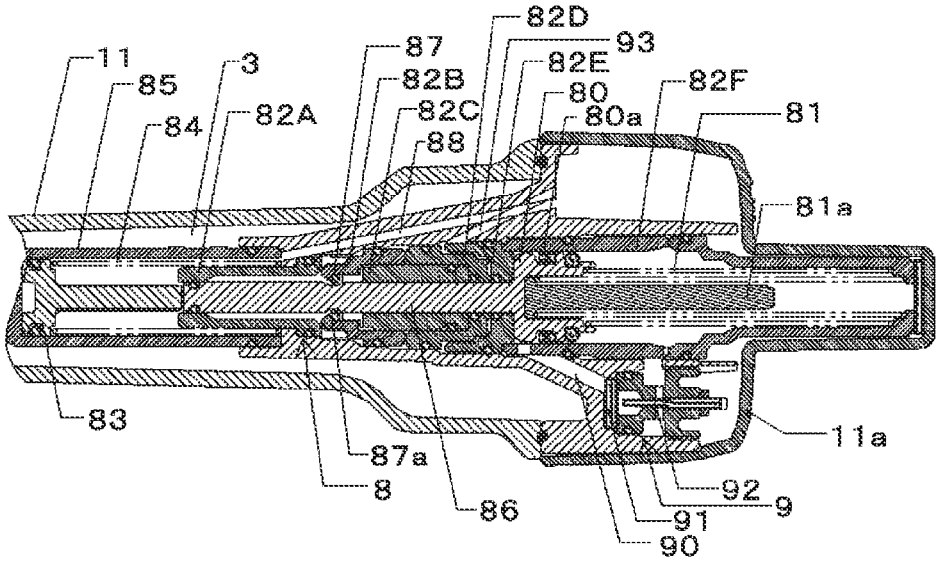
FIG. 3B is a sectional view of a main part showing the state before compressed air is supplied.

FIG. 3A is an overall sectional view showing a state before compressed air is supplied, and FIG. 3B is a sectional view of a main part showing the state before compressed air is supplied. Compressed air is not supplied to the nailing machine 1A in a state where a hose from an air compressor (not shown) is not connected to the chuck 30.

In this way, the main chamber 3, the main valve lower chamber 42, the main valve upper chamber 43, and the trigger valve lower chamber 55 have atmospheric pressure. Thus, the main valve 4 is urged by the main valve spring 41 and located in the top dead center position. Further, in the trigger valve 5, the pilot valve 50 is urged by the trigger valve stem spring 54 and held in the upper position. The position of the pilot valve 50 shown in FIG. 3A is referred to as a non-operating position. Furthermore, in the trigger valve 5, the trigger valve stem 52 is urged by the trigger valve stem spring 54 and held in the lower position. The position of the trigger valve stem 52 shown in FIG. 3A is referred to as a non-operating position. Further, in the trigger valve 5, the timer switch 56 is urged by the timer switch spring 59 and held in the lower position. The position of the timer switch 56 shown in FIG. 3A is referred to as a non-operating position.

When the timer switch 56 of the trigger valve 5 is in the non-operating position, the main chamber 3 communicates with the second timer operating flow path 33*b*. Since a hose from an air compressor (not shown) is not connected to the chuck 30, the main chamber 3 is in a state of communicating with the atmosphere. In this way, in the timer 8, the preset piston 83 is urged by the preset piston spring 84 and held in the left position. The position of the preset piston 83 shown in FIG. 3A is referred to as a non-operating position. Further, in the timer 8, the timer piston 80 is urged by the timer piston spring 81 and held in the left position. The position of the timer piston 80 shown in FIG. 3A is referred to as a non-operating position.

Figure 4A:
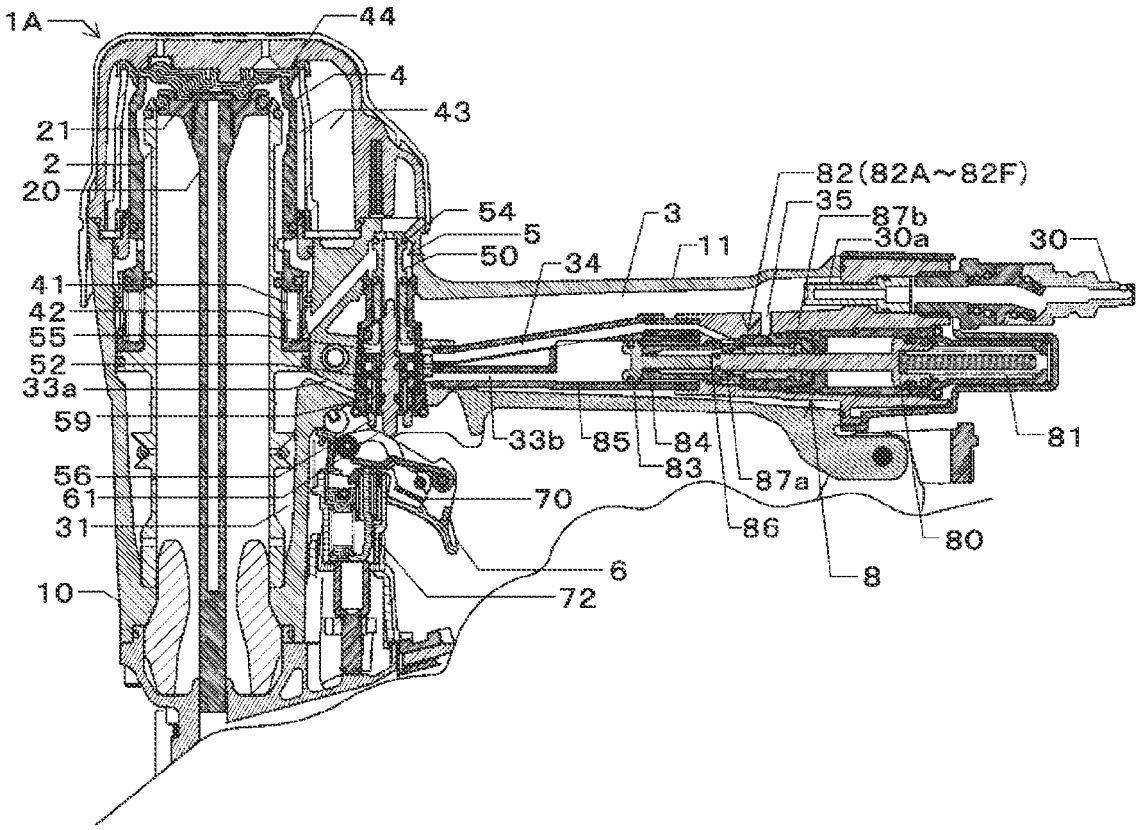
FIG. 4A is an overall sectional view showing a state after compressed air is supplied.
Figure 4B:
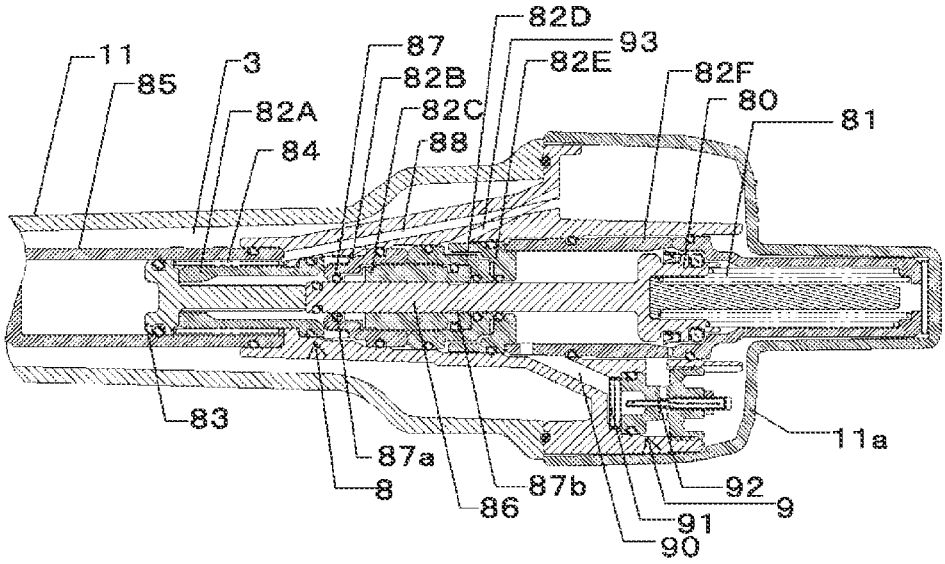
FIG. 4B is a sectional view of a main part showing the state after compressed air is supplied.

FIG. 4A is an overall sectional view showing a state after compressed air is supplied, and FIG. 4B is a sectional view of a main part showing the state after compressed air is supplied. In the nailing machine 1A, compressed air is supplied into the main chamber 3 when a hose from an air compressor (not shown) is connected to the chuck 30.

In this way, the main chamber 3, the main valve lower chamber 42, the main valve upper chamber 43, and the trigger valve lower chamber 55 have a pressure corresponding to the supply pressure of compressed air. Hereinafter, the pressure corresponding to the supply pressure of compressed air is referred to as the supply pressure. Therefore, the main valve 4 is held in the top dead center position. Further, in the trigger valve 5, the pilot valve 50 is held in the non-operating position. Furthermore, in the trigger valve 5, the trigger valve stem 52 is held in the non-operating position. Further, in the trigger valve 5, the timer switch 56 is held in the non-operating position in a state where the trigger 6 does not operate.

When the timer switch 56 of the trigger valve 5 is in the non-operating position, the main chamber 3 communicates with the second timer operating flow path 33*b*. When a hose from an air compressor (not shown) is connected to the chuck 30, the main chamber 3 has the supply pressure. In this way, in the timer 8, the preset piston 83 is pushed by the air pressure corresponding to the supply pressure and is moved to the right position. The position of the preset piston 83 shown in FIG. 4A is referred to as a timekeeping start position. Further, in the timer 8, the timer piston 80 is pushed by the preset piston 83 and is moved to the right position. The position of the timer piston 80 shown in FIG. 4A is referred to as a timekeeping start position. When the timer piston 80 of the timer 8 is moved to the timekeeping start position, the O-ring 87*a* provided on the timer piston housing 82B is in contact with the timer piston shaft 86, and the flow path communicating the inflow flow path 35 and the operation regulating flow path 34 with each other is closed. In this way, the supply pressure is not supplied to the operation regulating flow path 34.

Figure 5A:
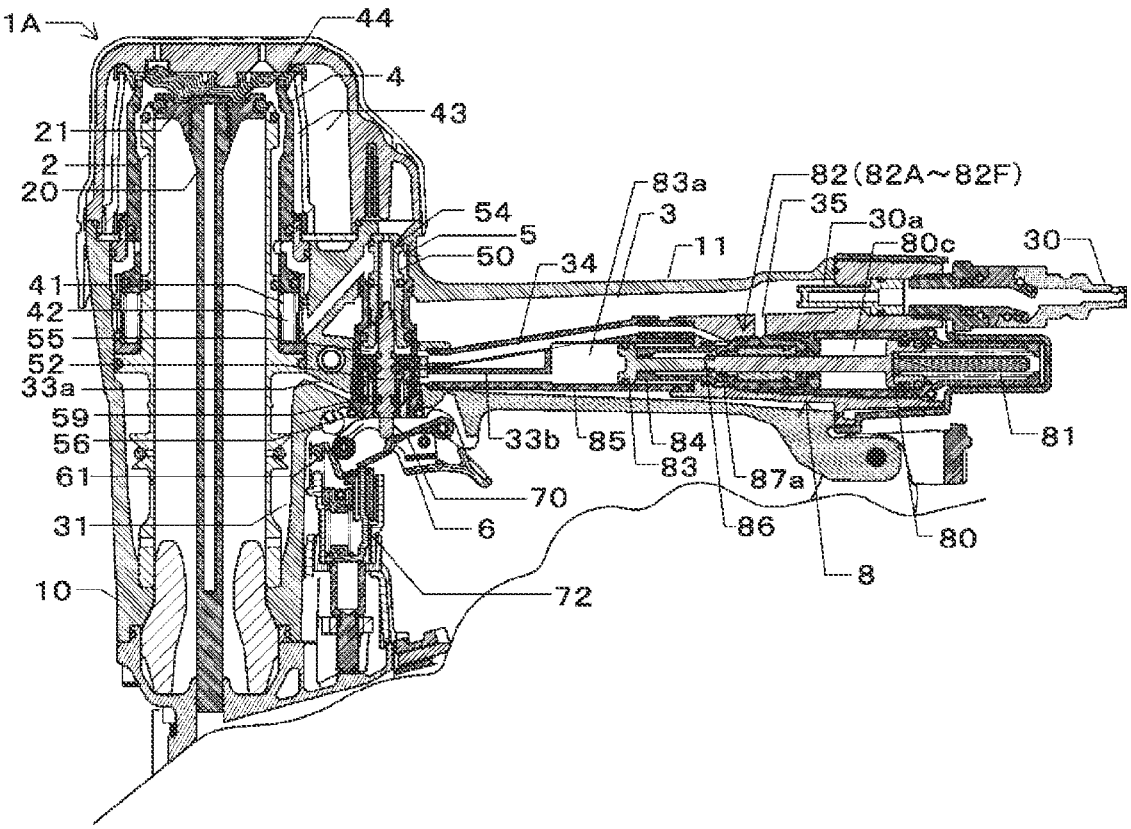
FIG. 5A is an overall sectional view showing a state at the moment when a trigger is operated.
Figure 5B:
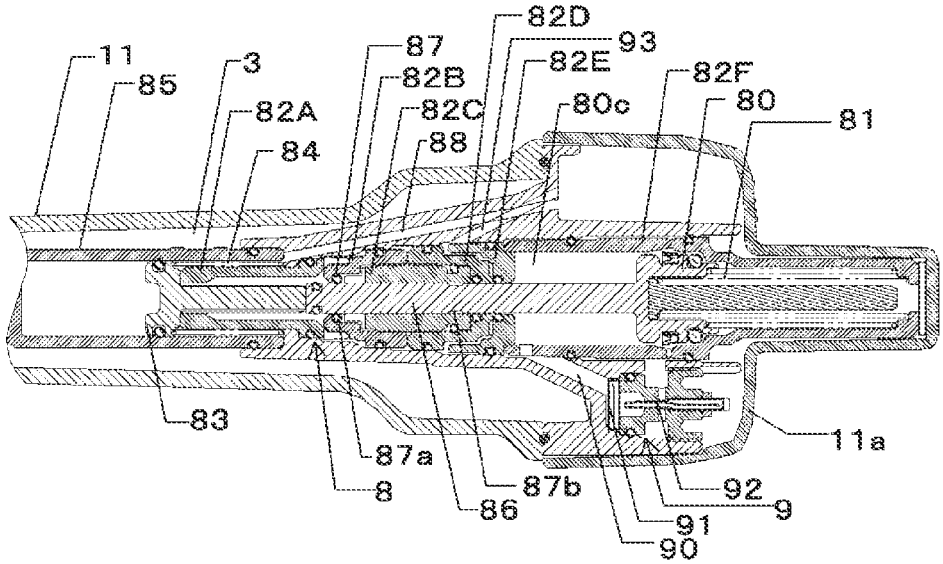
FIG. 5B is a sectional view of a main part showing the state at the moment when the trigger is operated.

FIG. 5A is an overall sectional view showing a state at the moment when the trigger is operated, and FIG. 5B is a sectional view of a main part showing the state at the moment when the trigger is operated. In the nailing machine 1A, the timer switch lever 61 pushes the timer switch 56 to the upper position when the trigger 6 is operated to move from an initial position (trigger OFF) to an operated position (trigger ON). The position of the timer switch 56 shown in FIG. 5A is referred to as an operating position.

When the timer switch 56 of the trigger valve 5 is in the operating position, the first timer operating flow path 33*a* and the second timer operating flow path 33*b* communicates with each other. The blowback chamber 31 communicates with the atmosphere. In this way, in the timer 8, the preset piston 83 is urged by the preset piston spring 84 and starts to advance from the timekeeping start position. Further, in the timer 8, the timer piston 80 is urged by the timer piston spring 81 and starts to advance from the timekeeping start position.

Even if the trigger 6 is operated, the contact lever 70 does not push the trigger valve stem 52 in a state where the butting portion 71 of the contact arm 7 is not butted against a member to be driven.

Figure 6A:
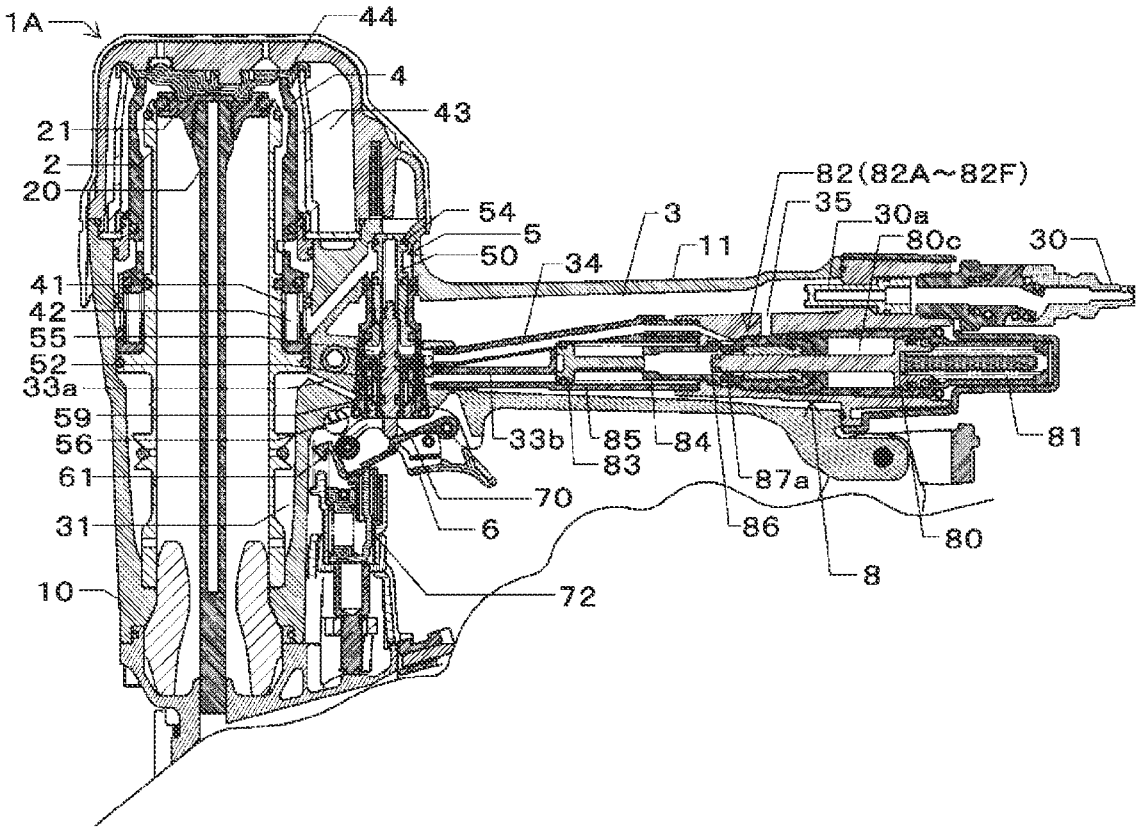
FIG. 6A is an overall sectional view showing a state after 0 seconds from the operation of the trigger.
Figure 6B:
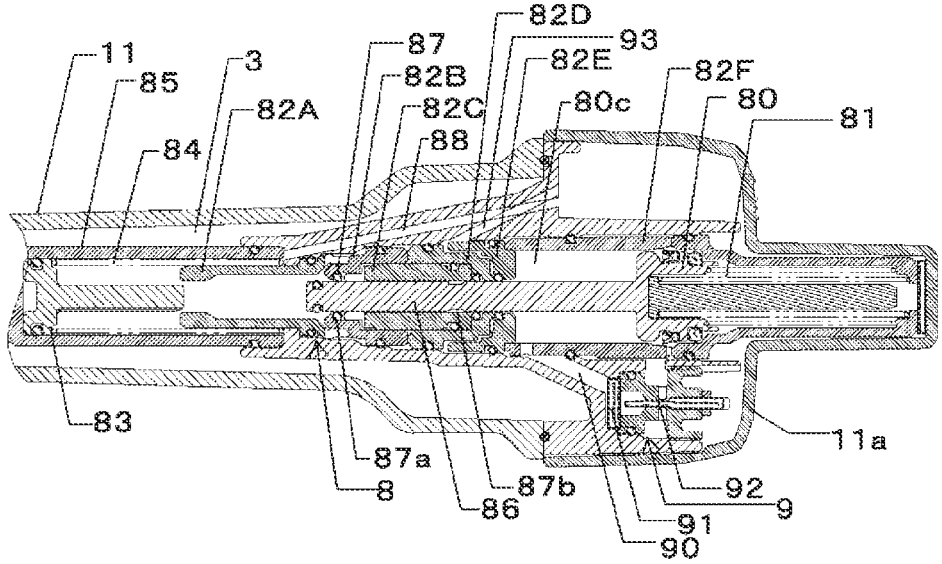
FIG. 6B is a sectional view of a main part showing the state after 0 seconds from the operation of the trigger.

FIG. 6A is an overall sectional view showing a state after 0 seconds from the operation of the trigger, and FIG. 6B is a sectional view of a main part showing the state after 0 seconds from the operation of the trigger.

A preset piston front chamber 83*a* formed by moving the preset piston 83 to the operating position communicates with the blowback chamber 31 via the first timer operating flow path 33*a* and the second timer operating flow path 33*b*. These flow paths do not become a large load when discharging the air in the preset piston front chamber 83*a*. In this way, the preset piston 83 is moved to the non-operating position in a very short time after the operation of the trigger 6.

On the contrary, a timer piston front chamber 80*c*, which is a chamber formed by moving the timer piston 80 to the operating position, communicates with the atmosphere via the choke 9. When the throttle of the choke 9 is narrowed to the point where only a very small amount of air flows, the timer piston front chamber 80*c* can be regarded as being substantially sealed at the moment when the timer piston 80 is moved. Thus, the volume of the timer piston front chamber 80*c* is reduced by the amount of movement of the timer piston 80, and the pressure is increased by that amount. The timer piston front chamber 80*c* is not configured to be supplied with compressed air from the main chamber 3. The internal pressure of the timer piston front chamber 80*c* is determined according to the position of the timer piston 80. In this way, the pressure in the timer piston front chamber 80*c* is not affected by the supply pressure. When the spring force of the timer piston spring 81 and the surface pressure of the air pressure due to internal compression are balanced, the timer piston 80 can advance by the amount of air released via the choke 9 from that time.

Figure 7A:
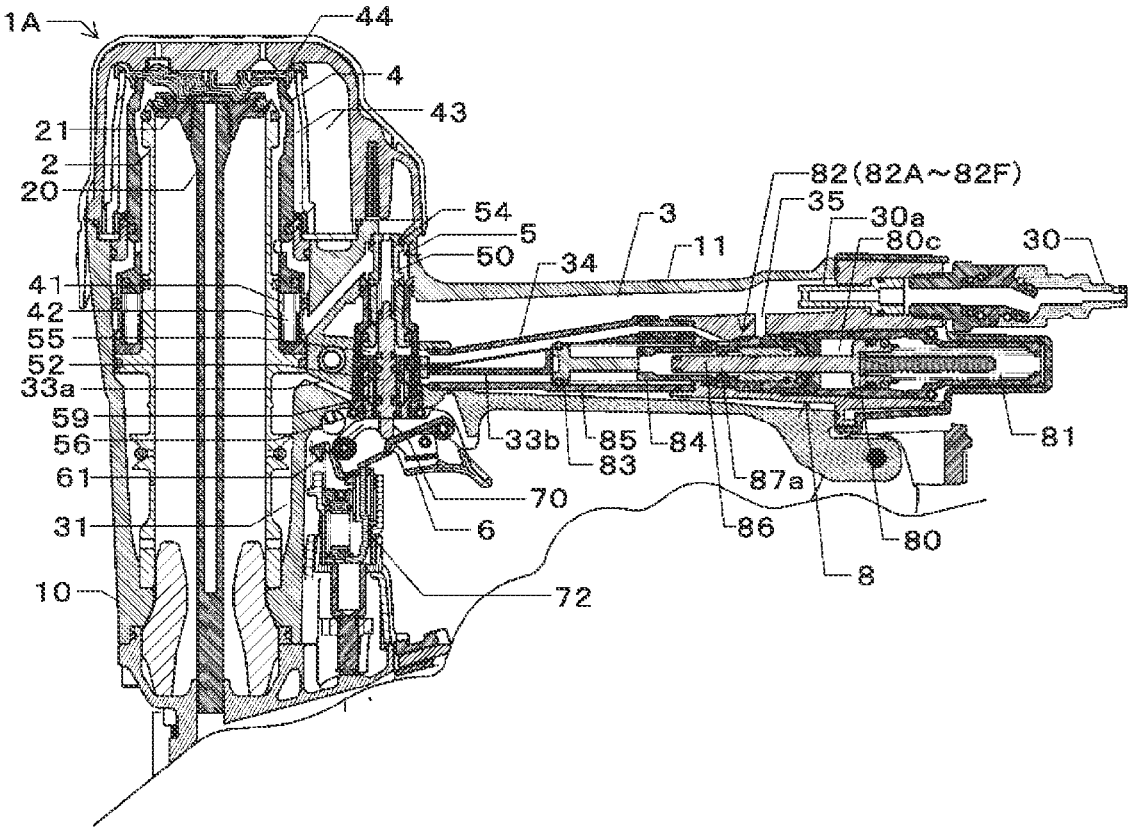
FIG. 7A is an overall sectional view showing a state from 0 seconds from the operation of the trigger to the end of timekeeping.
Figure 7B:
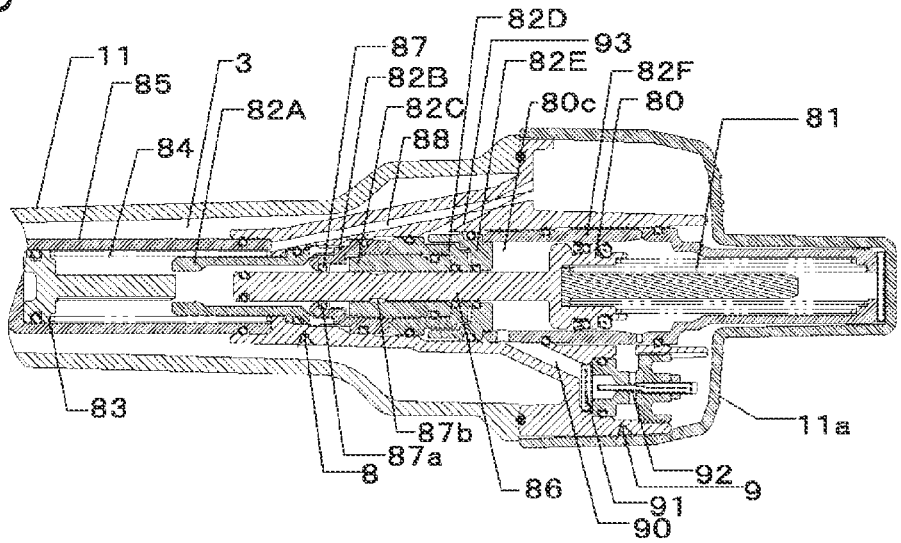
FIG. 7B is a sectional view of a main part showing the state from 0 seconds from the operation of the trigger to the end of timekeeping.

FIG. 7A is an overall sectional view showing a state from 0 seconds from the operation of the trigger to the end of timekeeping, and FIG. 7B is a sectional view of a main part showing the state from 0 seconds from the operation of the trigger to the end of timekeeping.

The timer piston 80 advances in a shorter time up to a predetermined position where the pressure in the timer piston front chamber 80*c* rises to a certain degree, as compared with the time from 0 seconds from the operation of the trigger to the end of timekeeping. Further, from the predetermined position where the pressure in the timer piston front chamber 80*c* rises to a certain degree to the non-operating position, the timer piston 80 is moved at a lower speed with respect to the moving speed up to the predetermined position where the pressure in the timer piston front chamber 80*c* rises to a certain degree.

Figure 8A:
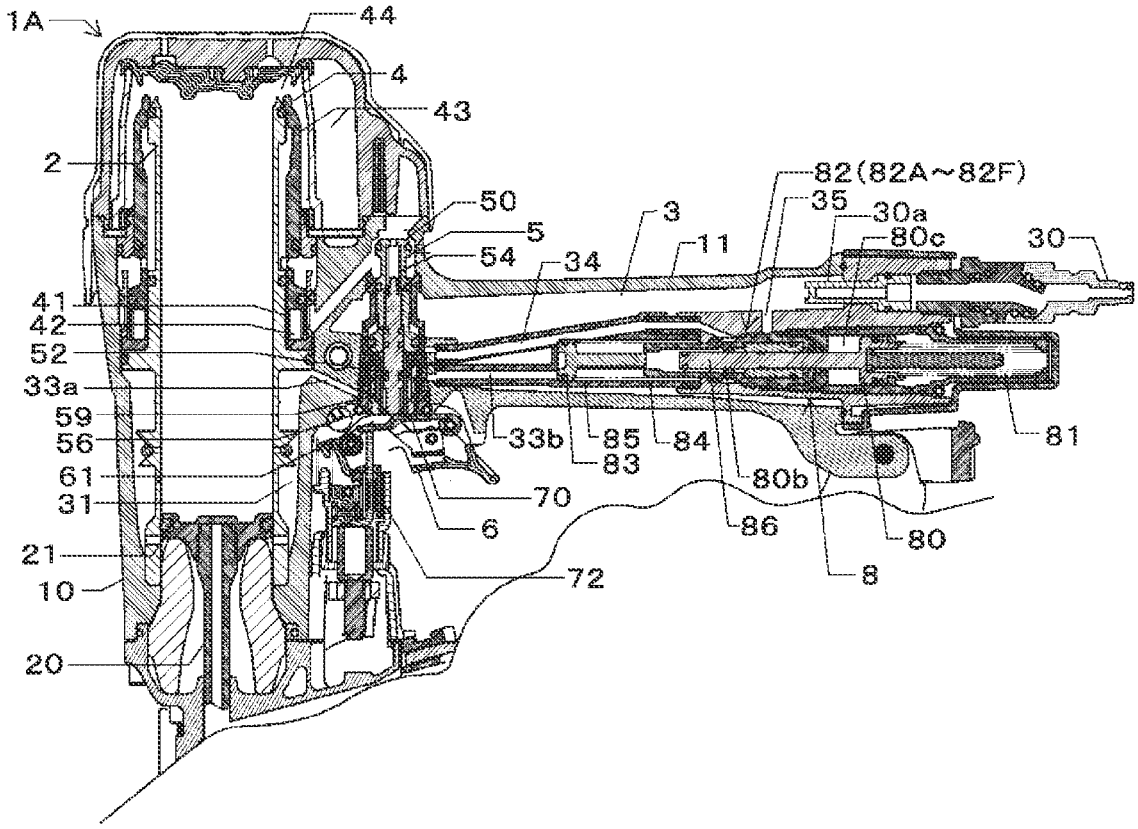
FIG. 8A is an overall sectional view showing a state in which a contact arm is operated from 0 seconds from the operation of the trigger to the end of timekeeping.
Figure 8B:
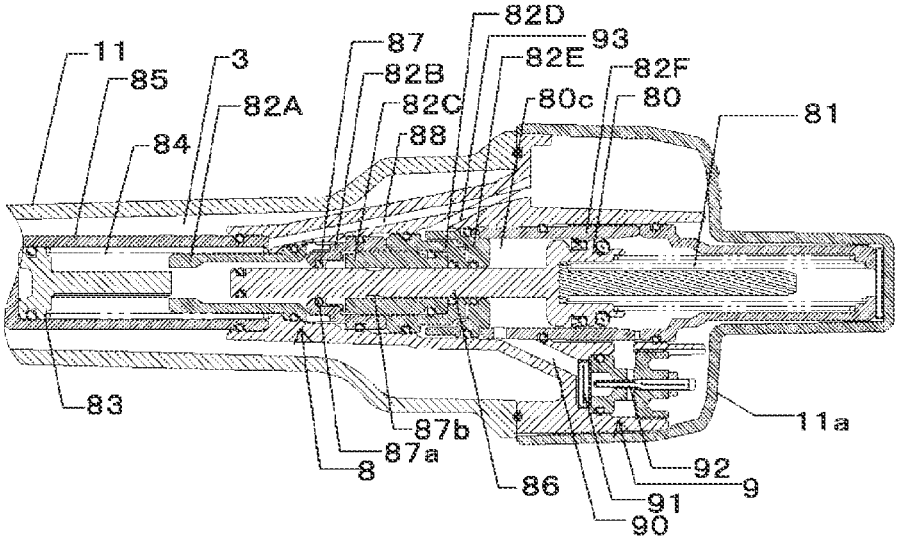
FIG. 8B is a sectional view of a main part showing the state in which the contact arm is operated from 0 seconds from the operation of the trigger to the end of timekeeping.

FIG. 8A is an overall sectional view showing a state in which the contact arm is operated from 0 seconds from the operation of the trigger to the end of timekeeping, and FIG. 8B is a sectional view of a main part showing the state in which the contact arm is operated from 0 seconds from the operation of the trigger to the end of timekeeping.

From 0 seconds from the operation of the trigger to the end of timekeeping, that is, during the period in which the timer piston 80 starts to advance from the timekeeping start position and is moved to the non-operating position, the pressing portion 72 of the contact arm 7 pushes the contact lever 70 when the contact arm 7 shown in FIG. 1 is pressed against the member to be driven (contact ON).

When the trigger 6 is moved to the operated position, the acting portion 70*a* of the contact lever 70 pushes the trigger valve stem 52. In the trigger valve 5, the flow path communicating the trigger valve lower chamber 55 with the main chamber 3 is closed and the flow path communicating the trigger valve lower chamber 55 with the operation regulating flow path 34 is opened when the trigger valve stem 52 is moved upward by a predetermined amount.

Further, while the timer piston 80 is moved from the timekeeping start position to the non-operating position, the flow path formed between the timer piston housing 82A and the timer piston shaft 86 and the flow path formed between the preset piston housing 85 and the preset piston shaft 83*a* communicate with each other.

In this way, the trigger valve lower chamber 55 communicates with the atmosphere via the operation regulating flow path 34, the flow path formed by the timer piston housing 82A, the flow path formed by the preset piston housing 85 and the discharge flow path 88, and compressed air is discharged therefrom, so that the air pressure in the trigger valve lower chamber 55 decreases.

Therefore, a force that pushes the pilot valve 50 downward with the air pressure of compressed air supplied from the main chamber 3 becomes larger than the force of the trigger valve stem spring 54. Then, the pilot valve 50 is moved downward, and the first air flow path 32 is opened.

When the first air flow path 32 is opened, the main valve lower chamber 42 is shut off from the main chamber 3 and communicates with the atmosphere. Then, compressed air is discharged from the main valve lower chamber 42, and the air pressure in the main valve lower chamber 42 decreases. In this way, a force that pushes the main valve 4 downward with the air pressure of compressed air supplied from the main chamber 3 into the main valve upper chamber 43 becomes larger than the force of the main valve spring 41. Then, the main valve 4 is moved downward, and the top opening portion 44 is opened. Therefore, the compressed air in the main chamber 3 is supplied to the striking cylinder 2.

In this way, the striking cylinder 2 is operated by the compressed air, the striking piston 21 is moved in the direction of striking out a nail (not shown), and the striking driver 20 performs a striking operation. Further, a part of the compressed air in the striking cylinder 2 is supplied from the inflow/discharge port 31*a* to the blowback chamber 31.

Figure 9A:
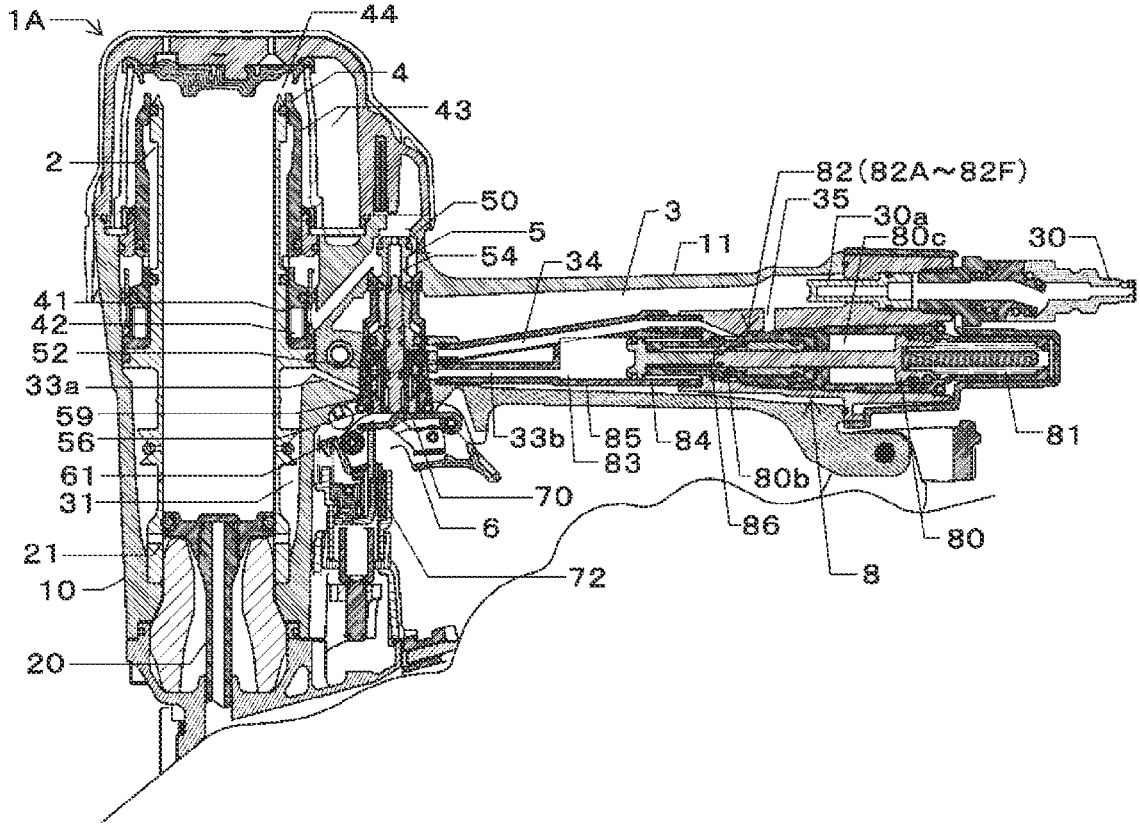
FIG. 9A is an overall sectional view showing a state in which a timer is reset.
Figure 9B:
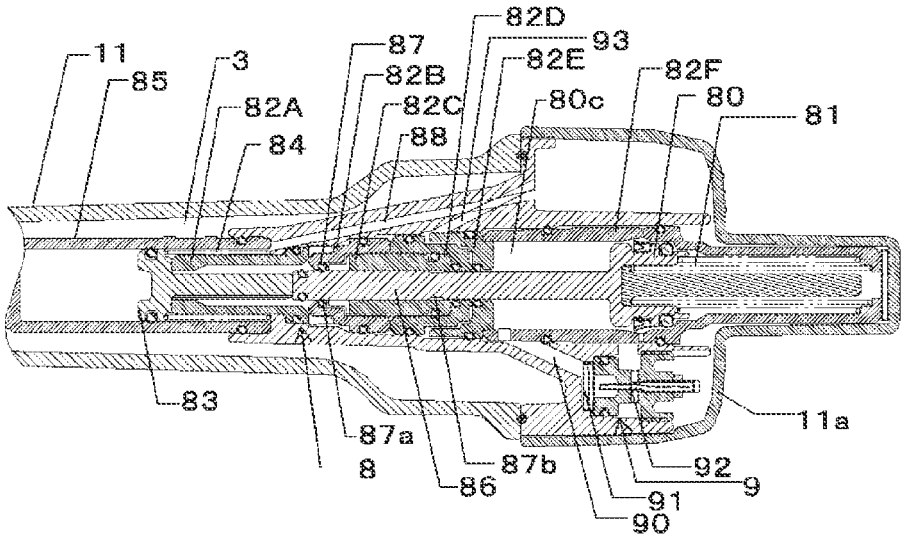
FIG. 9B is a sectional view of a main part showing the state in which the timer is reset.

FIG. 9A is an overall sectional view showing a state in which the timer is reset, and FIG. 9B is a sectional view of a main part showing the state in which the timer is reset.

When the trigger 6 is moved to the operated position during the striking operation, the timer switch 56 is moved to the operating position, and the first timer operating flow path 33*a* and the second timer operating flow path 33*b* communicate with each other. Further, during the striking operation, a part of the compressed air in the striking cylinder 2 is supplied from the inflow/discharge port 31*a* to the blowback chamber 31. In this way, in the timer 8, the preset piston 83 is pushed by the air pressure corresponding to the supply pressure of the compressed air and is moved to the timekeeping start position. Further, in the timer 8, the timer piston 80 is pushed by the preset piston 83 and is moved to the timekeeping start position. The operation in which the timer piston 80 is moved to the timekeeping start position by the striking operation is referred to as the reset of the timer 8.

After the striking operation, compressed air is supplied from the blowback chamber 31 to the striking cylinder 2, the striking piston 21 is moved in the direction of returning the striking driver 20, and the striking piston 21 returns to the top dead center position. When the striking piston 21 returns to the top dead center position, the blowback chamber 31 is in a state of communicating with the atmosphere.

In this way, in the timer 8 after being reset, the preset piston 83 is urged by the preset piston spring 84 and starts to advance from the timekeeping start position. Further, in the timer 8, the timer piston 80 is urged by the timer piston spring 81 and starts to advance from the timekeeping start position. Therefore, the timekeeping is initiated as described with reference to FIGS. 6A, 6B, 7A and 7B.

Figure 10A:
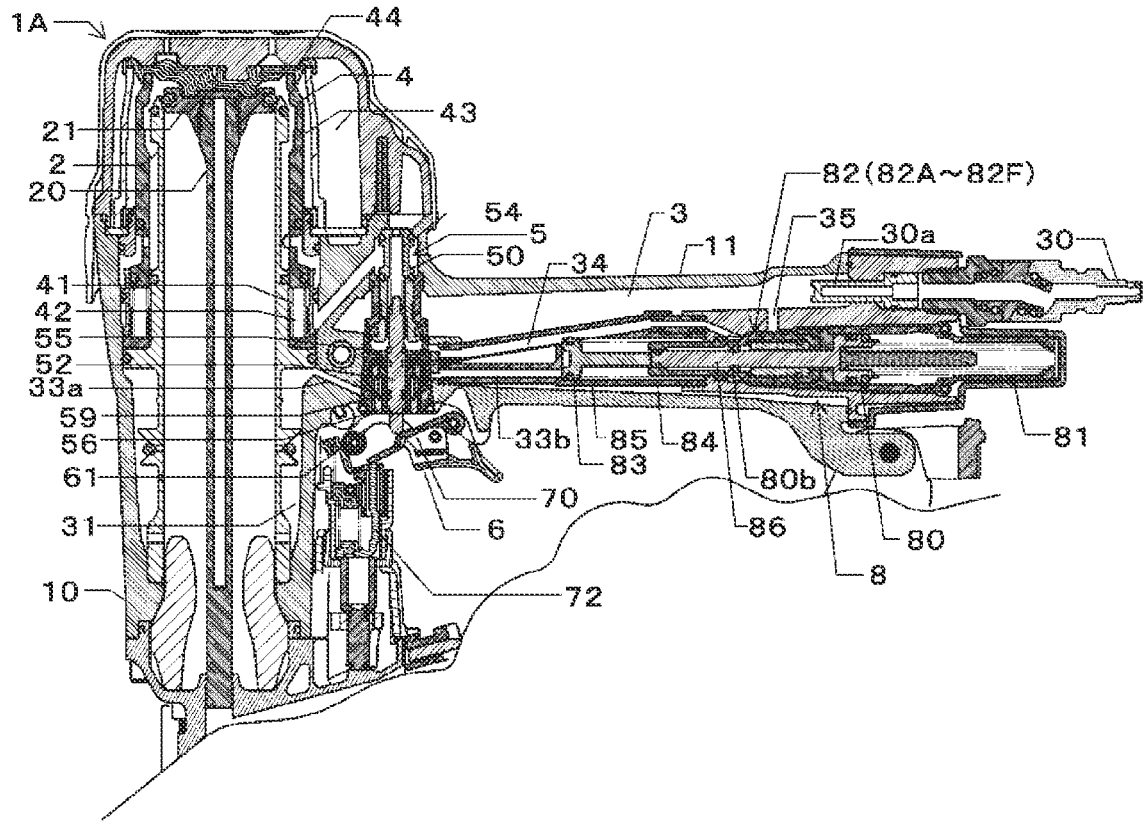
FIG. 10A is an overall sectional view showing a state at the time of time-out.
Figure 10B:
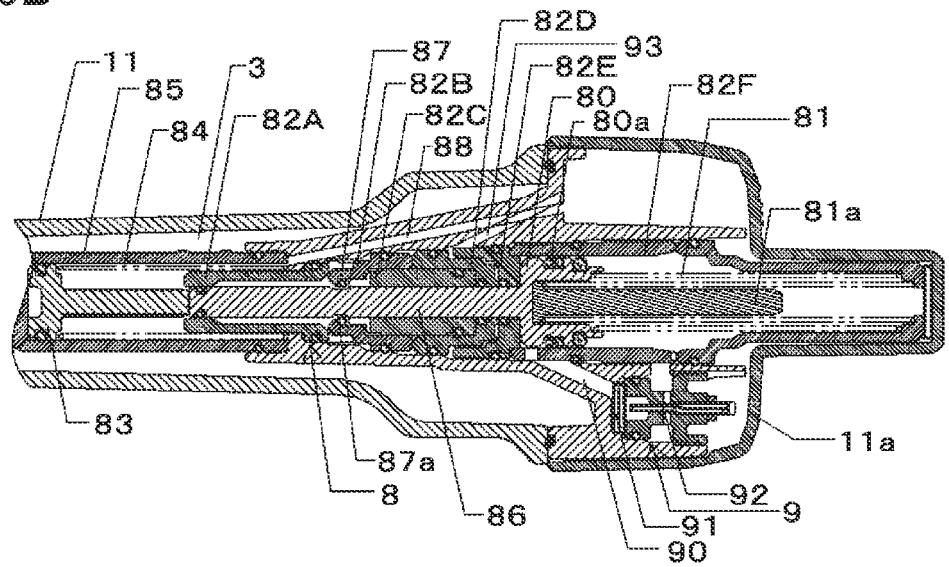
FIG. 10B is a sectional view of a main part showing the state at the time of time-out.

FIG. 10A is an overall sectional view showing a state at the time of time-out, and FIG. 10B is a sectional view of a main part showing the state at the time of time-out.

When the contact arm 7 is not pressed against the member to be driven and the trigger valve stem 52 is not pushed by the contact lever 70 for a predetermined time after the start of timekeeping described with reference to FIGS. 6A, 6B, 7A and 7B, the striking cylinder 2 does not operate. Therefore, compressed air is not supplied from the blowback chamber 31 to the preset piston housing 85. In this way, the timer piston 80 is moved to the non-operating position in a predetermined time under the load such as the urging by the timer piston spring 81 and the discharge amount of air throttled by the choke 9.

In the timer 8, the flow path forming recess 87*b* of the timer piston shaft 86 is moved to a position facing the O-ring 87*a* when the timer piston 80 is moved to the non-operating position. In this way, the flow path communicating the inflow flow path 35 with the operation regulating low path 34 is opened by the gap between the O-ring 87*a* and the flow path forming recess 87*b*, and compressed air is supplied from the main chamber 3 to the operation regulating flow path 34.

Figure 11A:
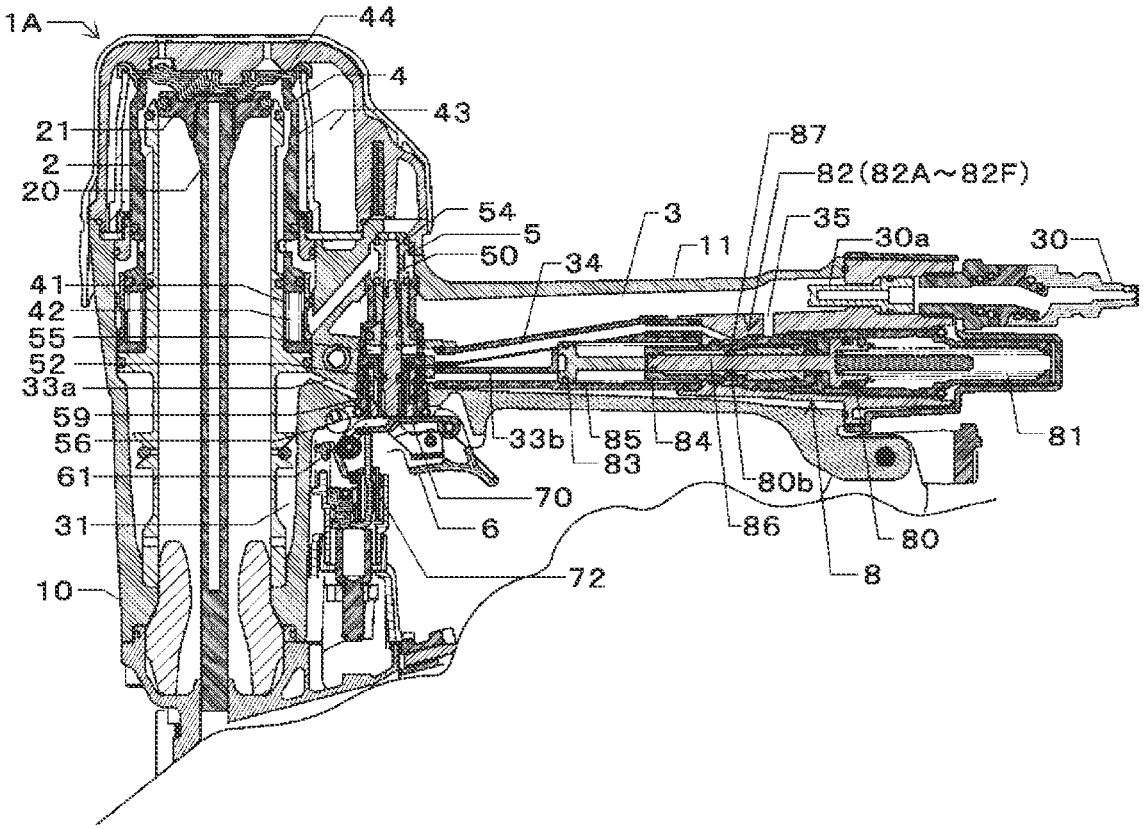
FIG. 11A is an overall sectional view showing a state in which the contact arm is operated after the time-out.
Figure 11B:
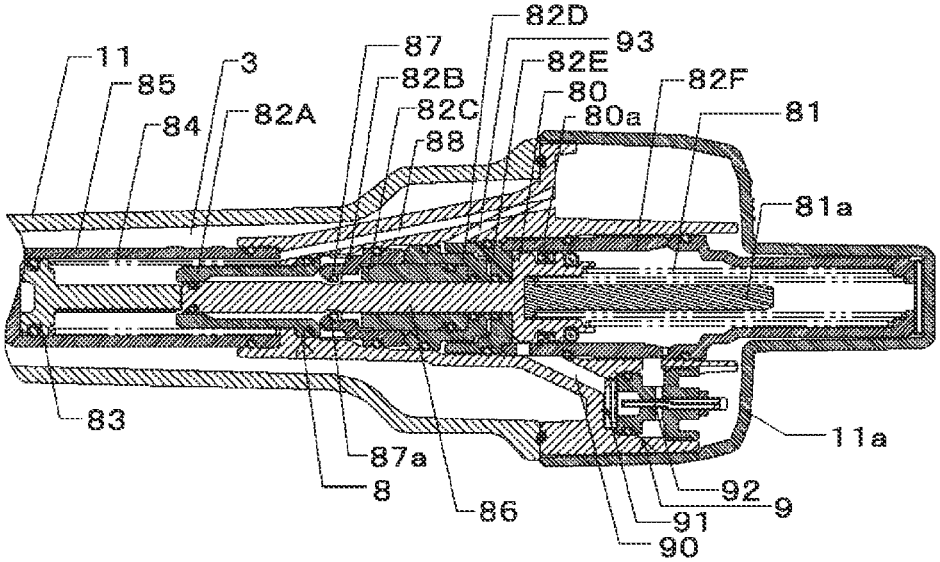
FIG. 11B is a sectional view of a main part showing the state in which the contact arm is operated after the time-out.

FIG. 11A is an overall sectional view showing a state in which the contact arm is operated after the time-out, and FIG. 11B is a sectional view of a main part showing the state in which the contact arm is operated after the time-out.

When the contact arm 7 shown in FIG. 1 is pressed against the member to be driven after the time-out, the pressing portion 72 of the contact arm 7 pushes the contact lever 70.

When the trigger 6 is moved to the operated position, the acting portion 70*a* of the contact lever 70 pushes the trigger valve stem 52. In the trigger valve 5, the trigger valve lower chamber 55 communicates with the operation regulating flow path 34 when the trigger valve stem 52 is moved upward by a predetermined amount. When the timer piston 80 is moved to the non-operating position, compressed air is supplied from the main chamber 3 to the operation regulating flow path 34. In this way, the trigger valve lower chamber 55 has a supply pressure by compressed air supplied from the main chamber 3 via the operation regulating flow path 34.

Therefore, the pilot valve 50 is held in the upper position due to the relationship between the balance of the air pressure of compressed air and the force of the trigger valve stem spring 54. In this way, the first air flow path 32 is not opened, the main valve 4 is held at the top dead center position, and the striking cylinder 2 does not operate.

<Detailed Example of the Timer and the Choke>

In the nailing machine 1A, until the timer piston 80 is moved from the timekeeping start position to the non-operating position after the trigger 6 is operated, the contact arm 7 is pressed against the member to be driven to perform the striking operation, and the timer 8 is reset.

On the other hand, when the timer piston 80 is moved from the timekeeping start position to the non-operating position after the trigger 6 is operated, the nailing machine 1A becomes a time-out, and the striking operation is not performed even when the contact arm 7 is pressed against the member to be driven.

In the nailing machine 1A, the moving speed of the timer piston 80 is controlled by generating compressed air by the timer 8 and the choke 9. In the timer 8, the time until the time-out is set by the balance among the force urging the timer piston 80 by the timer piston spring 81, the surface pressure of the air pressure applied to the timer piston 80, the sliding resistance of the timer piston 80 and the timer piston housing 82F, and the sliding resistance of the timer piston shaft 86 and the timer piston housings 82A to 82E.

Contact surface pressure is generated in an O-ring as a sealing member used in the trigger valve 5 and the timer 8 by the crushing margin at the time of assembly. When air pressure is applied to the timer piston 80, the surface contact pressure increases and the sliding resistance increases as the pressure increases. Under the influence of the environment, the rigidity of rubber increases at a lower temperature, and the sliding resistance further increases when the coefficient of friction increases due to running out of oil. These factors synergistically act and the sliding resistance changes, which greatly affects the time until the time-out.

On the other hand, reducing this change in sliding resistance leads to reducing the time-out time difference.

Therefore, the coefficient of friction of each sliding surface is reduced for the purpose of reducing the sliding resistance. At that time, it has been found that the desire purpose of reducing the sliding resistance can be achieved by using a material with a small friction resistance for a specific part and performing surface treatment.

First, the timer piston housing 82F on which the timer piston 80 slides is surface-treated with hard chrome plating. Further, among the timer piston housings 82A to 82E on which the timer piston shaft 86 slides, the timer piston housing 82C, which can come into contact with the timer piston shaft 86 without using a sealing member and has a large contactable area, is made of a high sliding grade POM.

Furthermore, the Y-ring 80*a* is used instead of an O-ring as a sealing member for the timer piston 80 that slides on the timer piston housing 82F. The Y-ring 80*a* having a Y-shaped cross section has a smaller sliding resistance than the O-ring when low-pressure air is shut off, and can suppress an increase in sliding resistance at a lower temperature.

The timer piston front chamber 80*c* formed by moving the timer piston 80 to the timekeeping start position is not configured to be supplied with compressed air from the main chamber 3, and the internal pressure thereof is determined according to the position of the timer piston 80. Therefore, the pressure in the timer piston front chamber 80*c* is lower than the supply pressure in the main chamber 3.

In this way, the necessary and sufficient blocking property can be obtained by using the Y-ring 80*a* instead of the O-ring as the sealing member for the timer piston 80. The variation in the time-out time can be suppressed by the characteristic of the Y-ring that the sliding resistance is smaller than that of the O-ring and the characteristic of the Y-ring that the increase in sliding resistance at a lower temperature can be suppressed.

The timer piston front chamber 80*c* is not configured to be supplied with compressed air from the main chamber 3, and the Y-ring 80*a* can be used for the timer piston 80. On the other hand, since a gap between the timer piston housing 82A and the timer piston shaft 86 and a gap between the timer piston housings 82B to 82D and the timer piston shaft 86 serve as a flow path for supplying compressed air from the main chamber 3, the air pressure in these portions is higher than that of the timer piston front chamber 80*c*. Therefore, it is not suitable to use the Y-ring as the sealing member in these portions, and the O-ring 87*a* is used in the on-off valve part 87 and the like.

As described above, contact surface pressure is generated in the O-ring by the crushing margin at the time of assembly. When air pressure is applied to the timer piston 80, the surface contact pressure increases and the sliding resistance increases as the pressure increases. Under the influence of the environment, the rigidity of rubber increases at a lower temperature, and the sliding resistance further increases when the coefficient of friction increases due to running out of oil. These factors synergistically act and the sliding resistance changes, which greatly affects the time until the time-out. In this way, the sliding resistance of the on-off valve part 87 and the like using the O-ring as the sealing member becomes large due to the influence of the supply pressure, which affects the time until the time-out. Therefore, a force that cancels the sliding resistance by using the supply pressure is applied to the timer piston 80.

Figure 12:
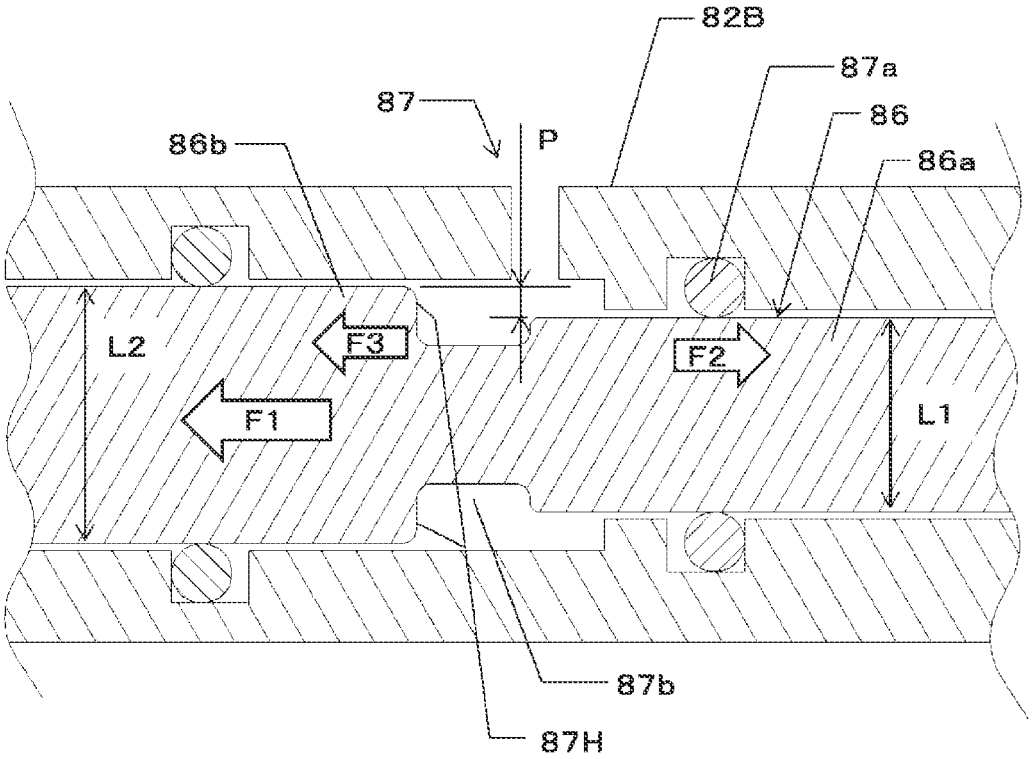
FIG. 12 is an enlarged sectional view showing a main configuration of an on-off valve part.

FIG. 12 is an enlarged sectional view showing a main configuration of the on-off valve part. In the on-off valve part 87, the timer piston shaft 86 is formed such that a diameter L2 of the shaft portion 86*b* on the side opposite to the timer piston 80 is larger than a diameter L of the shaft portion 86*a* on the side of the timer piston 80 with the flow path forming recess 87*b* interposed therebetween. In the on-off valve part 87, the pressure receiving surface 87H that receives the force of the compressed air supplied from the main chamber 3 is formed by the diameter difference of the timer piston shaft 86, which is the difference between the diameter L1 of the shaft portion 86*a* of the timer piston shaft 86 and the diameter L2 of the shaft portion 86*b*. That is, in the on-off valve part 87, the pressure receiving surface 87H formed by the diameter difference of the timer piston shaft 86 at the portions sandwiching the flow path forming recess 87*b* of the timer piston shaft 86 provides a difference in the pressure receiving area that receives the pressure of air in the axial direction of the timer piston shaft 86. In this way, in the timer piston shaft 86, a force for pushing the timer piston shaft 86 in the axial direction is generated by the supply pressure.

In the configuration in which the pressure receiving surface 87H formed by the diameter difference of the timer piston shaft 86 generates the force for pushing the timer piston shaft 86 in the axial direction by the supply pressure, similarly to the sliding resistance, the force for pushing the timer piston shaft 86 also increases as the supply pressure increases.

Therefore, the force for pushing the timer piston shaft 86 in the axial direction by the supply pressure is generated in the direction of cancelling the sliding resistance. Since the timer piston shaft 86 is moved in an arrow F1 direction by the timekeeping operation in which the timer piston 80 is moved from the timekeeping start position to the non-operating position, sliding resistance in an arrow F2 direction opposite to the moving direction is generated. On the other hand, when the diameter of the shaft portion 86*b* on the side opposite to the timer piston 80 is made larger than the diameter of the shaft portion 86*a* on the side of the timer piston 80 with the flow path forming recess 87*b* interposed therebetween, a force for pushing the timer piston shaft 86 is generated in an arrow F3 direction along the moving direction of the timer piston shaft 86 in the timekeeping operation.

In this way, even when the sliding resistance between the timer piston shaft 86 and the O-ring 87*a* increases in proportional to the supply pressure, similarly, the force for pushing the timer piston shaft 86 in the axial direction also increases due to the difference in the pressure receiving area, and therefore, the change in sliding resistance can be cancelled.

In this manner, the variation in the time-out time can be suppressed as necessary and sufficient by a combination of material change and surface treatment of a specific part in the timer piston housings 82A to 82F, using the Y-ring 80*a* for the timer piston 80, and cancelling the change in sliding resistance by using the difference in the pressure receiving area. The Y-ring has a characteristic that the sliding resistance is small at a low pressure, but the sliding resistance increases sharply as the pressure increases. On the contrary, the pressure in the timer piston front chamber 80*c* is smaller than the supply pressure in the main chamber 3, as described above. In this way, when the Y-ring 80*a* is used for the timer piston 80 on which the air pressure lower than the supply pressure acts, the demerit at the time of using the Y-ring as the sealing member, that is, the demerit that the sliding resistance increases when a high pressure such as the supply pressure is applied is suppressed, and the merit that the sliding resistance is small at a low pressure can be utilized.

Subsequently, a configuration for reliably opening and closing the on-off valve part 87 will be described. The on-off valve part 87 has a flow path that is opened by the gap between the O-ring 87*a* and the flow path forming recess 87*b* when the flow path forming recess 87*b* is moved to a position facing the O-ring 87*a*. However, the on-off valve part 87 may be not opened under a high temperature or a high pressure due to fluctuation in the supply pressure.

The reason is considered to be that the rigidity of the O-ring, which is a rubber part, decreases at a high temperature or the amount of deformation of the O-ring increases at a high pressure, and thus, the O-ring 87*a* is deformed to be continuously in contact with the flow path forming recess 87*b*.

Therefore, the on-off valve part 87 includes a deformation suppressing portion 87*c* for the O-ring 87*a* The on-off valve part 87 is a groove formed between the timer piston housing 82B and the timer piston housing 82C along the axial direction of the timer piston shaft 86, and a mounting groove portion 87*d* for the O-ring 87*a* is formed therein. Further, the deformation of the O-ring 87*a* is suppressed by narrowing the opening on the entrance side of the mounting groove portion 87*d* facing the timer piston shaft 86 along the axial direction of the timer piston shaft 86.

Figure 13A:
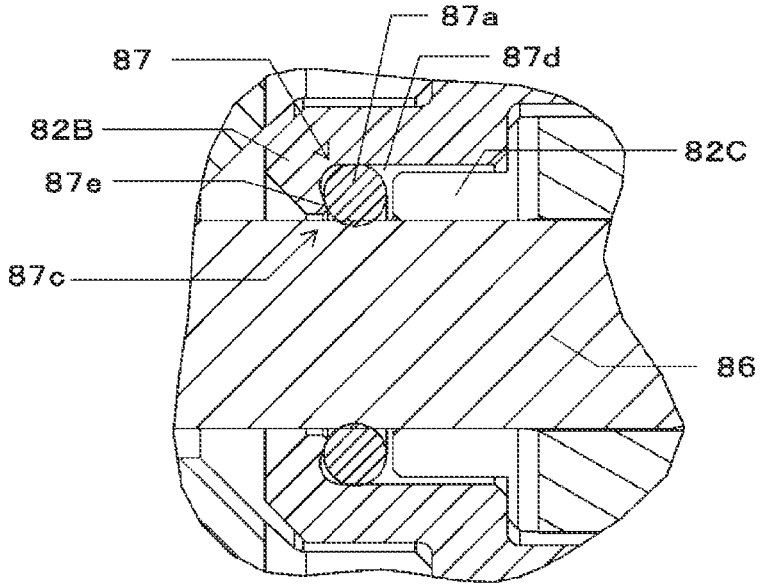
FIG. 13A is a sectional view of a main part showing an example of a deformation suppressing portion.
Figure 13B:
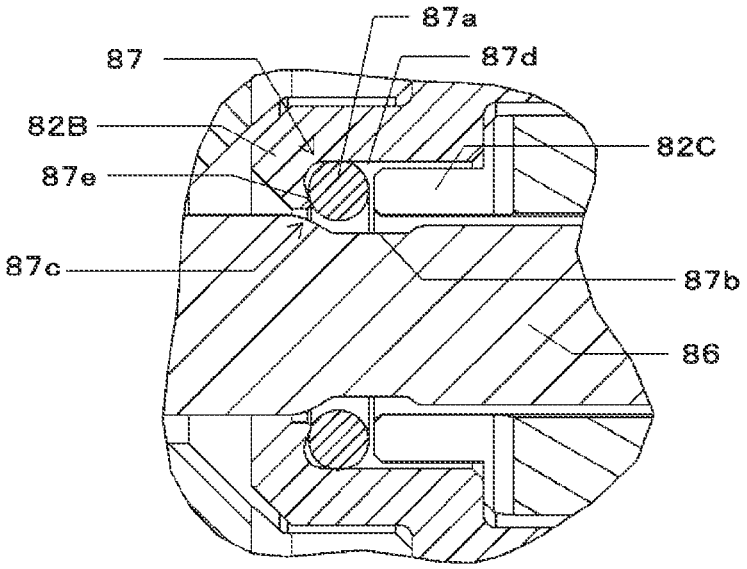
FIG. 13B is a sectional view of a main part showing an example of the deformation suppressing portion.

FIGS. 13A and 13B are sectional views of a main part showing an example of the deformation suppressing portion. In the deformation suppressing portion 87*c*, the opening on the entrance side of the mounting groove portion 87*d* is narrowly configured by providing a convex portion 87*e* protruding from the timer piston housing 82B toward the timer piston housing 82C on the opening on the entrance side of the mounting groove portion 87*d* facing the timer piston shaft 86.

In this way, as shown in FIG. 13A, the flow path is closed by the O-ring 87*a* when the O-ring 87*a* mounted to the mounting groove portion 87*d* is in contact with the timer piston shaft 86. On the contrary, as shown in FIG. 13B, the flow path is opened by the gap between the O-ring 87*a* and the flow path forming recess 87*b* when the flow path forming recess 87*b* faces the O-ring 87*a*. When the opening on the entrance side of the mounting groove portion 87*d* is narrowly configured, it is suppressed that the O-ring 87*a* is deformed to be continuously in contact with the flow path forming recess 87*b*. Further, the flow path can be reliably opened even under a high temperature or a high pressure due to fluctuation in the supply pressure, and it is possible to suppress the changes in the time-out time due to the magnitude of temperature and pressure.

Figure 14A:
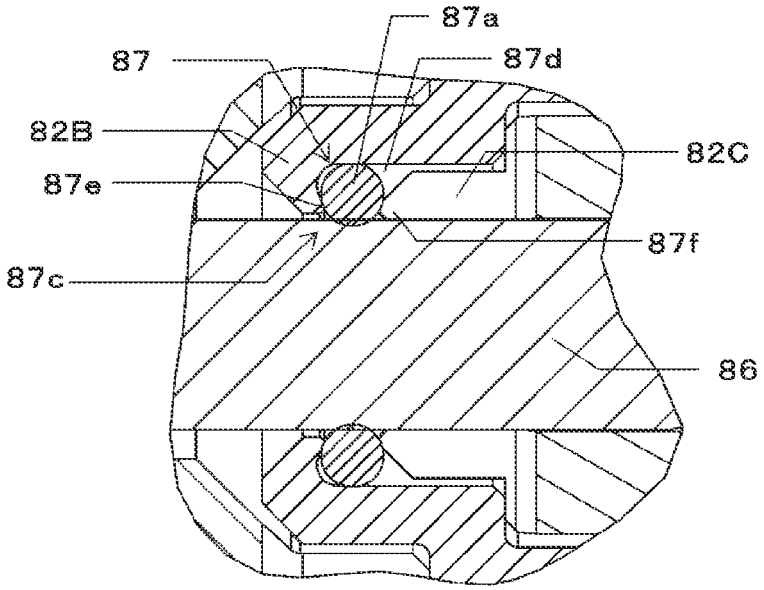
FIG. 14A is a sectional view of a main part showing another example of the deformation suppressing portion.
Figure 14B:
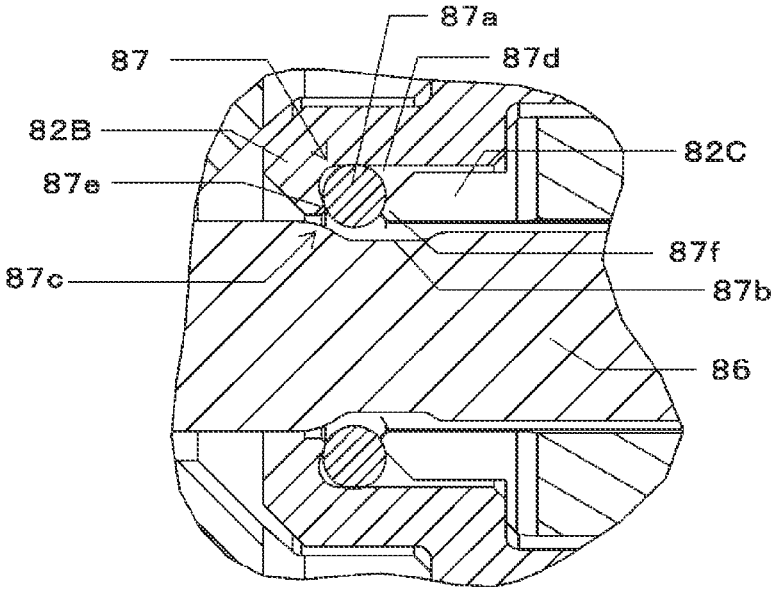
FIG. 14B is a sectional view of a main part showing another example of the deformation suppressing portion.

FIGS. 14A and 14B are sectional views of a main part showing another example of the deformation suppressing portion. In the deformation suppressing portion 87*c* of another example, the opening on the entrance side of the mounting groove portion 87*d* is narrowly configured by providing the convex portion 87*e* protruding from the timer piston housing 82B toward the timer piston housing 82C and a convex portion 87*f* protruding from the timer piston housing 82C toward the timer piston housing 82B on the opening on the entrance side of the mounting groove portion 87*d* facing the timer piston shaft 86.

In this way, as shown in FIG. 14A, the flow path is closed by the O-ring 87*a* when the O-ring 87*a* mounted to the mounting groove portion 87*d* is in contact with the timer piston shaft 86. On the contrary, as shown in FIG. 14B, the flow path is opened by the gap between the O-ring 87*a* and the flow path forming recess 87*b* when the flow path forming recess 87*b* faces the O-ring 87*a*. When the opening on the entrance side of the mounting groove portion 87*d* is narrowly configured, it is suppressed that the O-ring 87*a* is deformed to be continuously in contact with the flow path forming recess 87*b*. Further, the flow path can be reliably opened even under a high temperature or a high pressure due to fluctuation in the supply pressure, and it is possible to suppress the changes in the time-out time due to the magnitude of temperature and pressure.

Figure 15:
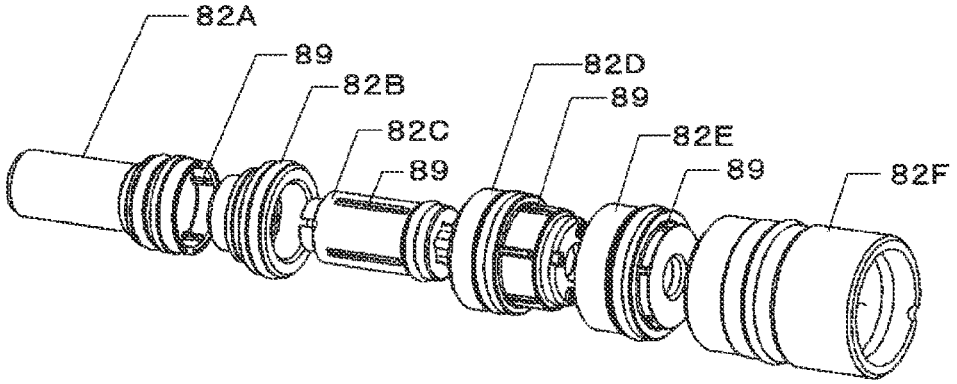
FIG. 15 is an exploded perspective view showing an example of a timer piston housing.

Subsequently, the accuracy improvement of the timer piston housing composed of a plurality of parts will be described. FIG. 15 is an exploded perspective view showing an example of the timer piston housing. In the timer 8 shown in FIG. 2B and the like, since the flow path is opened and closed by the on-off valve part 87, a plurality of flow paths and a sealing member such as a plurality of sliding O-rings are required. The timer piston 80 and the timer piston shaft 86 are supported by a component composed of a combination of the timer piston housings 82A to 82F as shown in FIG. 15.

Therefore, the sliding surface on which the timer piston 80 and the timer piston shaft 86 slide is configured by the inner wall surfaces of the plurality of timer piston housings 82A to 82F. When the central axes of the inner wall surfaces of the plurality of timer piston housings 82A to 82F are deviated from each other, this causes a delay in the time-out time due to excessive interference of any one of the timer piston housings with the timer piston 80 and the timer piston shaft 86, and this also causes a stable time-out time not to be obtained.

For this reason, the spaces between the plurality of timer piston housings are supported by a plurality of ribs 89 provided on inner wall surfaces or outer wall surfaces of the timer piston housings 82A to 82F. In the configuration in which the ribs 89 are provided on the inner wall surfaces of the timer piston housings, a diameter of a virtual circle connecting tips of the ribs 89 is made smaller than an outer diameter of the outer wall surface of the timer piston housing to be fitted, thereby providing a crushing margin. Further, in the configuration in which the ribs 89 are provided on the outer wall surfaces of the timer piston housings, the diameter of the virtual circle connecting the tips of the ribs 89 is made larger than an outer diameter of the inner wall surface of the timer piston housing to be fitted, thereby providing a crushing margin.

Figure 16A:
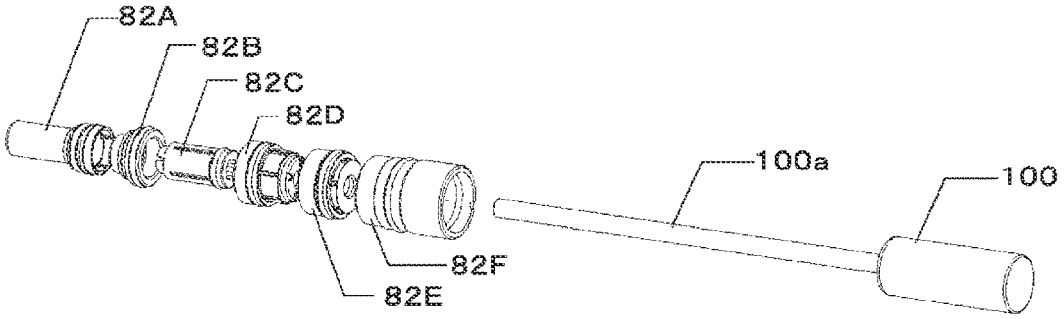
FIG. 16A is a perspective view showing an example of an assembly process of a timer piston housing.
Figure 16B:
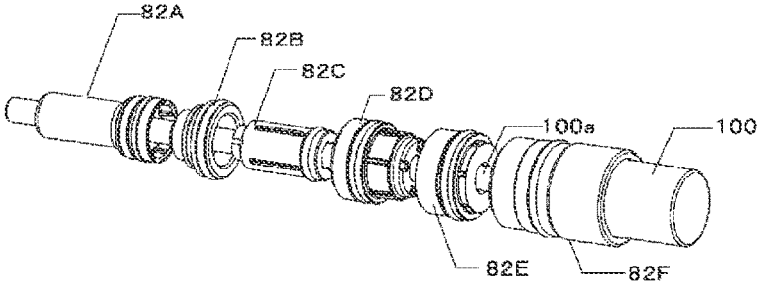
FIG. 16B is a perspective view showing an example of the assembly process of the timer piston housing.

FIGS. 16A to 16D are perspective views showing an example of an assembly process of the timer piston housings. In order to assemble the timer piston housings 82A to 82F, first, as shown in FIGS. 16A and 16B, the timer piston housings 82A to 82F are passed through a shaft 100*a* of a jig 100 in order.

Figure 16C:
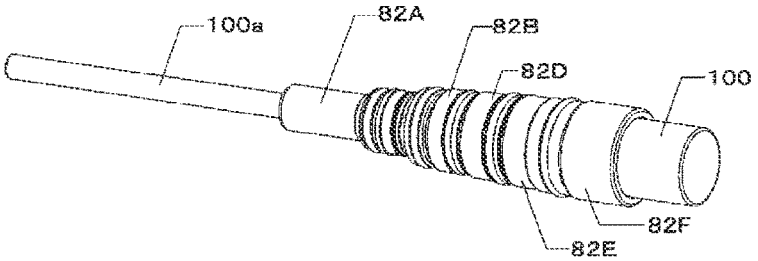
FIG. 16C is a perspective view showing an example of the assembly process of the timer piston housing.

As shown in FIG. 16C, the timer piston housings 82A to 82F are fitted with the central axes defined by the shaft 100*a* of the jig 100 when the timer piston housings 82A to 82F passed through the shaft 100*a* of the jig 100 are fitted. Therefore, the timer piston housings 82A to 82F are fitted in a state where the ribs 89 are crushed appropriately.

Figure 16D:
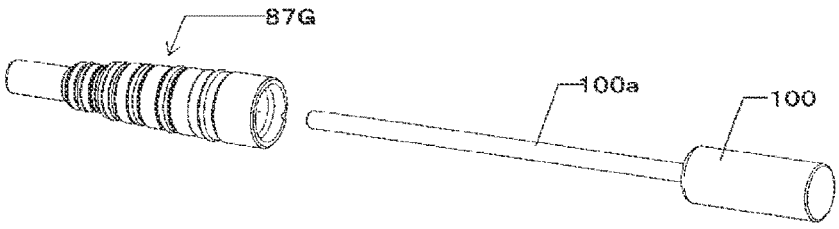
FIG. 16D is a perspective view showing an example of the assembly process of the timer piston housing.

As shown in FIG. 16D, a timer piston housing assembly 82G in which the timer piston housings 82A to 82F are integrally supported by the ribs 89 is configured by pulling out the shaft 100*a* of the jig 100.

Figure 17:
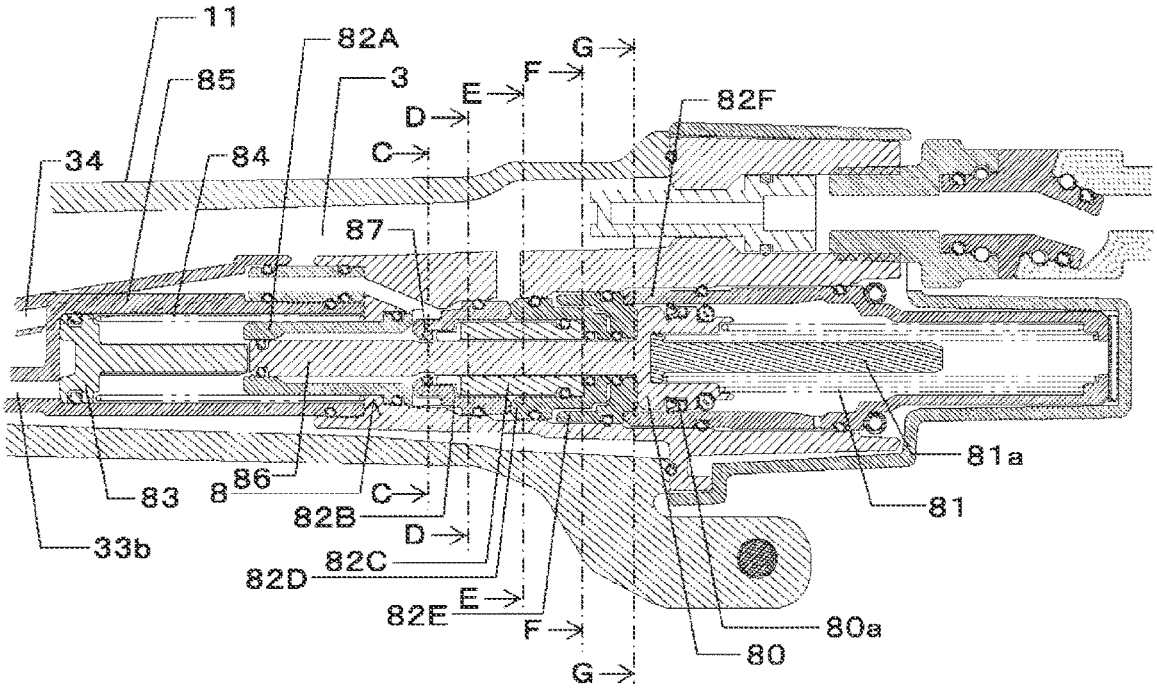
FIG. 17 is a side sectional view showing an example of the timer.
Figure 18A:
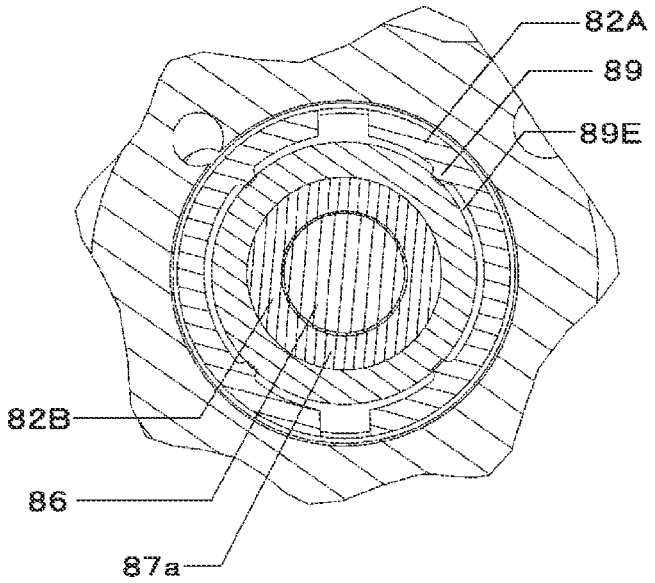
FIG. 18A is a sectional view taken along the line C-C in FIG. 17 showing a cross section of the timer piston housing.
Figure 18B:
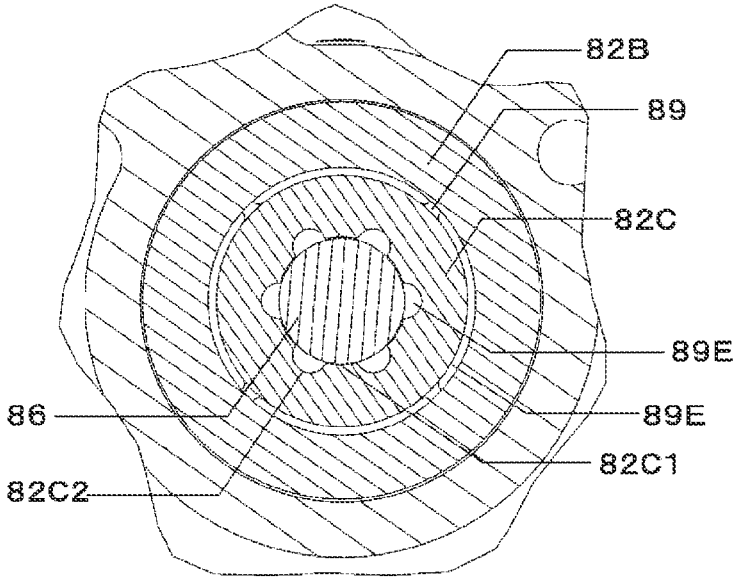
FIG. 18B is a sectional view taken along the line D-D in FIG. 17 showing a cross section of the timer piston housing.
Figure 18C:
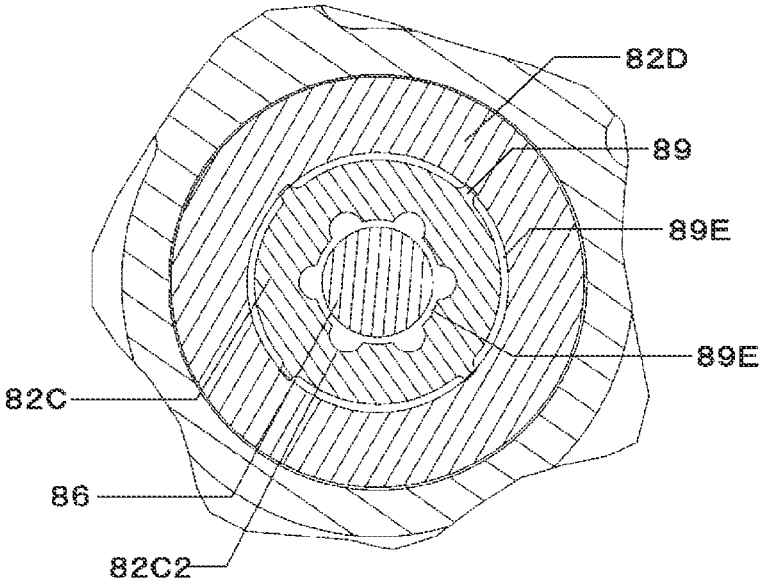
FIG. 18C is a sectional view taken along the line E-E in FIG. 17 showing a cross section of the timer piston housing.
Figure 18D:
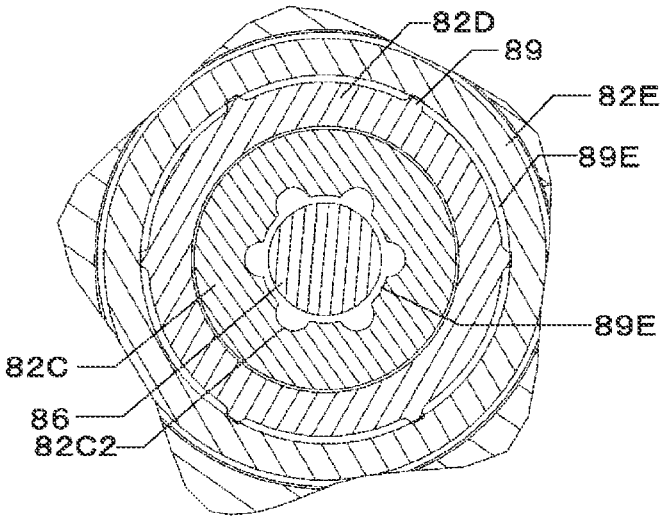
FIG. 18D is a sectional view taken along the line F-F in FIG. 17 showing a cross section of the timer piston housing.
Figure 18E:
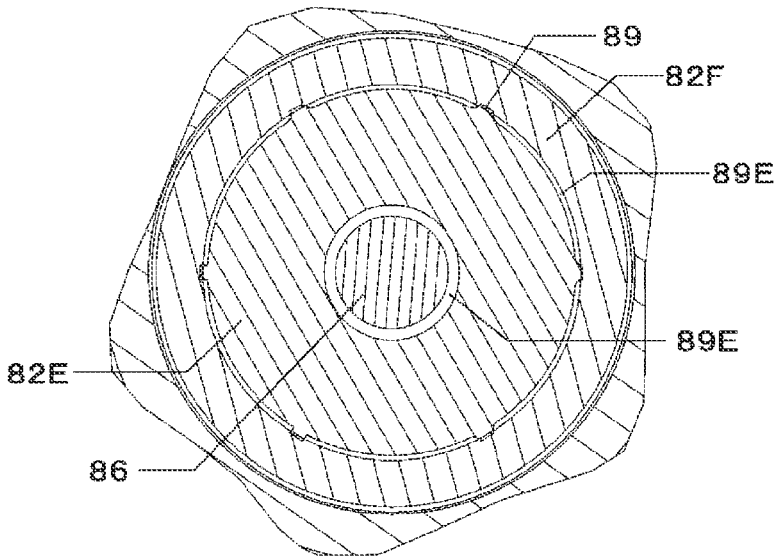
FIG. 18E is a sectional view taken along the line G-G in FIG. 17 showing a cross section of the timer piston housing.

FIG. 17 is a side sectional view showing an example of the timer, FIG. 18A is a sectional view taken along the line C-C in FIG. 17 showing a cross section of the timer piston housing, FIG. 18B is a sectional view taken along the line D-D in FIG. 17 showing a cross section of the timer piston housing, FIG. 18C is a sectional view taken along the line E-E in FIG. 17 showing a cross section of the timer piston housing, FIG. 18D is a sectional view taken along the line F-F in FIG. 17 showing a cross section of the timer piston housing, and FIG. 18E is a sectional view taken along the line G-G in FIG. 17 showing a cross section of the timer piston housing.

The timer piston housings 82A to 82F can form the timer piston housing assembly 82G having substantially the same central axis, so that excessive interference of any one of the timer piston housings with the timer piston 80 and the timer piston shaft 86 is suppressed and a stable time-out time is obtained. Further, gaps are formed between the outer wall surfaces and the inner wall surfaces of the fitting portions of the timer piston housings 82A to 82F by the ribs 89, and these gaps form a flow path 89E through which air or oil passes.

Figure 19A:
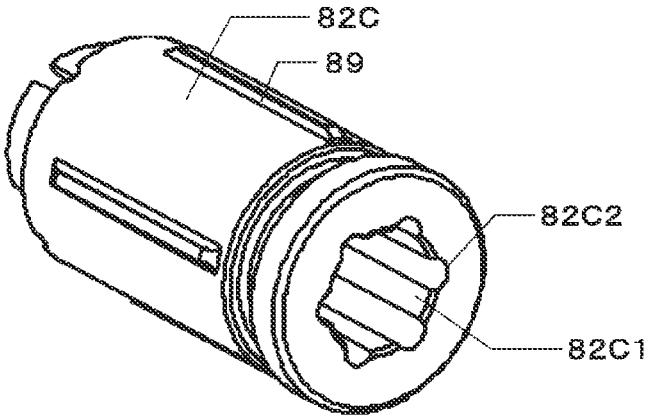
FIG. 19A is a perspective view showing an example of the timer piston housing.
Figure 19B:
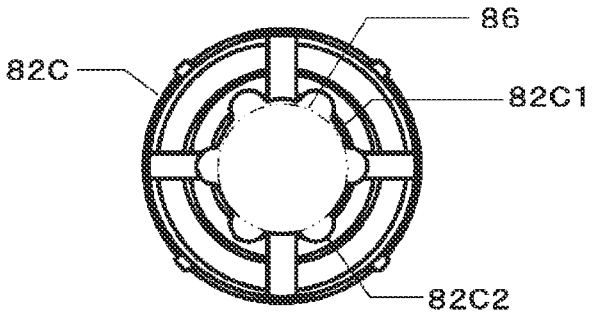
FIG. 19B is a front view showing an example of the timer piston housing.
Figure 19C:
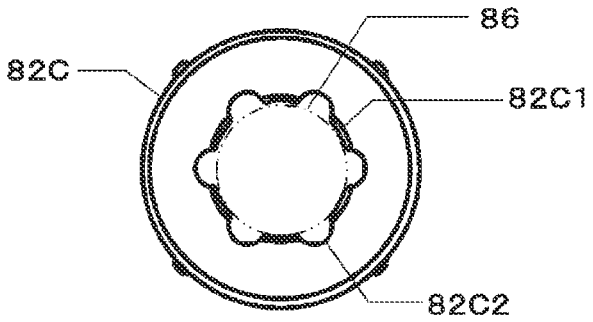
FIG. 19C is a rear view showing an example of the timer piston housing.

FIG. 19A is a perspective view showing an example of the timer piston housing, FIG. 19B is a front view showing an example of the timer piston housing, and FIG. 19C is a rear view showing an example of the timer piston housing. Next, a clearance between the timer piston housing and the timer piston shaft will be described.

As described above, since the timer piston housings 82A to 82F can form the timer piston housing assembly 82G having substantially the same central axis, the clearance between the timer piston housings 82A to 82F and the timer piston 80 and the timer piston shaft 86 can be reduced. Radial fluctuation of the timer piston shaft 86 is suppressed and the behavior is stabilized when the clearance is reduced. On the other hand, the influence of the presence or absence of lubricating oil and the changes in the viscous resistance of lubricating oil due to temperature environment becomes larger.

Therefore, among the timer piston housings 82A to 82E on which the timer piston shaft 86 slides, the timer piston housing 82C, which can come into contact with the timer piston shaft 86 without using a sealing member and has a large contactable area, is provided with a flow path expansion groove 82C2 on a guide surface 82C1 into which the timer piston shaft 86 is inserted.

The flow path expansion groove 82C2 is configured by providing grooves extending along the axial direction of the timer piston shaft 86 at a plurality of locations in the circumferential direction of the guide surface 82C1. In this way, at the position of the timer piston housing 82C where the flow path expansion groove 82C2 is not formed, the clearance between the timer piston shaft 86 and the guide surface 82C1 can be maintained, and the guide property of the timer piston shaft 86 can be maintained. Further, at the position of the timer piston housing 82C where the flow path expansion groove 82C2 is formed, the flow path of lubricating oil is expanded and the viscous resistance can be reduced. In this way, the influence of the change in the viscous resistance of oil on the time-out time can be suppressed.

Subsequently, the performance maintenance of the choke 9 will be described. The choke 9 has a configuration in which the needle 92 is inserted into a tubular flow path and the discharge flow path 90 is throttled. Since the throttled flow path is extremely narrow, the time-out time may be significantly delayed when foreign matters such as oil are introduced. Even when the flow path communicating with the choke 9 is shut off from the main chamber 3 by sealing the space between each timer piston housing and the timer piston with the O-ring, a very small amount of oil may leak from the state in which the supply pressure is not applied to the O-ring until the supply of compressed air is started and a sufficient sealing property is ensured. Further, since a very small amount of oil may leak even due to the sliding of the timer piston 80, oil may be introduced into the flow path communicating with the choke 9.

Therefore, as shown in FIG. 2C, the nailing machine 1A includes the foreign matter discharge flow path 93 that suppresses foreign matters from entering the choke 9 mainly from the flow path formed between the timer piston shaft 86 and the timer piston housings 82A to 82C communicating with the main chamber 3. The foreign matter discharge flow path 93 communicates the flow path formed between the timer piston housing 82D and the timer piston shaft 86 with the atmosphere.

The choke 9 communicates with the timer piston housing 82F via the discharge flow path 90 and communicates with a flow path formed between the timer piston housing 82E and the timer piston shaft 86. The flow path formed between the timer piston housing 82E and the timer piston shaft 86 is shut off from the flow path formed between the timer piston housing 82D and the timer piston shaft 86 by the O-ring.

In this way, the flow path formed between the timer piston housing 82D and the timer piston shaft 86 and the atmosphere are communicated with each other by the foreign matter discharge flow path 93, so that it is possible to suppress oil or the like from entering the flow path formed between the timer piston housing 82E and the timer piston shaft 86. Therefore, oil is suppressed from entering the flow path communicating with the choke 9, and the accumulation of oil is suppressed, so that the performance of the choke 9 can be maintained and the influence on the time-out time can be suppressed.

Further, in the timer 8, the axial position of the needle 92 can be adjusted by using a screw so that the time until the time-out can be set to a predetermined reference time. In order to make it easier to adjust the needle 92 from the outside, the choke 9 is provided on an end cap 11*a* of the handle 11, and the needle 92 can be adjusted from the outside of the end cap 11*a*. The choke 9 can be mounted to the handle 11 after being assembled to the end cap 11*a*. Therefore, compared to the case where the choke 9 is assembled inside the handle 11, assembling work becomes easier, the choke 9 can be easily adjusted for each machine body so that the time until the time-out becomes the reference time, and it is possible to deal with individual differences in parts.

FIGS. 20A to 20D are sectional views of a main part showing an example of a mechanism for adjusting the time until the time-out. By allowing a user to adjust the time until the time-out described above, it is possible to adjust whether to prioritize safety or operability according to the user's preference. However, in a throttle adjustment mechanism using a screw, when the area of the flow path is small, the influence of the flow rate becomes large even with a slight rotation of the needle 92. Accordingly, the adjustment becomes severe and becomes difficult.

Therefore, the nailing machine 1A includes a throttling amount adjustment part 94 of the choke 9, a spring force adjustment part 95, and a volume adjustment part 96. The throttling amount adjustment part 94 makes it possible to adjust the throttling amount in two steps by adjusting the position of the needle 92 in a stepwise manner, in this example, in two steps by the displacement of a throttling amount adjustment lever 94*b* with a shaft 94*a* as a fulcrum.

The spring force adjustment part 95 makes it possible to adjust the spring force of the timer piston spring 81 that urges the timer piston 80 in a stepless manner with a screw or in a stepwise manner with a lever or the like. The volume adjustment part 96 makes it possible to adjust the volume of the discharge flow path 90 in a stepless manner with a screw or in a stepwise manner with a lever or the like.

Figure 20A:
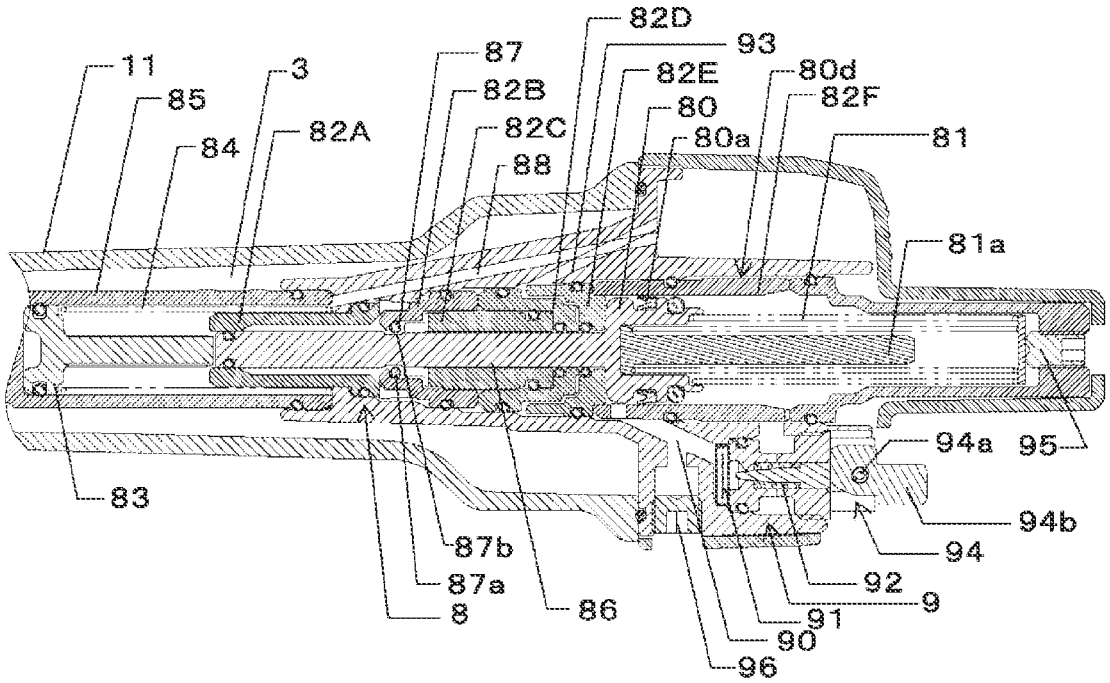
FIG. 20A is a sectional view of a main part showing an example of a mechanism for adjusting the time until the time-out.
Figure 20B:
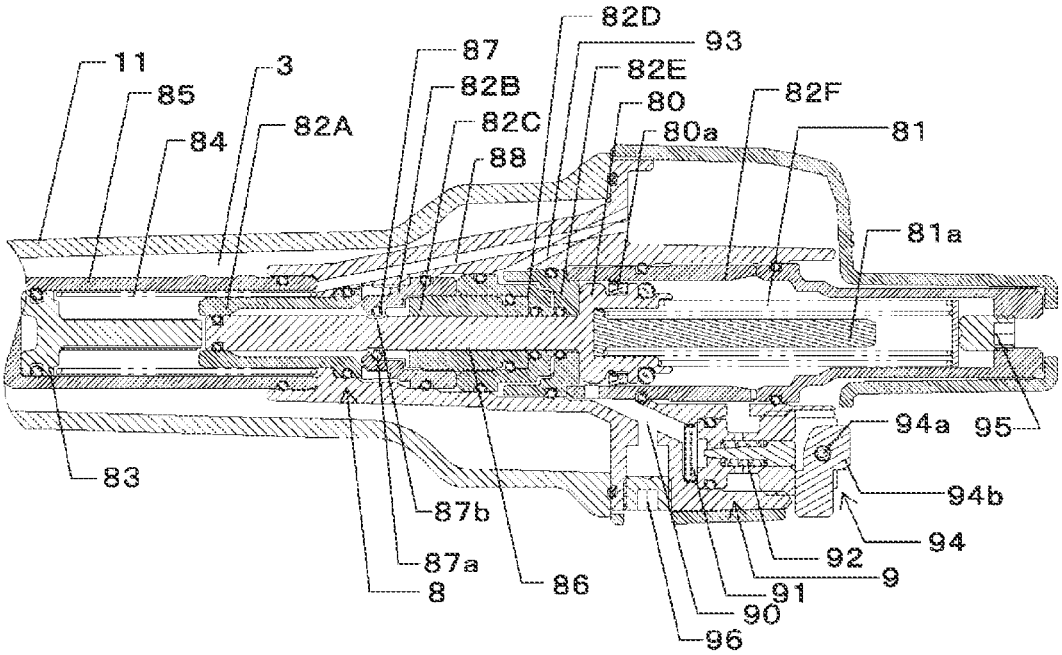
FIG. 20B is a sectional view of a main part showing an example of the mechanism for adjusting the time until the time-out.

In FIG. 20B, the throttling amount adjustment part 94 is set so that the throttling amount by the needle 92 is reduced and the time until the time-out is shortened. Further, the spring force adjustment part 95 is set so that the spring force of the timer piston spring 81 is strengthen and the time until the time-out is shortened. Furthermore, the volume adjustment part 96 is set so that the volume of the discharge flow path 90 is increased and the time until the time-out is shortened. By setting the throttling amount adjustment part 94, the spring force adjustment part 95 and the volume adjustment part 96 as described above, the time until the time-out is set to be shorter.

Figure 20C:
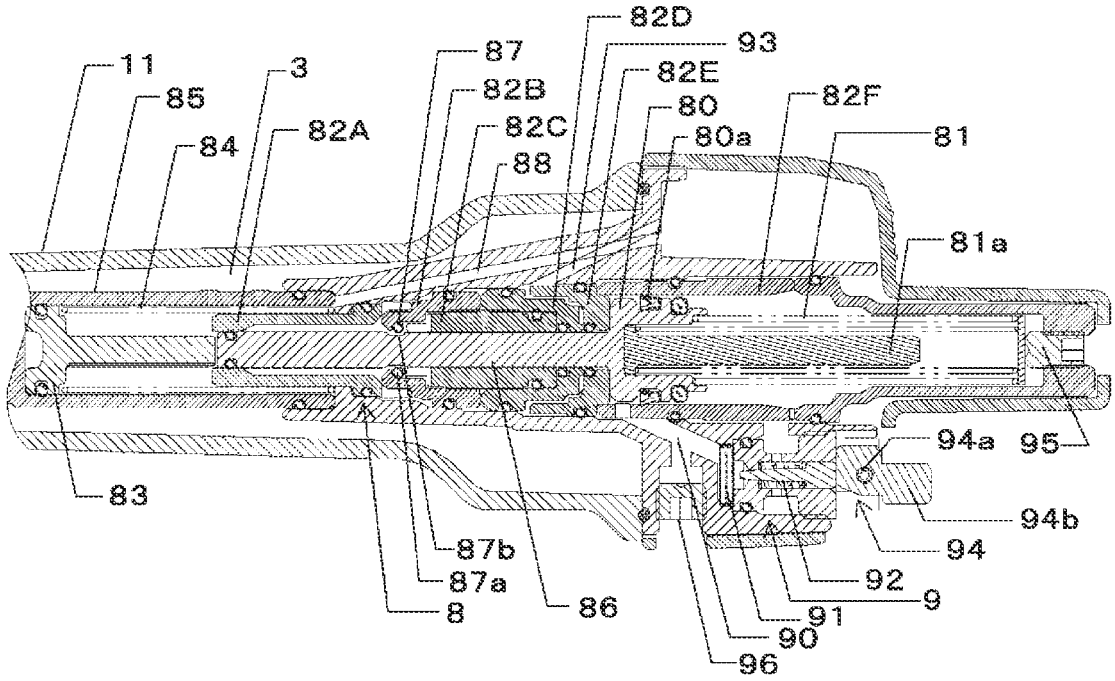
FIG. 20C is a sectional view of a main part showing an example of the mechanism for adjusting the time until the time-out.

In FIG. 20C, the throttling amount adjustment part 94 is set so that the throttling amount by the needle 92 is increased and the time until the time-out is lengthened. Further, the spring force adjustment part 95 is set so that the spring force of the timer piston spring 81 is weakened and the time until the time-out becomes longer than that in FIG. 20B. Furthermore, the volume adjustment part 96 is set so that the volume of the discharge flow path 90 is reduced and the time until the time-out becomes longer than that in FIG. 20B. By setting the throttling amount adjustment part 94, the spring force adjustment part 95 and the volume adjustment part 96 as described above, the time until the time-out is set to standard.

Figure 20D:
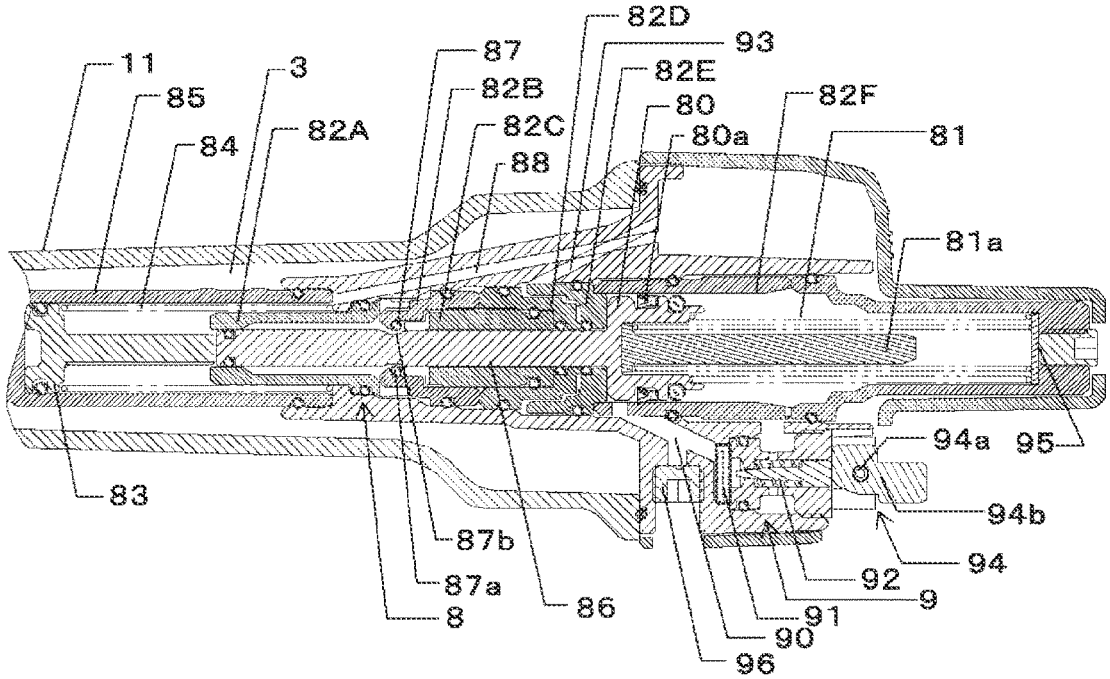
FIG. 20D is a sectional view of a main part showing an example of the mechanism for adjusting the time until the time-out.

In FIG. 20D, the throttling amount adjustment part 94 is set so that the throttling amount by the needle 92 is increased and the time until the time-out is lengthened. Further, the spring force adjustment part 95 is set so that the spring force of the timer piston spring 81 is further weakened and the time until the time-out becomes longer than that in FIG. 20C. Furthermore, the volume adjustment part 96 is set so that the volume of the discharge flow path 90 is further reduced and the time until the time-out becomes longer than that in FIG. 20C. By setting the throttling amount adjustment part 94, the spring force adjustment part 95 and the volume adjustment part 96 as described above, the time until the time-out is set to be longer.

In this way, a user can easily and reliably adjust the time until the time-out, so that it is possible to adjust whether to prioritize safety or operability according to the user's preference.

<Configuration Example of a Nailing Machine of a Second Embodiment>

Figure 21A:
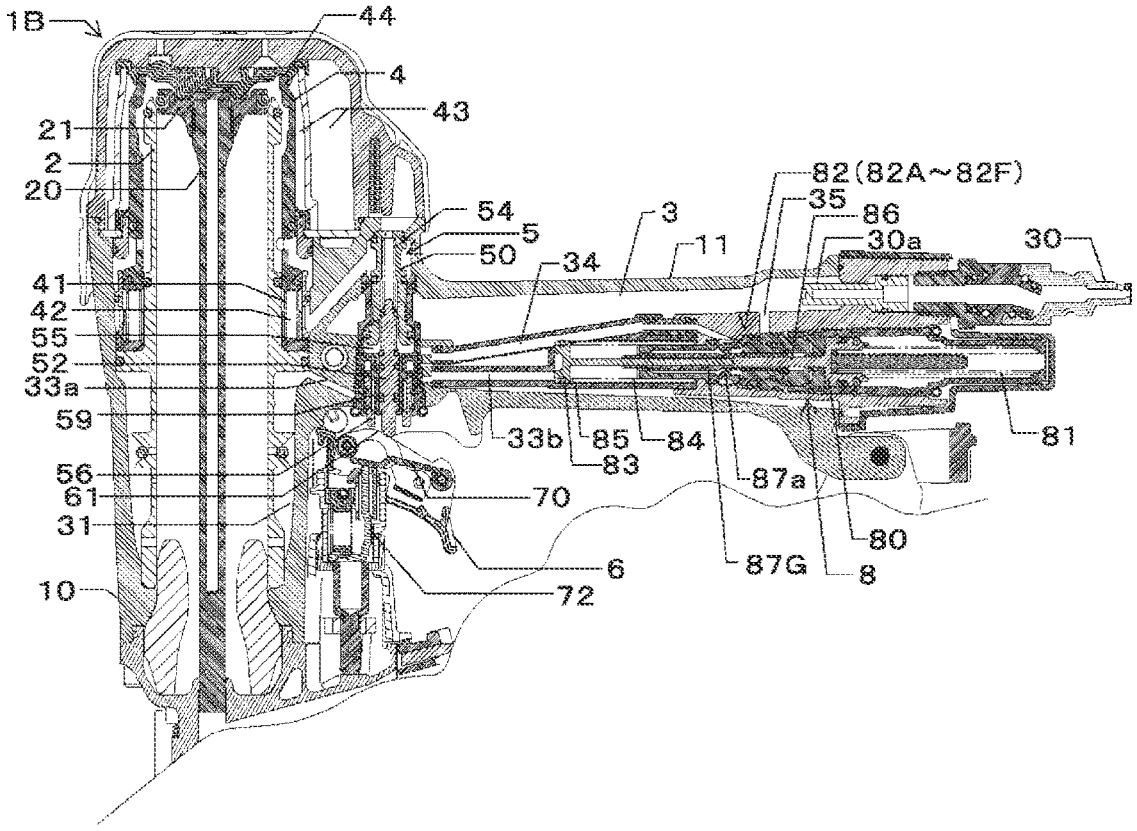
FIG. 21A is an overall sectional view showing an example of a nailing machine according to a second embodiment.
Figure 21B:
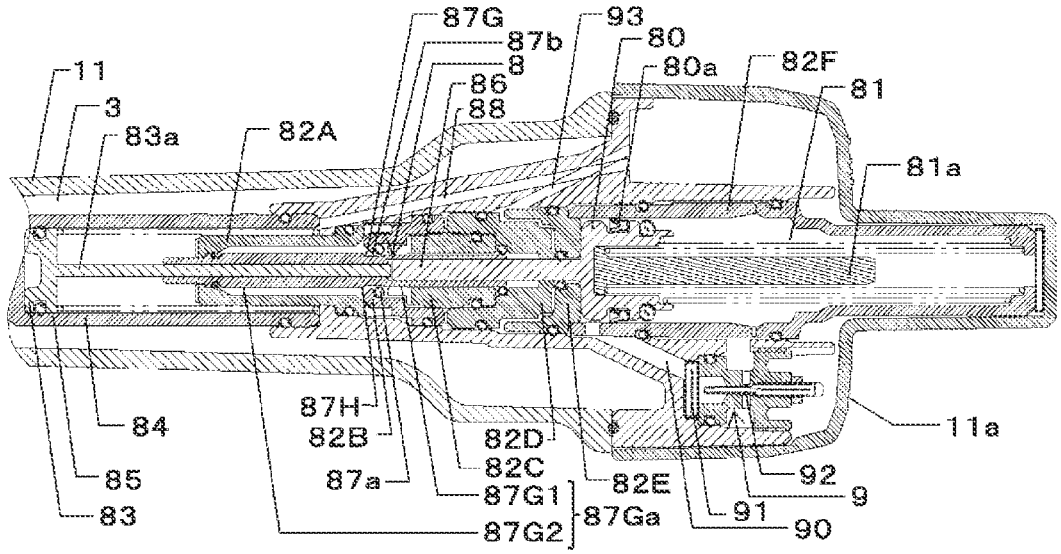
FIG. 21B is a sectional view of a main part showing an example of the nailing machine according to the second embodiment.

FIG. 21A is an overall sectional view showing an example of a nailing machine according to a second embodiment, and FIG. 21B is a sectional view of a main part showing an example of the nailing machine according to the second embodiment. In a nailing machine 1B of the second embodiment, the timer 8 that controls the speed of the timer piston 80 by meter-out control has a configuration in which the timer piston 80 and an on-off valve part 87G are separate parts. The on-off valve part 87G is configured to be movable along the moving direction of the timer piston 80 by being guided by the preset piston shaft 83*a* of the preset piston 83 and the timer piston shaft 86 of the timer piston 80, and is moved by being pushed by the preset piston 83 and the timer piston shaft 86 of the timer piston 80. Further, in the nailing machine 1A of the first embodiment, the pressure receiving surface 87H formed by the diameter difference is provided on the timer piston shaft 86. In the nailing machine 1B of the second embodiment, the pressure receiving surface 87H is provided on the on-off valve part 87G. The on-off valve part 87G is formed such that a diameter of a shaft portion 87G2 on the side opposite to the timer piston 80 is larger than a diameter of a shaft portion 87G1 on the side of the timer piston 80 with the flow path forming recess 87*b* interposed therebetween. In the on-off valve part 87G, the pressure receiving surface 87H that receives the force of the compressed air supplied from the main chamber 3 is formed by the diameter difference of a shaft portion 87Ga, which is the difference between the diameter of the shaft portion 87G1 and the diameter of the shaft portion 87G2. In this way, in the on-off valve part 87G, the shaft portion 87Ga is pressed by the supply pressure. Other configurations are the same as those of the nailing machine 1A of the first embodiment.

<Operation Example of the Nailing Machine of the Second Embodiment>

Next, the operation of the nailing machine 1B of the second embodiment will be describe d with reference to each drawing.

FIGS. 21A and 21B show a state before compressed air is supplied. Compressed air is not supplied to the nailing machine 1B in a state where a hose from an air compressor (not shown) is not connected to the chuck 30.

In this way, as described above, the main valve 4 is urged by the main valve spring 41 and located in the top dead center position. Further, in the trigger valve 5, the pilot valve 50 is urged by the trigger valve stem spring 54 and held in the non-operating position. Furthermore, in the trigger valve 5, the trigger valve stem 52 is urged by the trigger valve stem spring 54 and held in the non-operating position. Further, in the trigger valve 5, the timer switch 56 is urged by the timer switch spring 59 and held in the non-operating position.

When the timer switch 56 of the trigger valve 5 is in the non-operating position, the main chamber 3 communicates with the second timer operating flow path 33*b*. Since a hose from an air compressor (not shown) is not connected to the chuck 30, the main chamber 3 is in a state of communicating with the atmosphere. In this way, in the timer 8, the preset piston 83 is urged by the preset piston spring 84 and held in the non-operating position. Further, in the timer 8, the timer piston 80 is urged by the timer piston spring 81 and held in the non-operating position. Furthermore, in the timer 8, the on-off valve part 87G is pushed by the timer piston shaft 86 of the timer piston 80 and is moved to an opening position of opening the flow path communicating the inflow flow path 35 and the operation regulating flow path 34 with each other.

Figure 22:
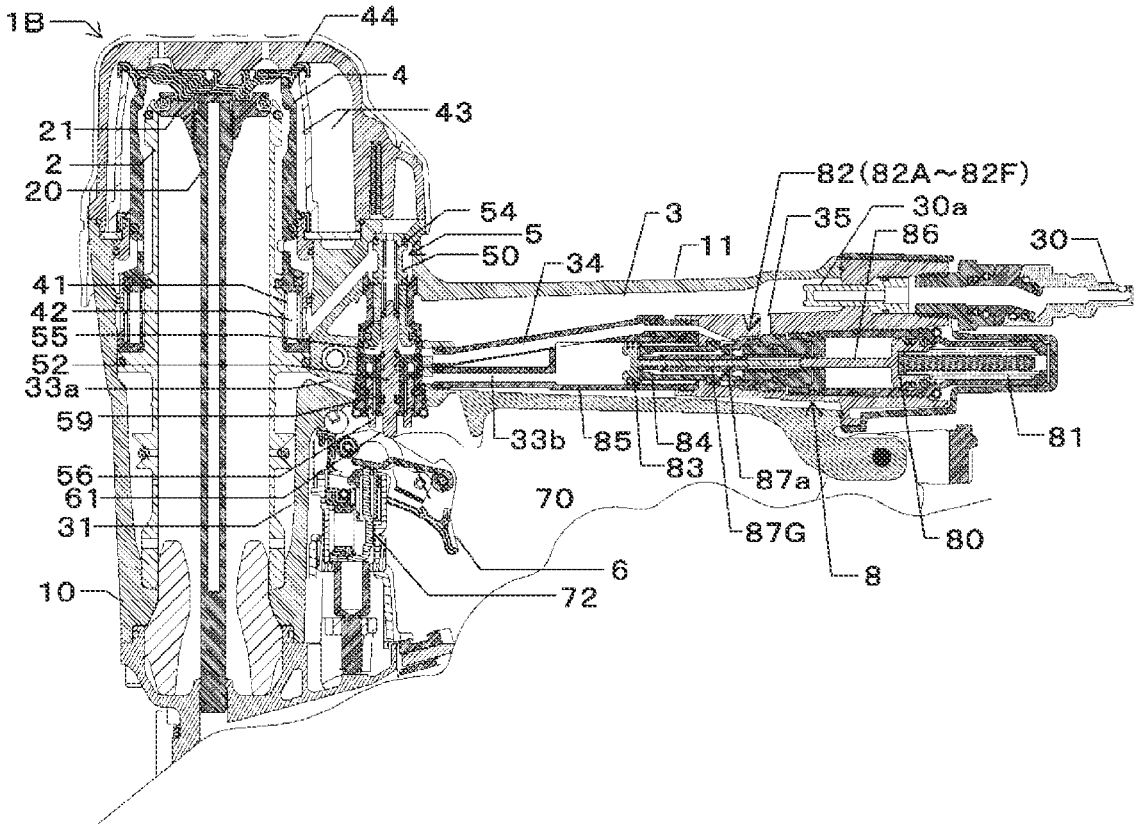
FIG. 22 is an overall sectional view showing a state after compressed air is supplied.

FIG. 22 is an overall sectional view showing a state after compressed air is supplied. In the nailing machine 1B, compressed air is supplied into the main chamber 3 when a hose from an air compressor (not shown) is connected to the chuck 30.

In this way, the main valve 4 is held in the top dead center position. Further, in the trigger valve 5, the pilot valve 50 is held in the non-operating position. Furthermore, in the trigger valve 5, the trigger valve stem 52 is held in the non-operating position. Further, in the trigger valve 5, the timer switch 56 is held in the non-operating position in a state where the trigger 6 does not operate.

When the timer switch 56 of the trigger valve 5 is in the non-operating position, the main chamber 3 communicates with the second timer operating flow path 33*b*. When a hose from an air compressor (not shown) is connected to the chuck 30, the main chamber 3 has the supply pressure. In this way, in the timer 8, the preset piston 83 is pushed by the air pressure corresponding to the supply pressure and is moved to the timekeeping start position. Further, in the timer 8, the timer piston 80 is pushed by the preset piston 83 and is moved to the timekeeping start position. Furthermore, in the timer 8, the on-off valve part 87G is pushed by the preset piston 83 and is moved to a closing position of closing the flow path communicating the inflow flow path 35 and the operation regulating flow path 34 with each other. In this way, the supply pressure is not supplied to the operation regulating flow path 34.

Figure 23:
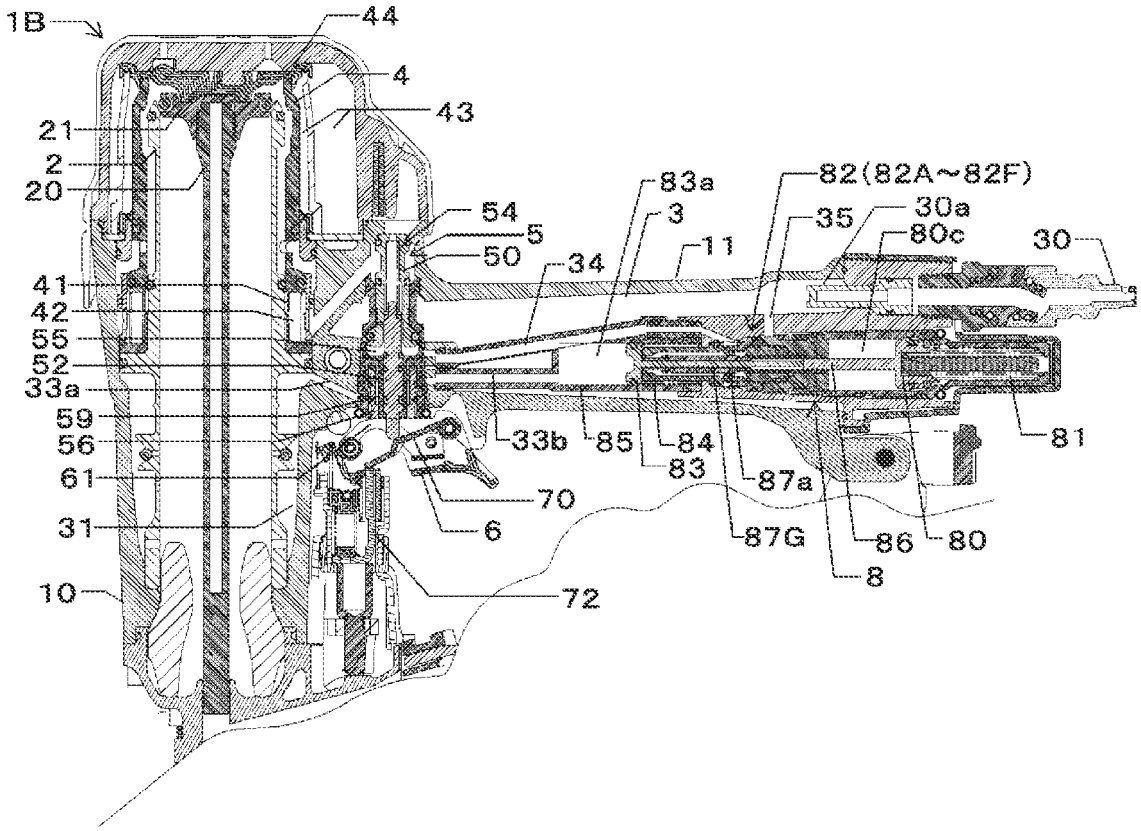
FIG. 23 is an overall sectional view showing a state at the moment when a trigger is operated.

FIG. 23 is an overall sectional view showing a state at the moment when the trigger is operated. In the nailing machine 1B, the timer switch lever 61 pushes the timer switch 56 to the operating position when the trigger 6 is operated to move from the initial position to the operated position.

When the timer switch 56 of the trigger valve 5 is in the operating position, the first timer operating flow path 33*a* and the second timer operating flow path 33*b* communicates with each other. The blowback chamber 31 communicates with the atmosphere. In this way, in the timer 8, the preset piston 83 is urged by the preset piston spring 84 and starts to advance from the timekeeping start position. Further, in the timer 8, the timer piston 80 is urged by the timer piston spring 81 and starts to advance from the timekeeping start position.

Even if the trigger 6 is operated, the contact lever 70 does not push the trigger valve stem 52 in a state where the butting portion 71 of the contact arm 7 is not butted against a member to be driven.

Figure 24:
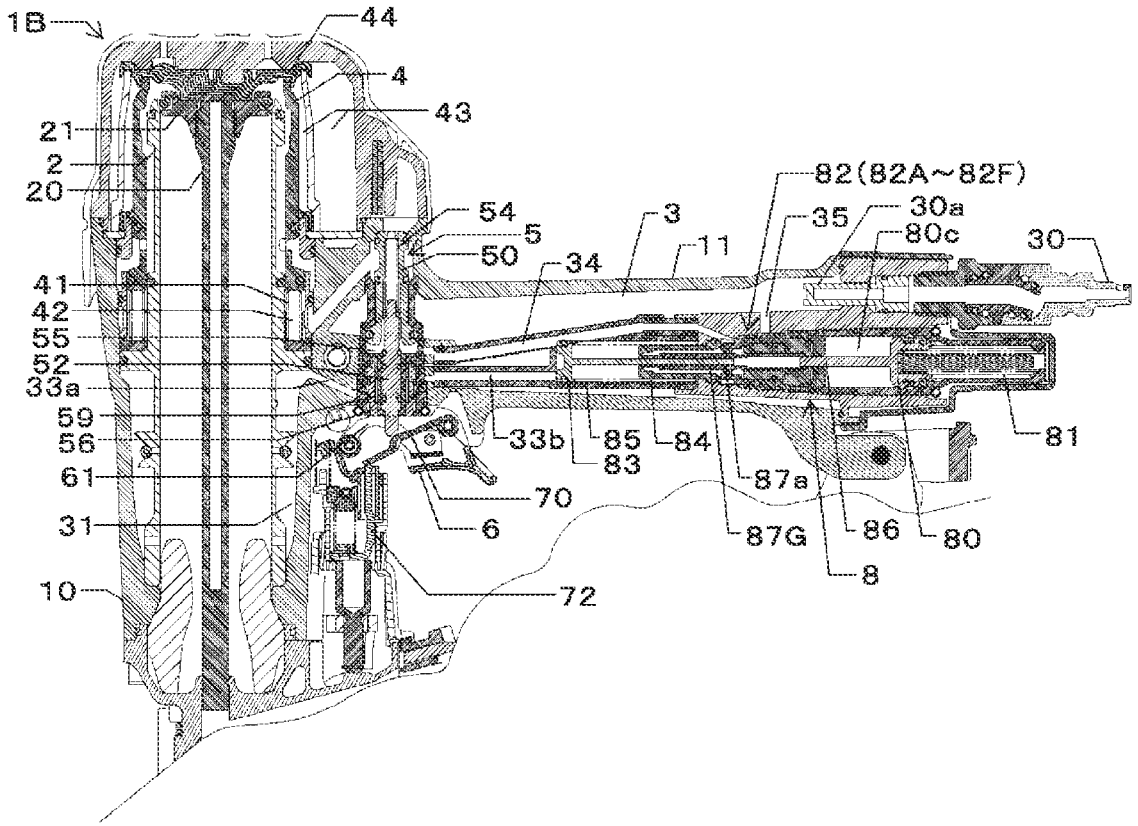
FIG. 24 is an overall sectional view showing a state after 0 seconds from the operation of the trigger.

FIG. 24 is an overall sectional view showing a state after 0 seconds from the operation of the trigger. The preset piston front chamber 83*a* formed by moving the preset piston 83 to the operating position communicates with the blowback chamber 31 via the first timer operating flow path 33*a* and the second timer operating flow path 33*b*. In this way, the preset piston 83 is moved to the non-operating position in a very short time after the operation of the trigger 6.

On the contrary, the timer piston front chamber 80*c*, which is formed by moving the timer piston 80 to the operating position, communicates with the atmosphere via the choke 9. In this way, the timer piston 80 advances with a delay with respect to the preset piston 83.

Figure 25:
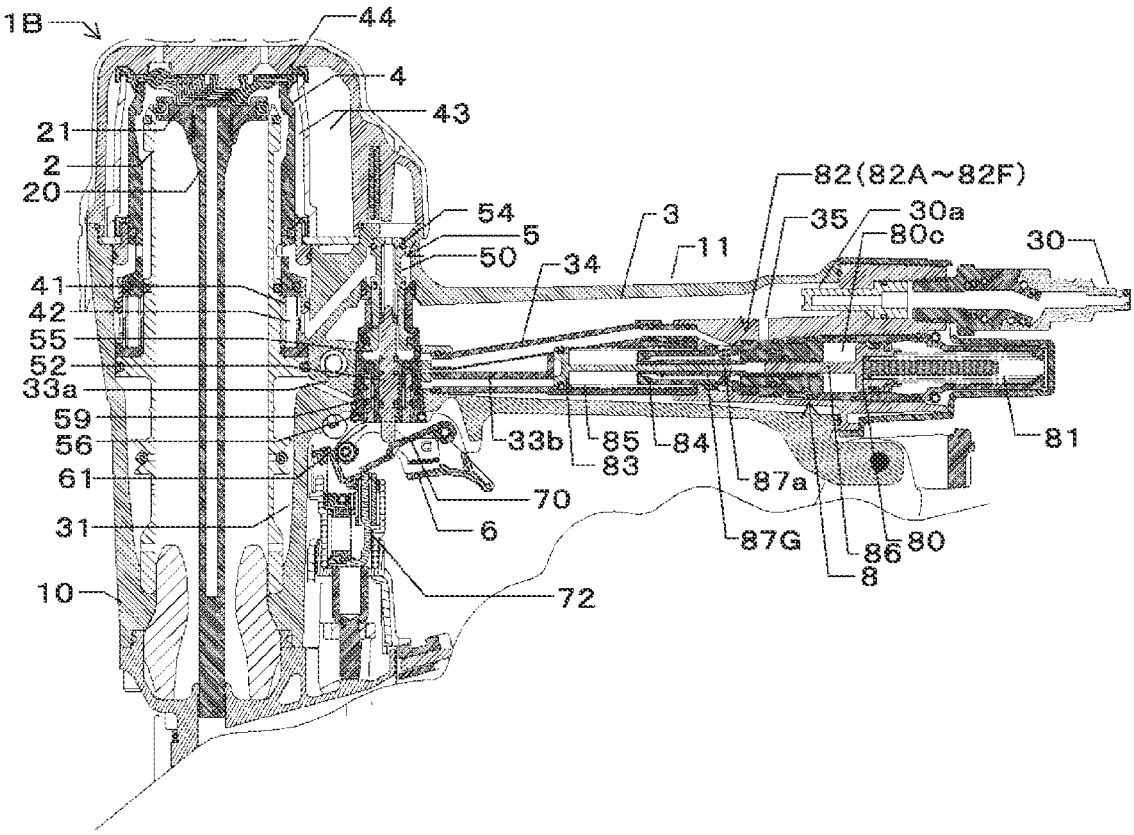
FIG. 25 is an overall sectional view showing a state from 0 seconds from the operation of the trigger to the end of timekeeping.

FIG. 25 is an overall sectional view showing a state from 0 seconds from the operation of the trigger to the end of timekeeping. In the timer 8, the volume of the timer piston front chamber 80*c* decreases when the timer piston 80 advances by being urged by the timer piston spring 81. Since the timer piston front chamber 80*c* communicates with the atmosphere via the choke 9, the discharge amount of air per unit time is small compared to the decrease in volume. In this way, when the timer piston 80 advances and the volume of the timer piston front chamber 80*c* decreases, the pressure in the timer piston front chamber 80*c* increases.

The timer piston 80 advances in a shorter time up to a predetermined position where the pressure in the timer piston front chamber 80*c* rises to a certain degree, as compared with the time from 0 seconds from the operation of the trigger to the end of timekeeping. Further, from the predetermined position where the pressure in the timer piston front chamber 80*c* rises to a certain degree to the non-operating position, the discharge amount of air throttled by the choke 9 becomes a load against the urging by the timer piston spring 81, and the timer piston 80 is moved at a lower speed with respect to the moving speed up to the predetermined position where the pressure in the timer piston front chamber 80*c* rises to a certain degree.

Figure 26:
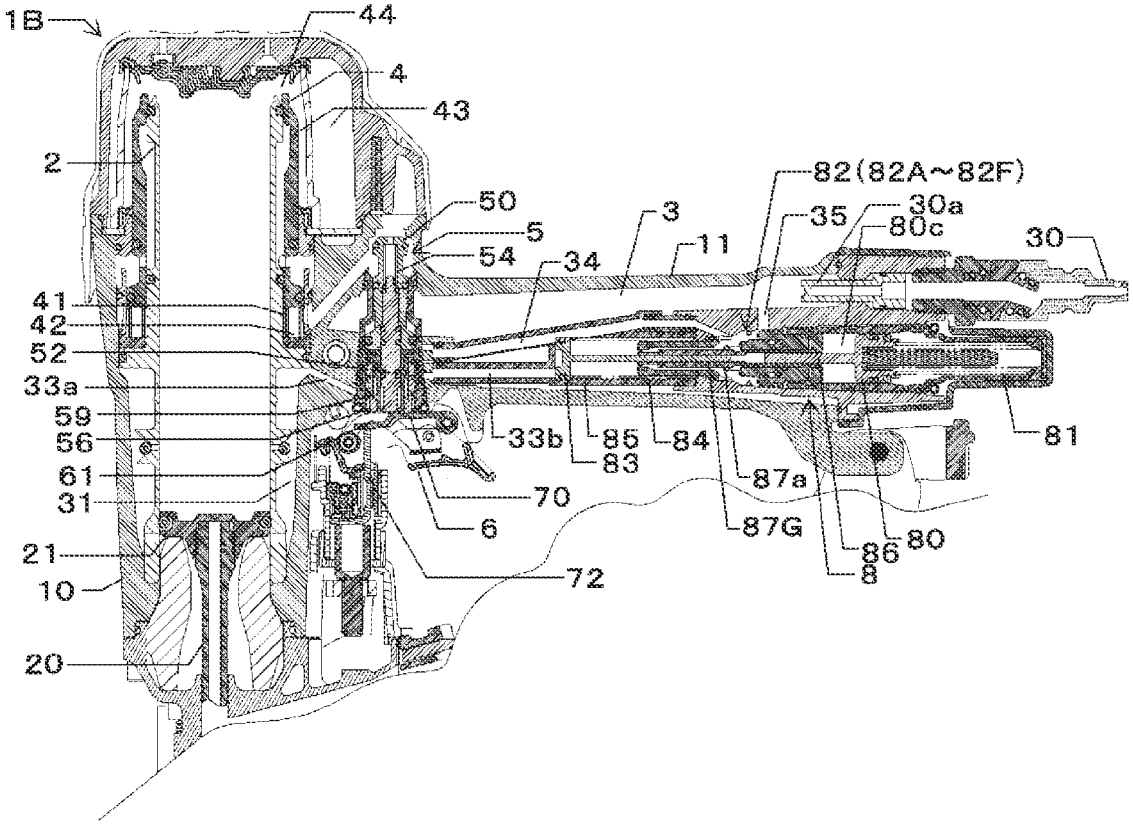
FIG. 26 is an overall sectional view showing a state in which a contact arm is operated from 0 seconds from the operation of the trigger to the end of timekeeping.

FIG. 26 is an overall sectional view showing a state in which the contact arm is operated from 0 seconds from the operation of the trigger to the end of timekeeping.

From 0 seconds from the operation of the trigger to the end of timekeeping, that is, during the period in which the timer piston 80 starts to advance from the timekeeping start position and is moved to the non-operating position, the pressing portion 72 of the contact arm 7 pushes the contact lever 70 when the contact arm 7 shown in FIG. 26 is pressed against the member to be driven.

When the trigger 6 is moved to the operated position, the acting portion 70*a* of the contact lever 70 pushes the trigger valve stem 52. In the trigger valve 5, the flow path communicating the trigger valve lower chamber 55 with the main chamber 3 is closed and the flow path communicating the trigger valve lower chamber 55 with the operation regulating flow path 34 is opened when the trigger valve stem 52 is moved upward by a predetermined amount.

Further, while the timer piston 80 is moved from the timekeeping start position to the non-operating position, the flow path formed between the timer piston housing 82A and the timer piston shaft 86 and the flow path formed between the preset piston housing 85 and the preset piston shaft 83*a* communicate with each other.

In this way, the trigger valve lower chamber 55 communicates with the atmosphere and compressed air is discharged therefrom, so that the air pressure in the trigger valve lower chamber 55 decreases. Therefore, the pilot valve 50 is moved downward, and the first air flow path 32 is opened.

When the first air flow path 32 is opened, the main valve lower chamber 42 is shut off from the main chamber 3 and communicates with the atmosphere. Then, compressed air is discharged from the main valve lower chamber 42, and the air pressure in the main valve lower chamber 42 decreases. In this way, the main valve 4 is moved downward, and the top opening portion 44 is opened. Therefore, the compressed air in the main chamber 3 is supplied to the striking cylinder 2.

In this way, the striking cylinder 2 is operated by the compressed air, the striking piston 21 is moved in the direction of striking out a nail (not shown), and the striking driver 20 performs a striking operation. Further, a part of the compressed air in the striking cylinder 2 is supplied from the inflow/discharge port 31*a* to the blowback chamber 31.

Figure 27:
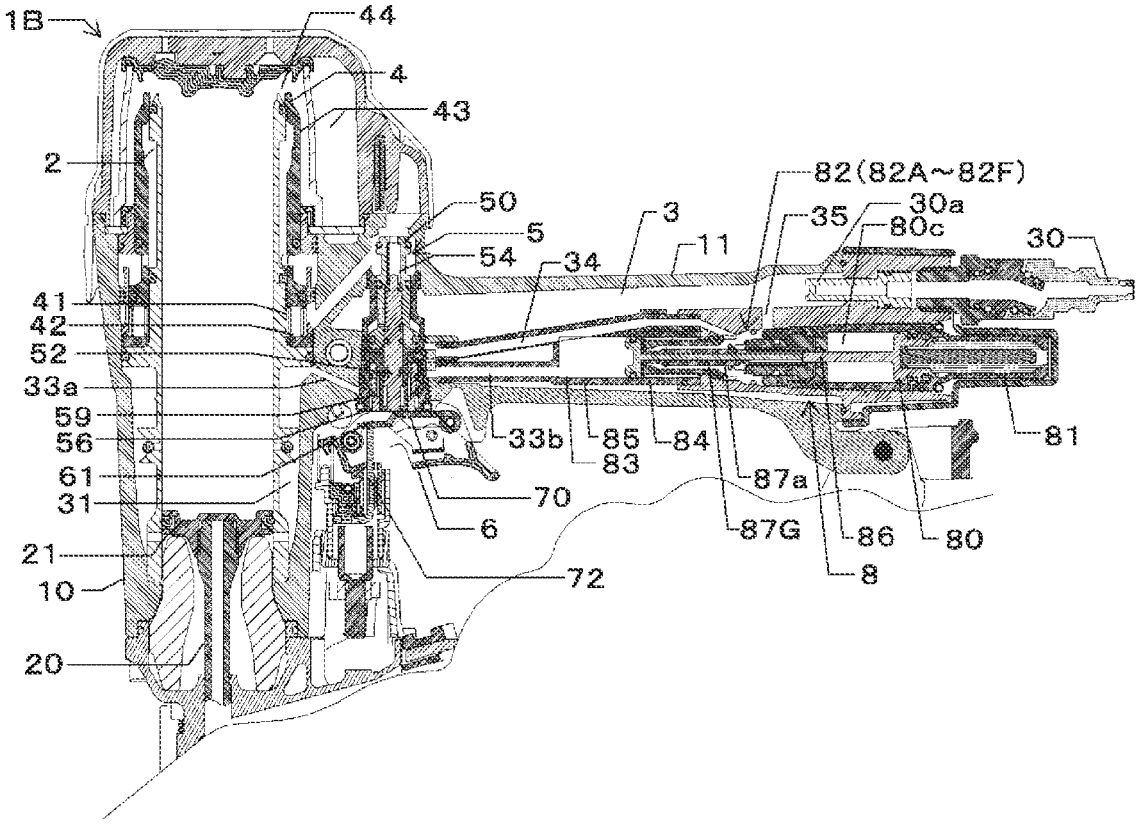
FIG. 27 is an overall sectional view showing a state in which a timer is reset.

FIG. 27 is an overall sectional view showing a state in which the timer is reset. When the trigger 6 is moved to the operated position during the striking operation, the timer switch 56 is moved to the operating position, and the first timer operating flow path 33*a* and the second timer operating flow path 33*b* communicate with each other. Further, during the striking operation, a part of the compressed air in the striking cylinder 2 is supplied from the inflow/discharge port 31*a* to the blowback chamber 31. In this way, in the timer 8, the preset piston 83 is pushed by the air pressure corresponding to the supply pressure of the compressed air and is moved to the timekeeping start position. Further, in the timer 8, the timer piston 80 is pushed by the preset piston 83 and is moved to the timekeeping start position. In this way, the timer 8 is reset.

After the striking operation, compressed air is supplied from the blowback chamber 31 to the striking cylinder 2, the striking piston 21 is moved in the direction of returning the striking driver 20, and the striking piston 21 returns to the top dead center position. When the striking piston 21 returns to the top dead center position, the blowback chamber 31 is in a state of communicating with the atmosphere.

In this way, in the timer 8 after being reset, the preset piston 83 is urged by the preset piston spring 84 and starts to advance from the timekeeping start position. Further, in the timer 8, the timer piston 80 is urged by the timer piston spring 81 and starts to advance from the timekeeping start position. Therefore, the timekeeping is initiated.

Figure 28:
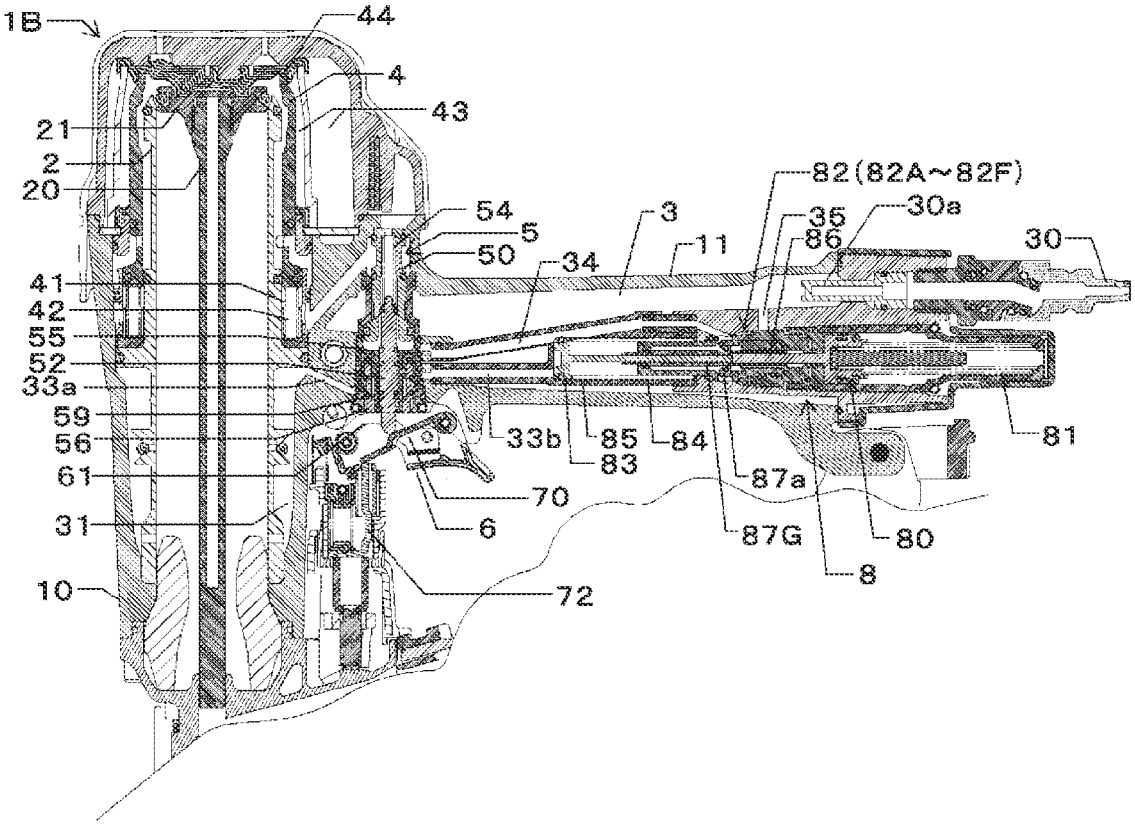
FIG. 28 is an overall sectional view showing a state at the time of time-out.

FIG. 28 is an overall sectional view showing a state at the time of time-out. When the contact arm 7 is not pressed against the member to be driven and the trigger valve stem 52 is not pushed by the contact lever 70 for a predetermined time after the start of timekeeping, the striking cylinder 2 does not operate. Therefore, compressed air is not supplied from the blowback chamber 31 to the preset piston housing 85. In this way, the timer piston 80 is moved to the non-operating position in a predetermined time under the load such as the urging by the timer piston spring 81 and the discharge amount of air throttled by the choke 9.

In the timer 8, the on-off valve part 87G is pushed by the timer piston shaft 86 of the timer piston 80 and is moved to the opening position of opening the flow path communicating the inflow flow path 35 and the operation regulating flow path 34 with each other when the timer piston 80 is moved to the non-operating position. In this way, compressed air is supplied from the main chamber 3 to the operation regulating flow path 34.

Figure 29:
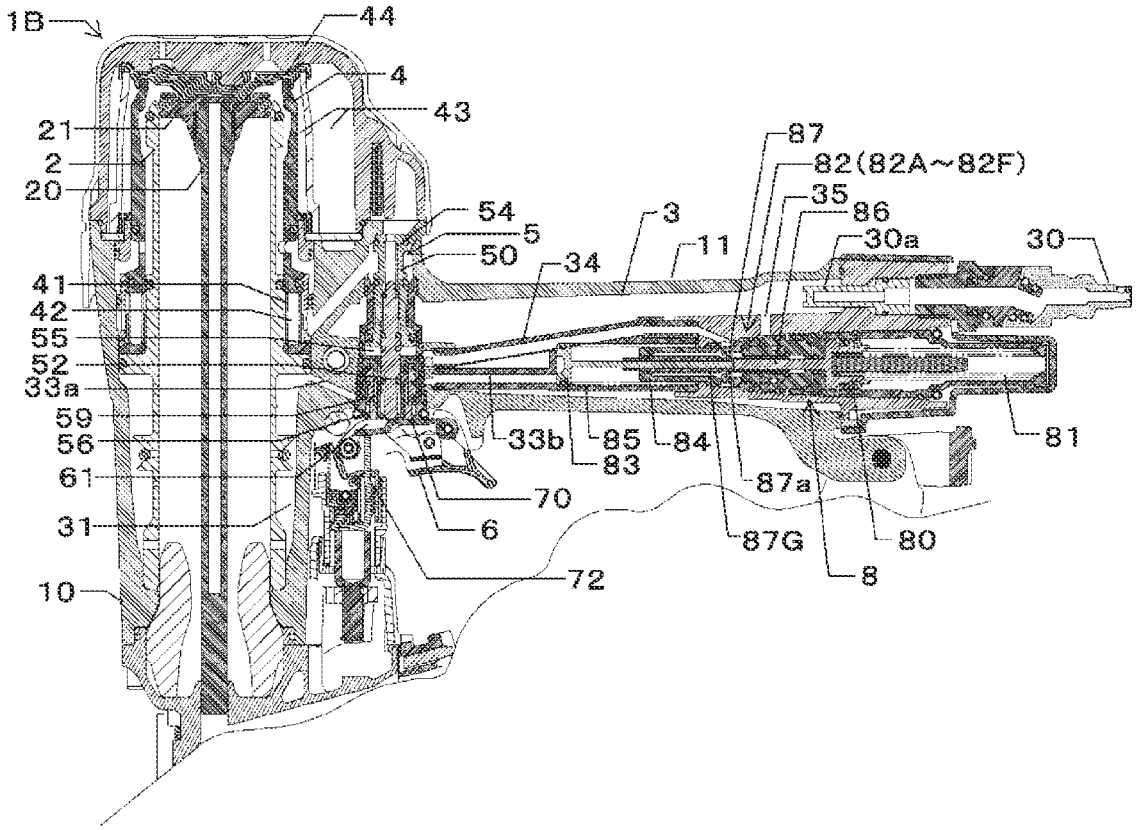
FIG. 29 is an overall sectional view showing a state in which the contact arm is operated after the time-out.

FIG. 29 is an overall sectional view showing a state in which the contact arm is operated after the time-out. When the contact arm 7 shown in FIG. 29 is pressed against the member to be driven after the time-out, the pressing portion 72 of the contact arm 7 pushes the contact lever 70.

When the trigger 6 is moved to the operated position, the acting portion 70*a* of the contact lever 70 pushes the trigger valve stem 52. In the trigger valve 5, the trigger valve lower chamber 55 communicates with the operation regulating flow path 34 when the trigger valve stem 52 is moved upward by a predetermined amount. When the on-off valve part 87G is moved to the opening position, compressed air is supplied from the main chamber 3 to the operation regulating flow path 34. In this way, the trigger valve lower chamber 55 has a supply pressure by compressed air supplied from the main chamber 3 via the operation regulating flow path 34.

Therefore, the pilot valve 50 is held in the upper position due to the relationship between the balance of the air pressure of compressed air and the force of the trigger valve stem spring 54. In this way, the first air flow path 32 is not opened, the main valve 4 is held at the top dead center position, and the striking cylinder 2 does not operate.

<Configuration Example and Operation Example of a Nailing Machine of Another Embodiment>

The first and second embodiments adopt the structure using the meter-out control in which the moving speed of the timer piston is controlled by adjusting the outflow of air compressed by the timer piston pushed by the urging member such as the spring. On the contrary, instead of the throttle disposed on the outflow side of the timer piston cylinder, the throttle may be disposed on the inflow side, and a meter-in control may be adopted in which the moving speed of the piston is controlled by adjusting the amount of air flowing into the cylinder by the piston moved by the urging force of the spring. FIGS. 30A to 30D are sectional views of a main part showing an example of a nailing machine according to another embodiment. A nailing machine 1C according to another embodiment includes a timer 8C using a meter-in control in which the speed of the timer piston 80 is controlled by adjusting the amount of inflow air. In the timer 8C, the air in the main chamber 3 is supplied to the timer piston cylinder 80*d* via a choke 9C.

The choke 9C includes an inflow/outflow flow path 90C1 communicating with the main chamber 3, the filter 91 provided in the inflow/outflow flow path 90C1, the needle 92 for throttling the inflow/outflow flow path 90C1, and an inflow/outflow flow path 90C2 communicating with the timer piston cylinder 80*d*. The choke 9C is attached to the handle 11 via a Y-ring 97*a* having a Y-shaped cross section. The Y-ring 97*a* is an example of a check valve, and opens and closes a flow path 97*b* formed on the outer periphery of the choke 9C according to the direction in which air flows.

The Y-ring 97*a* is deformed in the direction in which the flow path 97*b* on the outer periphery of the choke 9C is opened by the pressure of air flowing from the timer piston cylinder 80*d* into the main chamber 3, and the flow path 97*b* is opened. Further, the Y-ring 97*a* is deformed in the direction in which the flow path 97*b* is closed by the pressure of air flowing from the main chamber 3 to the timer piston 80*d*, and the flow path 97*b* is closed.

Further, the nailing machine 1C includes a discharge flow path 93C that communicates the atmosphere with the timer piston front chamber 80*c* formed by moving the timer piston 80 to the timekeeping start position. The discharge flow path 93C communicates with the timer piston cylinder 80*d* via a flow path or the like formed between the timer piston housing 82D and the timer piston housing 82E, but a throttle such as the choke 9 is provided therein.

In the nailing machine 1C, similarly to the nailing machine 1A of the first embodiment, the timer piston shaft 86 constituting the on-off valve part 87 is formed such that the diameter of the shaft portion 86*b* on the side opposite to the timer piston 80 is larger than the diameter of the shaft portion 86*a* on the side of the timer piston 80 with the flow path forming recess 87*b* interposed therebetween. In the timer piston shaft 86, the pressure receiving surface 87H that receives the force of the compressed air supplied from the main chamber 3 is formed by the diameter difference of the timer piston shaft 86, which is the difference between the diameter of the shaft portion 86*a* and the diameter of the shaft portion 86*b*, and the supply pressure is applied to the timer piston shaft 86 constituting the on-off valve part 87.

Other configurations are the same as those of the nailing machine 1A of the first embodiment.

Figure 30A:
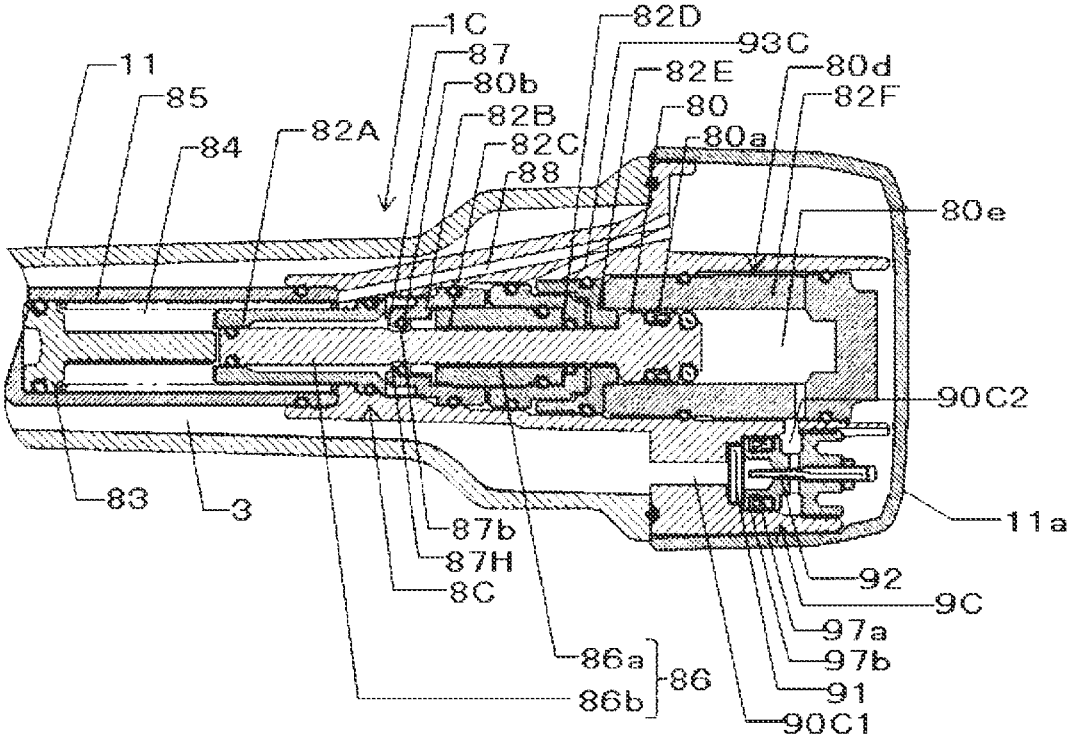
FIG. 30A is a sectional view of a main part showing an example of a nailing machine according to another embodiment.

Hereinafter, the operation of the nailing machine 1C of another embodiment will be described with reference to each drawing. In a state where a hose from an air compressor (not shown) is not connected and compressed air is not supplied, as shown in FIG. 30A, in the timer 8C, the preset piston 83 is urged by the preset piston spring 84 and held in the non-operating position. Further, in the timer 8C, the timer piston 80 is held in the non-operating position.

Figure 30B:
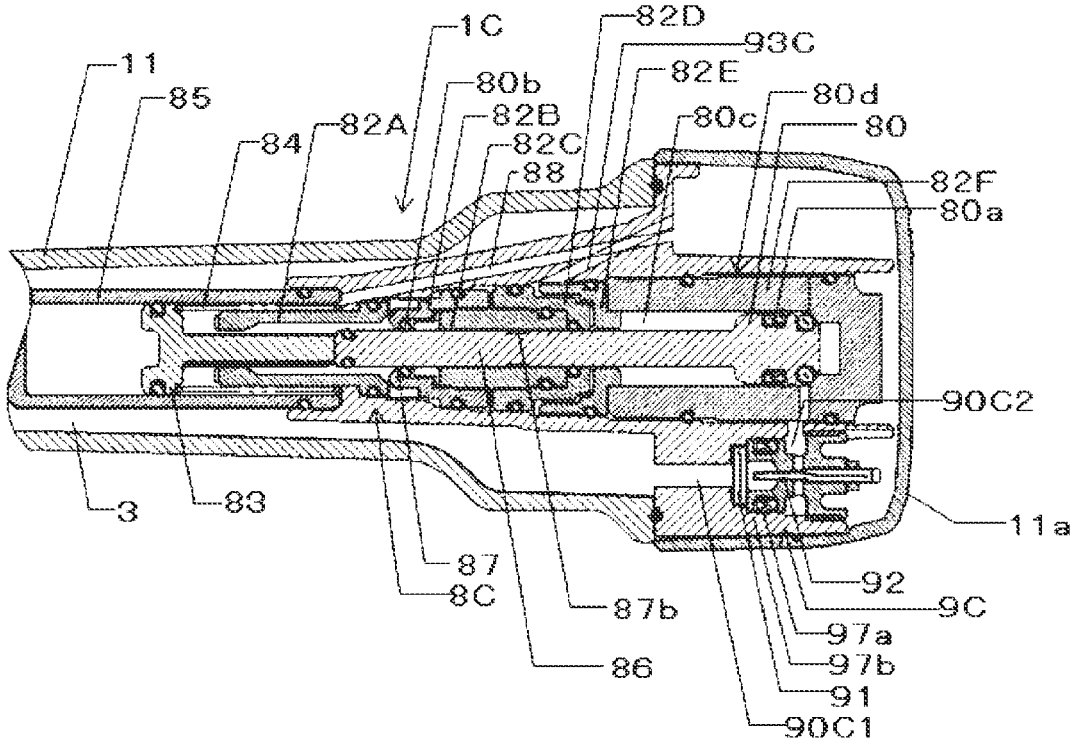
FIG. 30B is a sectional view of a main part showing an example of the nailing machine according to another embodiment.

In the nailing machine 1C, when a hose from an air compressor (not shown) is connected and compressed air is supplied into the main chamber 3, as shown in FIG. 30B, the preset piston 83 of the timer 8C is pushed by air pressure corresponding to the supply pressure, and is moved to the timekeeping start position. Further, in the timer 8C, the timer piston 80 is pushed by the preset piston 83 and is moved to the timekeeping start position.

In the timer 8C, as the timer piston 80 moves to the timekeeping start position, the pressure in the timer piston rear chamber 80*e* increases with the decrease in the volume of a timer piston rear chamber 80*e*. When the pressure in the timer piston rear chamber 80*e* increases and the pressure of air flowing from the timer piston cylinder 80*d* into the main chamber 3 is applied to the Y-ring 97*a*, the Y-ring 97*a* is deformed in the direction in which the flow path 97*b* on the outer periphery of the choke 9C is opened, and the flow path 97*b* is opened. In this way, air is introduced from the timer piston rear chamber 80*e* into the main chamber 3 without passing through the choke 9C, and the timer piston 80 is moved to the timekeeping start position.

Figure 30C:
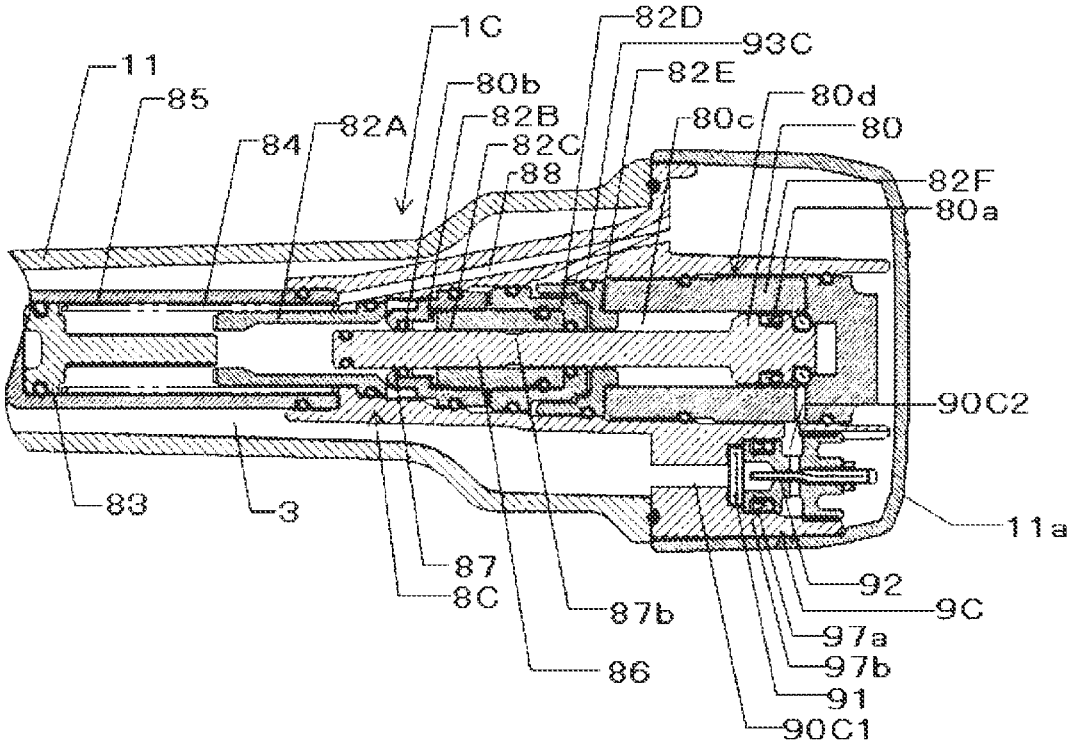
FIG. 30C is a sectional view of a main part showing an example of the nailing machine according to another embodiment.

As shown in FIG. 5C, when the trigger 6 is operated to move from the initial position to the operated position, the preset piston 83 of the timer 8C is urged by the preset piston spring 84 and starts to advance from the timekeeping start position. As shown in FIG. 30C, the preset piston 83 is moved to the non-operating position in a very short time after the operation of the trigger 6.

Figure 30D:
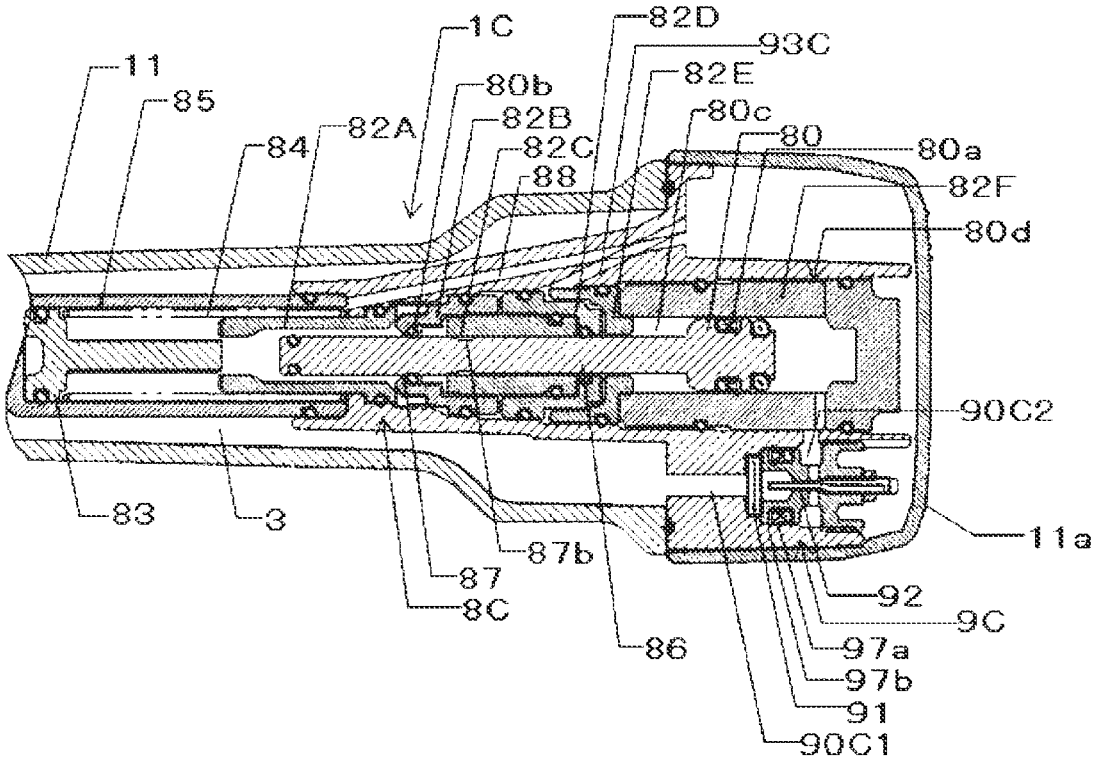
FIG. 30D is a sectional view of a main part showing an example of the nailing machine according to another embodiment.

When the preset piston 83 is moved to the non-operating position, the force for pressing the timer piston 80 to the timekeeping start position is released. When the supply pressure in the main chamber 3 is applied to the Y-ring 97*a*, the Y-ring 97*a* is deformed in the direction in which the flow path 97*b* on the outer periphery of the choke 9C is closed, and the flow path 97*b* is closed. In this way, air is introduced from the main chamber 3 to the timer piston rear chamber 80*e* via the choke 9C, and as shown in FIG. 30D, the timer piston 80 starts to advance from the timekeeping start position.

In the timer 8C, the air in the main chamber 3 is supplied to the timer piston rear chamber 80*e* via the choke 9C, and the timer piston 80 moved to the timekeeping start position is pressed by the air whose flow rate is throttled by the choke 9C. Further, in the timer 8C, the air in the timer piston front chamber 80*c* is discharged from the discharge flow path 93C into the atmosphere. In this way, the timer piston 80 is pressed by the air whose flow rate is throttled by the choke 9C, and the moving speed of the timer piston 80 is controlled.

When the contact arm 7 shown in FIG. 1 is pressed against the member to be driven during the period in which the timer piston 80 starts to advance from the timekeeping start position and is moved to the non-operating position, the trigger 6 is moved to the operated position. In this way, as described above, compressed air in the main chamber 3 is supplied to the striking cylinder 2, and the striking driver 20 performs the striking operation.

Further, during the striking operation, the preset piston 83 of the timer 8C is pushed by air pressure corresponding to the supply pressure of compressed air and is moved to the timekeeping start position. Further, the timer piston 80 is pushed by the preset piston 83 and is moved to the timekeeping start position, and the timer 8C is reset.

In the timer 8C after being reset by the striking operation, the preset piston 83 advances from the timekeeping start position and moves to the non-operating position by being urged by the preset piston spring 84. Further, in the timer 8C, as described above, the air in the main chamber 3 is supplied to the timer piston rear chamber 80*e* via the choke 9C, and the timer piston 80 moved to the timekeeping start position advances by being pressed by the air whose flow rate is throttled by the choke 9C, and the timekeeping is initiated.

When the contact arm 7 shown in FIG. 1 is not pressed against the member to be driven for a predetermined time after the start of timekeeping, the striking cylinder 2 does not operate, and therefore, compressed air is not supplied to the preset piston housing 85. In this way, the timer piston 80 is moved to the non-operating position in a predetermined time under the load such as the pressure of air whose flow rate is throttled by the choke 9 and the sliding resistance.

In the timer 8C, the on-off valve part 87 is opened when the timer piston 80 is moved to the non-operating position. When the on-off valve part 87 is opened, as described above, the trigger 6 is in a state of being moved to the operated position, and the striking cylinder 2 does not operate even when the contact arm 7 shown in FIG. 1 is pressed against the member to be driven after the time-out.

In the operation of the timer piston 80 moving from the timekeeping start position to the non-operating position, as described above, the sliding resistance of the on-off valve part 87 and the like using the O-ring as the sealing member becomes large due to the influence of the supply pressure, which affects the time until the time-out. Therefore, the pressure receiving surface 87H that receives the force of compressed air supplied from the main chamber 3 is formed on the timer piston shaft 86 constituting the on-off valve part 87, and a force that cancels the sliding resistance by using the supply pressure is applied to the timer piston 80.

In the configuration in which the pressure receiving surface 87H using the diameter difference of the timer piston shaft 86 generates a force that pushes the timer piston shaft 86 in the axial direction by the supply pressure, similarly to the sliding resistance, the force that pushes the timer piston shaft 86 also increases as the supply pressure increases.

Therefore, the force that pushes the timer piston shaft 86 in the axial direction by the supply pressure is generated in the direction of cancelling the sliding resistance. In this way, even when the sliding resistance between the timer piston shaft 86 and the O-ring 87*a* increases in proportion to the supply pressure, the force that pushes the timer piston shaft 86 in the axial direction also increases by the pressure receiving surface 87H, so that the change in sliding resistance can be cancelled.

Further, the timer piston housings 82A to 82F have the same configuration as those in the nailing machine 1A of the first embodiment and can obtain the same effect as that of the nailing machine 1A of the first embodiment by having a configuration for improving accuracy and a configuration for securing a flow path, and the like.

Figure 31A:
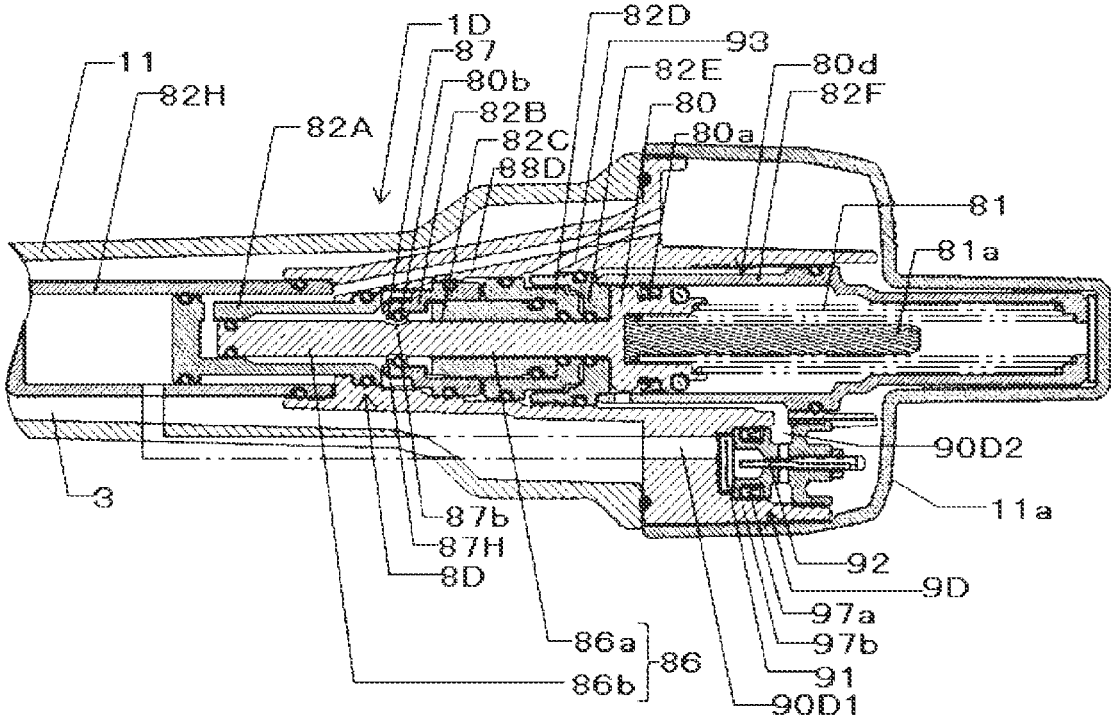
FIG. 31A is a sectional view of a main part showing an example of a nailing machine according to still another embodiment.
Figure 31B:
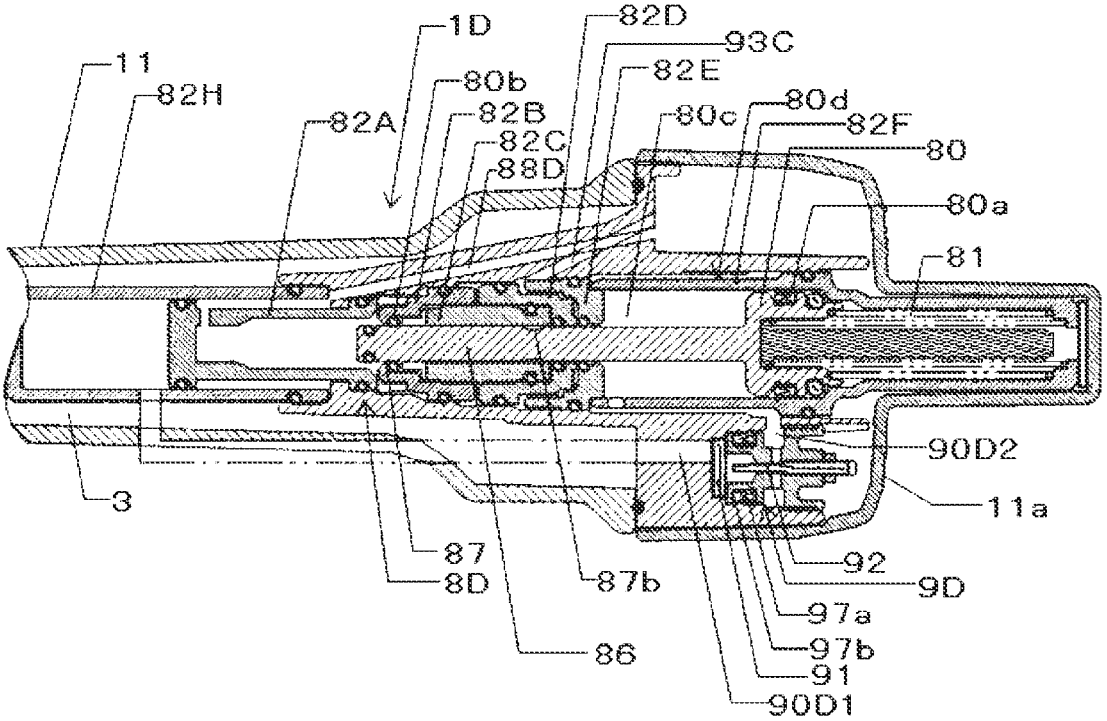
FIG. 31B is a sectional view of a main part showing an example of the nailing machine according to still another embodiment.
Figure 31C:
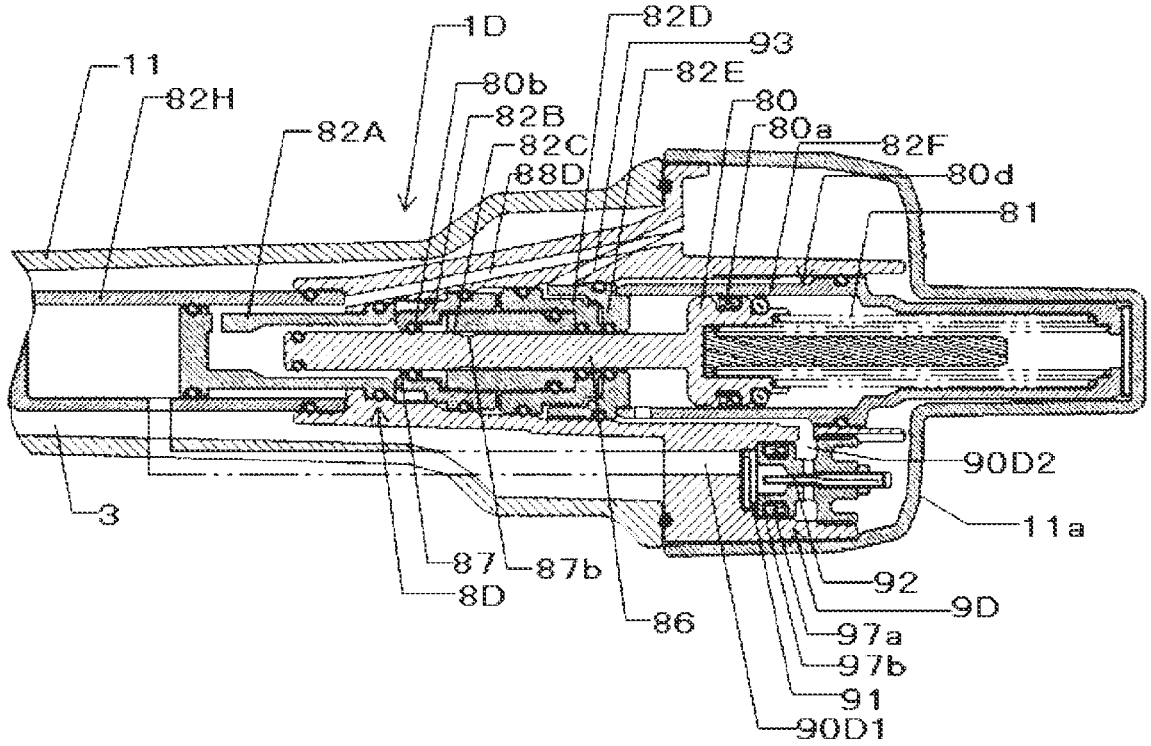
FIG. 31C is a sectional view of a main part showing an example of the nailing machine according to still another embodiment.

Although, in each of the above-described embodiments, the timer piston is pushed by an urging member such as a spring, the timer piston may be pushed by air pressure. In the following example, a meter-out control in which the throttle is arranged on the outflow side of the timer piston cylinder will be described as an example, but a meter-in control in which the throttle is arranged on the inflow side of the timer piston cylinder may be adopted. FIGS. 31A to 31C are sectional views of a main part showing an example of a nailing machine according to still another embodiment. A nailing machine 1D of another embodiment includes a timer 8D using a meter-out control in which the speed of the timer piston 80 is controlled by adjusting the amount of outflow air. In the timer 8D, the air in the timer piston cylinder 80*d* is discharged via a choke 9D.

As shown in FIG. 1, the choke 9D includes an inflow/outflow flow path 90D1 that communicates with a timer piston housing 82H connected to the second timer operating flow path 33*b* communicating with the main chamber 3 or the blowback chamber 31 by an operation of the timer switch 56, the filter 91 provided in the inflow/outflow flow path 90D1, the needle 92 for throttling the inflow/outflow flow path 90D1, and an inflow/outflow flow path 90D2 communicating with the timer piston cylinder 80*d*. The choke 9D is attached to the handle 11 via the Y-ring 97*a* having a Y-shaped cross section. The Y-ring 97*a* is an example of a check valve, and opens and closes the flow path 97*b* formed on the outer periphery of the choke 9D according to the direction in which air flows.

The Y-ring 97*a* is deformed in the direction in which the flow path 97*b* on the outer periphery of the choke 9D is opened by the pressure of air flowing from the inflow/outflow flow path 90D1 to the timer piston cylinder 80*d*, and the flow path 97*b* is opened. Further, the Y-ring 97*a* is deformed in the direction in which the flow path 97*b* is closed by the pressure of air flowing from the timer piston cylinder 80*d* to the inflow/outflow flow path 90D1, and the flow path 97*b* is closed.

Further, the timer 8D includes a discharge flow path 88D communicating the timer piston housing 82A with the atmosphere. In the timer 8D, the air in the timer piston housing 82A is discharged from the discharge flow path 88D to the outside by the operation of moving the timer piston.

In the nailing machine 1D, similarly to the nailing machine 1A of the first embodiment, the pressure receiving surface 87H that receives the force of compressed air supplied from the main chamber 3 is formed on the timer piston shaft 86 constituting the on-off valve part 87 by the difference between the diameter of the shaft portion 86*a* and the diameter of the shaft portion 86*b*, and the supply pressure is applied to the timer piston shaft 86 constituting the on-off valve part 87.

Other configurations are the same as those of the nailing machine 1A of the first embodiment.

Hereinafter, the operation of the nailing machine 1D of another embodiment will be described with reference to each drawing. In a state where a hose from an air compressor (not shown) is not connected and compressed air is not supplied, as shown in FIG. 31A, in the timer 8D, the timer piston 80 is urged by the timer piston spring 81 and held in the non-operating position.

In the nailing machine 1D, when a hose from an air compressor (not shown) is connected and compressed air is supplied into the main chamber 3, the compressed air in the main chamber 3 is supplied to the timer piston housing 82H and the pressure in the timer piston housing 82H increases. When the pressure in the timer piston housing 82H increases and the supply pressure is applied to the Y-ring 97*a* via the inflow/outflow flow path 90D1, the Y-ring 97*a* is deformed in the direction in which the flow path 97*b* on the outer periphery of the choke 9D is opened, and the flow path 97*b* is opened. In this way, air is introduced from the timer piston housing 82E to the timer piston cylinder 80*d* without passing through the choke 9D, and as shown in FIG. 31B, the timer piston 80 is moved to the timekeeping start position.

As shown in FIG. 5A, when the trigger 6 is operated to move from the initial position to the operated position, in the timer 8D, the timer piston housing 82H have atmospheric pressure and the supply pressure for pressing the timer piston 80 to the timekeeping start position is released. In this way, in the timer 8D, the timer piston 80 is urged by the timer piston spring 81 and starts to advance from the timekeeping start position.

In the timer 8D, as shown in FIG. 31C, when the timer piston 80 starts to advance from the timekeeping start position, the volume of the timer piston front chamber 80*c* is reduced, and the pressure in the timer piston front chamber 80*c* increases. When the pressure in the timer piston front chamber 80*c* increases and air pressure is applied to the Y-ring 97*a* via the inflow/outflow flow path 90D2, the Y-ring 97*a* is deformed in the direction in which the flow path 97*b* on the outer periphery of the choke 9D is closed, and the flow path 97*b* is closed. In this way, air flows out from the timer piston front chamber 80*c* to the inflow/outflow flow path 90D1 via the choke 9D.

When the throttle of the choke 9D is narrowed to the point where only a very small amount of air flows, the timer piston front chamber 80*c* can be regarded as being substantially sealed at the moment when the timer piston 80 is moved. Thus, the volume of the timer piston front chamber 80*c* is reduced by the amount of movement of the timer piston 80, and the pressure is increased by that amount. When the spring force of the timer piston spring 81 and the surface pressure of the air pressure due to internal compression are balanced, the timer piston 80 can advance by the amount of air released via the choke 9D from that time. In this way, the moving speed of the timer piston 80 is controlled.

When the contact arm 7 shown in FIG. 1 is pressed against the member to be driven during the period in which the timer piston 80 starts to advance from the timekeeping start position and is moved to the non-operating position, the trigger 6 is moved to the operated position. In this way, as described above, compressed air in the main chamber 3 is supplied to the striking cylinder 2, and the striking driver 20 performs the striking operation.

Further, during the striking operation, in the timer 8D, compressed air is supplied to the timer piston housing 82H and the pressure in the timer piston housing 82H increases. When the pressure in the timer piston housing 82H increases, as shown in FIG. 31B, the timer piston 80 is moved to the timekeeping start position, and the timer 8D is reset.

In the timer 8D after being reset by the striking operation, the timer piston 80 advances by being urged by the timer piston spring 81, and the timekeeping is initiated.

When the contact arm 7 shown in FIG. 1 is not pressed against the member to be driven for a predetermined time after the start of timekeeping, the striking cylinder 2 does not operate, and therefore, compressed air is not supplied to the timer piston housing 82H. In this way, the timer piston 80 is moved to the non-operating position in a predetermined time by the urging of the timer piston spring 81 and the outflow of air whose flow rate is throttled by the choke 9D.

In the timer 8D, the on-off valve part 87 is opened when the timer piston 80 is moved to the non-operating position. When the on-off valve part 87 is opened, as described above, the trigger 6 is in a state of being moved to the operated position, and the striking cylinder 2 does not operate even when the contact arm 7 shown in FIG. 1 is pressed against the member to be driven after the time-out.

In the operation of the timer piston 80 moving from the timekeeping start position to the non-operating position, as described above, the sliding resistance of the on-off valve part 87 and the like using the O-ring as the sealing member becomes large due to the influence of the supply pressure, which affects the time until the time-out. Therefore, the pressure receiving surface 87H that receives the force of compressed air supplied from the main chamber 3 is formed on the timer piston shaft 86 constituting the on-off valve part 87, and a force that cancels the sliding resistance by using the supply pressure is applied to the timer piston 80.

In the configuration in which the pressure receiving surface 87H using the diameter difference of the timer piston shaft 86 generates a force that pushes the timer piston shaft 86 in the axial direction by the supply pressure, similarly to the sliding resistance, the force that pushes the timer piston shaft 86 also increases as the supply pressure increases.

Therefore, the force that pushes the timer piston shaft 86 in the axial direction by the supply pressure is generated in the direction of cancelling the sliding resistance. In this way, even when the sliding resistance between the timer piston shaft 86 and the O-ring 87*a* increases in proportion to the supply pressure, the force that pushes the timer piston shaft 86 in the axial direction also increases by the pressure receiving surface 87H, so that the change in sliding resistance can be cancelled.

Further, the timer piston housings 82A to 82F have the same configuration as those in the nailing machine 1A of the first embodiment and can obtain the same effect as that of the nailing machine 1A of the first embodiment by having a configuration for improving accuracy and a configuration for securing a flow path, and the like.

Figure 32A:
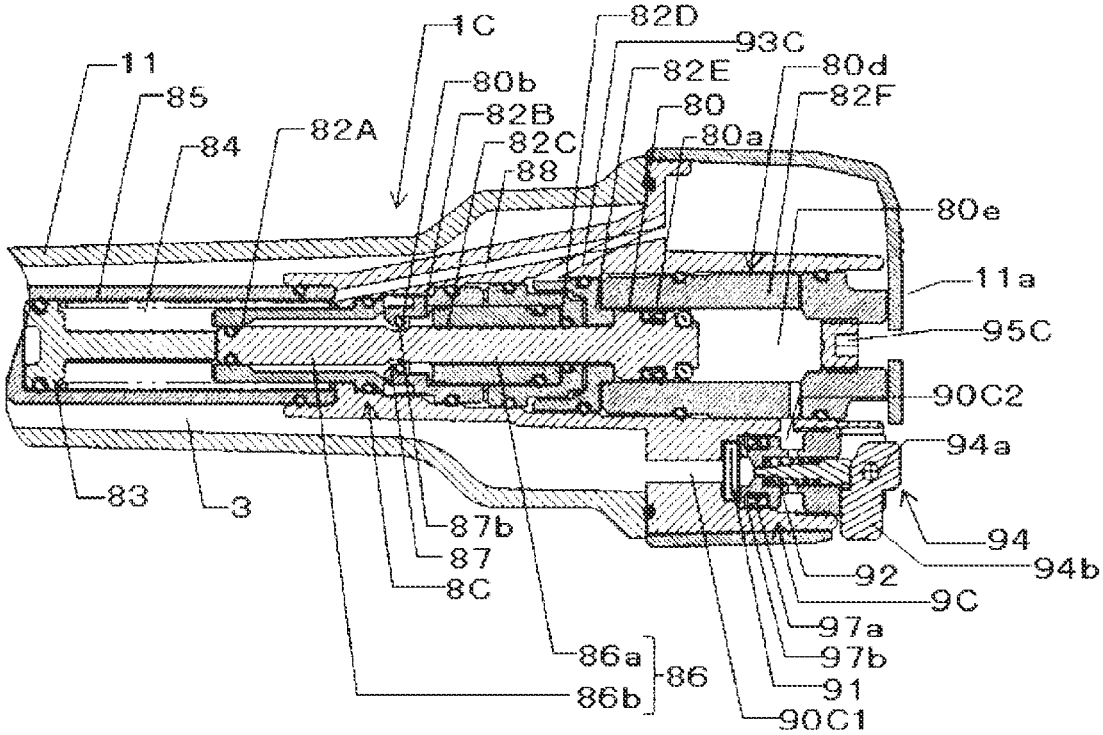
FIG. 32A is a sectional view of a main part showing an example of a mechanism for adjusting the time until the time-out in a nailing machine according to another embodiment.
Figure 32B:
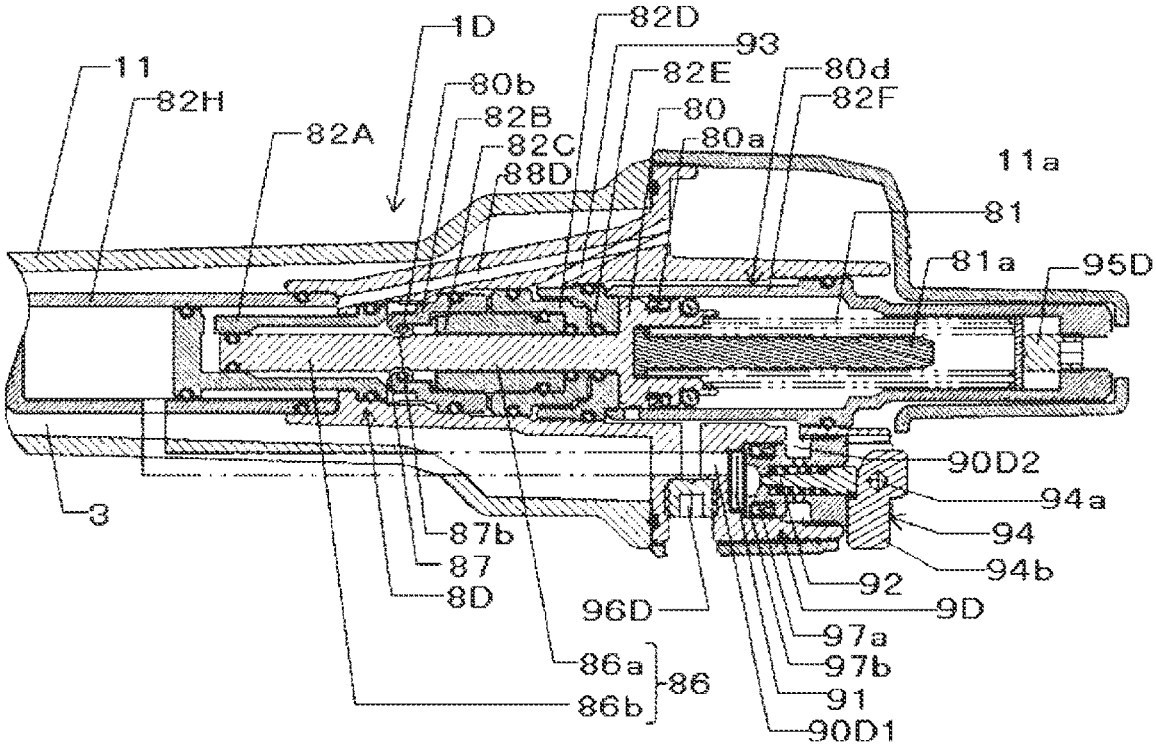
FIG. 32B is a sectional view of a main part showing an example of the mechanism for adjusting the time until the time-out in the nailing machine according to another embodiment.

FIGS. 32A and 32B are sectional views of a main part showing an example of a mechanism for adjusting the time until the time-out in the nailing machine according to another embodiment. As described above, a user can easily and reliably adjust the time until the time-out from the outside of the end cap 11*a* of the handle 11, so that it is possible to adjust whether to prioritize safety or operability according to the user's preference.

Therefore, as shown in FIG. 32A, the nailing machine 1C includes the throttling amount adjustment part 94 of the choke 9C and a volume adjustment part 95C. The throttling amount adjustment part 94 makes it possible to adjust the throttling amount in two steps by adjusting the position of the needle 92 in a stepwise manner, in this example, in two steps by the displacement of the throttling amount adjustment lever 94*b* with the shaft 94*a* as a fulcrum.

The volume adjustment part 95C makes it possible to adjust the volume of the timer piston cylinder 80*d* in a stepless manner with a screw or in a stepwise manner with a lever or the like.

In FIG. 32A, the throttling amount adjustment part 94 is set so that the throttling amount by the needle 92 is reduced and the time until the time-out is shortened. Further, the volume adjustment part 95C is set so that the volume of the timer piston cylinder 80*d* is increased and the time until the time-out is shortened. By setting the throttling amount adjustment part 94 and the volume adjustment part 95C as described above, the time until the time-out is set to be shorter.

As shown in FIG. 32B, the nailing machine 1D includes the throttling amount adjustment part 94 of the choke 9D, a spring force adjustment part 95D, and a volume adjustment part 96D. The throttling amount adjustment part 94 makes it possible to adjust the throttling amount in two steps by adjusting the position of the needle 92 in a stepwise manner, in this example, in two steps by the displacement of the throttling amount adjustment lever 94*b* with the shaft 94*a* as a fulcrum.

The spring force adjustment part 95D makes it possible to adjust the spring force of the timer piston spring 81 that urges the timer piston 80 in a stepless manner with a screw or in a stepwise manner with a lever or the like. The volume adjustment part 96D makes it possible to adjust the volume of the inflow/outflow flow path 90D2 in a stepless manner with a screw or in a stepwise manner with a lever or the like.

In FIG. 32B, the throttling amount adjustment part 94 is set so that the throttling amount by the needle 92 is reduced and the time until the time-out is shortened. Further, the spring force adjustment part 95D is set so that the spring force of the timer piston spring 81 is strengthen and the time until the time-out is shortened. Furthermore, the volume adjustment part 96D is set so that the volume of the inflow/outflow flow path 90D2 is reduced and the time until the time-out is shortened. By setting the throttling amount adjustment part 94, the spring force adjustment part 95D and the volume adjustment part 96D as described above, the time until the time-out is set to be shorter.

What is claimed is:

1. A pneumatic tool comprising:

a drive part configured to be driven by compressed air;

a control valve configured to switch the presence or absence of operation of the drive part; and a timer part configured to switch the presence or absence of operation of the control valve after a lapse of a predetermined time, wherein the timer part comprises a timer piston configured to move in one direction and perform timekeeping, a timer piston cylinder configured to support the timer piston such that the timer piston can slide, an urging member configured to apply urging force in the one direction to the timer piston, and an on-off valve part configured to switch the presence or absence of operation of the control valve in conjunction with the timer piston, wherein the on-off valve part comprises a shaft portion configured to move in conjunction with the timer piston, and compressed air flowing into the on-off valve part presses the shaft portion in the one direction, and wherein with respect to the one direction, at least part of the timer piston is located between the on-off valve part and the urging member.

2. The pneumatic tool according to claim 1, wherein, due to the movement of the on-off valve part in conjunction with the movement of the timer piston in the one direction, sliding resistance is generated in the other direction opposite to the one direction, and the on-off valve part is pressed in the one direction by the air pressure of compressed air that drives the drive part.

3. The pneumatic tool according to claim 1, wherein the on-off valve part comprises a pressure receiving surface that receives the air pressure of compressed air that drives the drive part by providing a difference in the diameter of the shaft portion.

4. The pneumatic tool according to claim 1, wherein the timer piston comprises a sealing member that slides on an inner peripheral surface of the timer piston cylinder, and the sealing member has a lip structure.

5. The pneumatic tool according to claim 1, wherein the timer part comprises a choke portion configured to adjust the amount of outflow air from the timer piston cylinder.

6. The pneumatic tool according to claim 5, wherein the timer piston is moved in the one direction by the urging of the urging member to compress the air inside the timer piston cylinder and cause the air pressure inside the timer piston cylinder to be lower than that of compressed air that drives the drive part.

7. The pneumatic tool according to claim 1, wherein the timer part comprises a choke portion configured to adjust the amount of inflow air into the timer piston cylinder.

8. The pneumatic tool according to claim 1, wherein the timer piston is positioned inside of the timer piston cylinder, and at least part of the on-off valve part is outside of the timer piston cylinder.

9. The pneumatic tool according to claim 1, wherein a timer piston shaft extends from the timer piston, and the timer piston shaft includes the shaft portion forming part of the on-off valve part.

10. The pneumatic tool according to claim 1, wherein at least part of the on-off valve part is outside of the timer piston cylinder on a downstream side of the timer piston cylinder with respect to the one direction.

11. A pneumatic tool comprising:

a drive part configured to be driven by compressed air;

a control valve configured to switch the presence or absence of operation of the drive part; and a timer part configured to switch the presence or absence of operation of the control valve after a lapse of a predetermined time, wherein the timer part comprises a timer piston configured to move in one direction and perform timekeeping, a timer piston cylinder configured to support the timer piston such that the timer piston can slide, and an on-off valve part configured to switch the presence or absence of operation of the control valve in conjunction with the timer piston, wherein the on-off valve part comprises a shaft portion configured to move in conjunction with the timer piston, and compressed air flowing into the on-off valve part presses the shaft portion in the one direction, and wherein the on-off valve part comprises a mounting groove portion to which a sealing member on which the shaft portion slides is mounted, and a deformation suppressing portion configured to suppress deformation of the sealing member mounted to the mounting groove portion.

12. The pneumatic tool according to claim 11, wherein the sealing member mounted to the mounting groove portion opens and closes a flow path through which air passes to switch the presence or absence of operation of the control valve by the movement of the shaft portion.

* * * * *